US010167102B2

(12) United States Patent
Rubitschung

(10) Patent No.: US 10,167,102 B2
(45) Date of Patent: Jan. 1, 2019

(54) APPARATUS FOR TRANSFERRING PROCESS MATERIAL BETWEEN A FIRST CONTAINER AND A SECOND CONTAINER, AND METHOD FOR THIS PURPOSE

(71) Applicant: Rubitec AG, Bennwil (CH)

(72) Inventor: Christoph Rubitschung, Lampenberg (CH)

(73) Assignee: Rubitec AG, Bennwil (CH)

( * ) Notice: Subject to any disclaimer, the term of this patent is extended or adjusted under 35 U.S.C. 154(b) by 8 days.

(21) Appl. No.: 14/916,021

(22) PCT Filed: Sep. 2, 2014

(86) PCT No.: PCT/CH2014/000126
§ 371 (c)(1),
(2) Date: Mar. 2, 2016

(87) PCT Pub. No.: WO2015/027350
PCT Pub. Date: Mar. 5, 2015

(65) Prior Publication Data

US 2016/0214754 A1 Jul. 28, 2016

(30) Foreign Application Priority Data

Sep. 2, 2013 (CH) ..... 1485/13

(51) Int. Cl.
*B65B 69/00* (2006.01)
*B65B 39/00* (2006.01)

(52) U.S. Cl.
CPC ..... *B65B 69/0075* (2013.01); *B65B 39/007* (2013.01)

(58) Field of Classification Search
CPC ..... B65B 39/007; B65B 69/0075; B65B 69/0083; B67D 7/54
(Continued)

(56) References Cited

U.S. PATENT DOCUMENTS 4,344,468 A 8/1982 Sandberg
4,703,782 A * 11/1987 Henkel, Sr. ..... B65B 1/26 141/114

(Continued)

FOREIGN PATENT DOCUMENTS

CH 698646 B1 9/2009
CH 699603 3/2010

(Continued)

OTHER PUBLICATIONS

International Search Report of the International Searching Authority dated Oct. 10, 2014, along with its English translation, issued in connection with International Patent Appln. No. PCT/CH2014/000126 (7 pages).

(Continued)

*Primary Examiner* — Timothy L Maust
(74) *Attorney, Agent, or Firm* — McCarter & English, LLP

(57) ABSTRACT

The apparatus for transferring process material between a first container and a second container has, as its essential constituent parts, at least one first tensioning unit, which has a first tensioner and a second tensioner, which can be actuated independently of one another, and also a tubular liner piece, which extends indirectly between the containers in order to seal off the transition between the containers from the exterior. The tensioning unit has fixed in it, temporarily, the near end portion of the liner piece and the near end portion of a tubular liner remainder left over from a previous transfer operation. In specific applications, a transfer means is installed between the containers. The process material is usually of a sensitive nature e.g. a pharmaceutical component and must be neither contaminated by the exterior surroundings nor pass into the surroundings. The containers are typically constituent parts of a production installation, (Continued)

Figure 1:
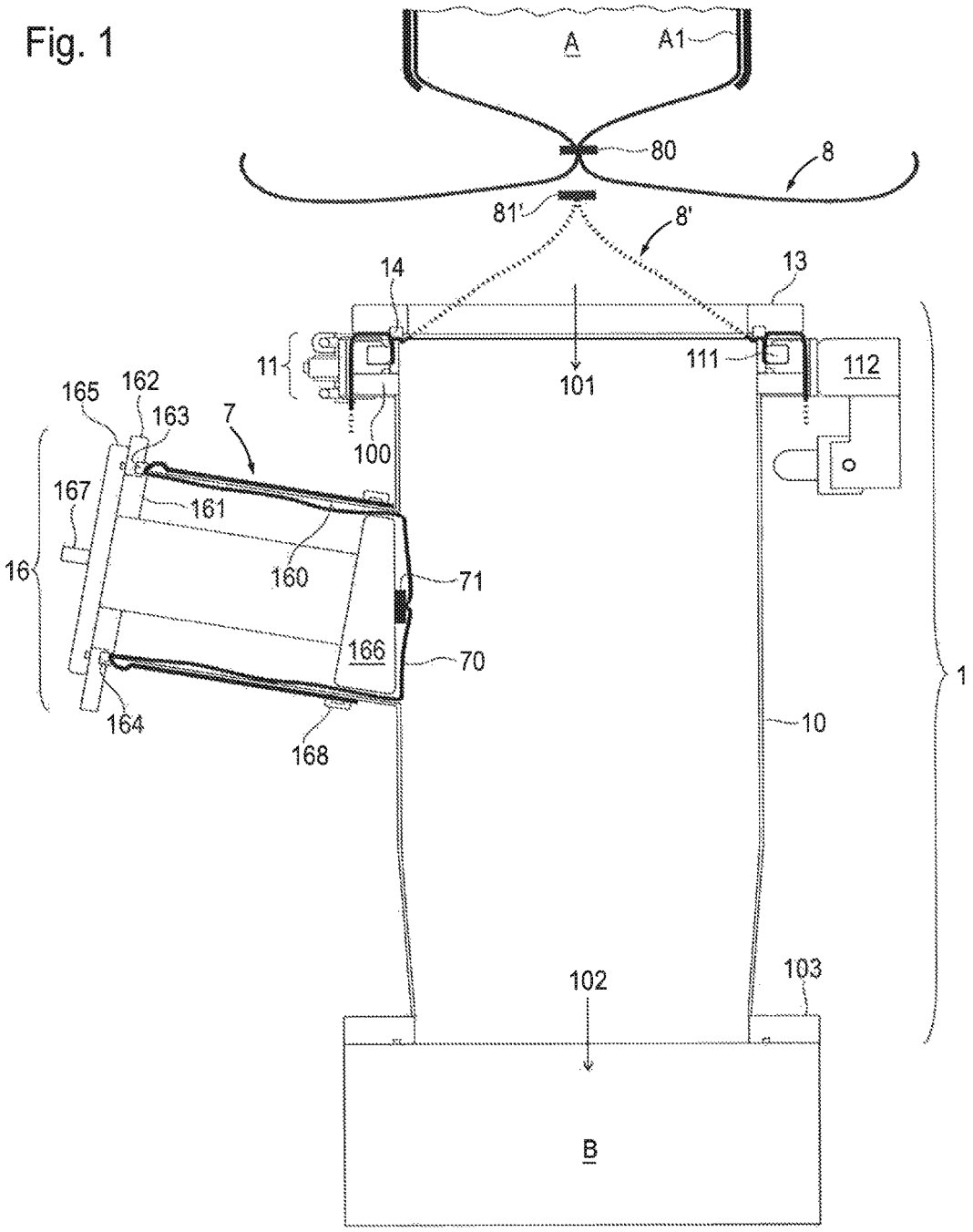

such as big bags, steel containers or drums. The invention also relates to a method for using the apparatus.

17 Claims, 86 Drawing Sheets

(58) Field of Classification Search
USPC ..... 141/287, 313–317
See application file for complete search history.

(56) References Cited

U.S. PATENT DOCUMENTS

| | | | | |
|---|---|---|---|---|
| 5,810,060 | A * | 9/1998 | Bolz | B65B 31/02 141/287 |
| 9,382,065 | B2 * | 7/2016 | Gallacher | B65B 1/28 |
| 9,387,950 | B2 * | 7/2016 | Hofman | B65B 69/0091 |
| 9,714,122 | B2 * | 7/2017 | Snape | B65D 47/063 |
| 2008/0145198 | A1 | 6/2008 | Multer et al. | |

FOREIGN PATENT DOCUMENTS

| | | | | |
|---|---|---|---|---|
| DE | 4023425 | A1 | 10/1991 | |
| DE | 102004010500 | A1 | 9/2005 | |
| DE | 60030426 | T2 | 5/2007 | |
| DE | 202012003611 | U1 | 5/2012 | |
| DE | 102013006224 | A1 | 10/2013 | |
| EP | 1321399 | A1 | 6/2003 | |
| EP | 1334908 | A1 | 8/2003 | |
| EP | 1502860 | A1 * | 2/2005 | B65B 39/02 |
| EP | 1619124 | A1 | 1/2006 | |
| EP | 1708941 | | 2/2008 | |
| EP | 1958900 | | 8/2008 | |
| EP | 2168881 | A2 * | 3/2010 | B65B 69/0083 |
| EP | 2216106 | A2 | 8/2010 | |
| GB | 2465180 | A | 5/2010 | |
| JP | 2011-084333 | A | 4/2011 | |
| JP | 2012-207698 | A | 10/2012 | |
| WO | WO 2006117224 | A1 * | 11/2006 | B65B 69/0075 |
| WO | WO2010/134102 | | 11/2010 | |
| WO | WO 2010134102 | A1 * | 11/2010 | B65G 69/183 |
| WO | WO2013/050968 | | 4/2013 | |
| WO | WO 2013050968 | A1 * | 4/2013 | B65B 39/04 |
| WO | WO2013/050968 | | 4/2014 | |

OTHER PUBLICATIONS

Written Opinion of the International Searching Authority dated Oct. 10, 2014, along with its English translation, issued in connection with International Patent Appln. No. PCT/CH2014/000126 (13 pages).

Notice of Opposition filed Sep. 7, 2017, in connection with European Patent No. EP3041749B1 (31 pages).

Christoph Rubitschung, "Big Bags staubarm an- und abdocken", prozesstechnik online article dated Nov. 26, 2014, retrieved Aug. 17, 2017 from [http://prozesstechnik.industrie.de/chemie/anlagen-chemie/big-bags-staubarm-an-und-abdocken/] (4 pages).

Christoph Rubitschung, "Big Bags staubarm an- und abdocken", prozesstechnik online article dated Sep. 16, 2014, retrieved Aug. 17, 2017 from [http://prozesstechnik.industrie.de/chemie/big-bags-staubarm-an-und-abdocken-2/] (4 pages).

Christoph Rubitschung, "Teilautomatisierung sorgt für einige Vorteile", prozesstechnik online article dated Nov. 14, 2016, retrieved Aug. 17, 2017 from [http://prozesstechnik.industrie.de/chemie/teilautomatisierung-sorgt-fuer-einige-vorteile/] (3 pages).

Rubitec AG, "Screenshots of www.rubitec.ch/home on Jun. 4, 2014", retrieved Aug. 17, 2017 from [www.rubitec.ch/home (using https://web.archive.org/)] (4 pages).

Rubitec AG, "SmartDock—Containment system to fill and empty Big Bags or drums with plastic liner. (Patent pending)", product brocuhre excerpt, 2014 (16 pages).

Rubitec AG, "SmartDock—Containment system to fill and empty Big Bags or drums with plastic liner. (Patent pending)", advertising leaflet, 2014 (5 pages).

Search Report dated Apr. 16, 2014, issued in connection with Swiss Patent Application No. CH1485/13 (3 pages).

* cited by examiner

Fig. 48B
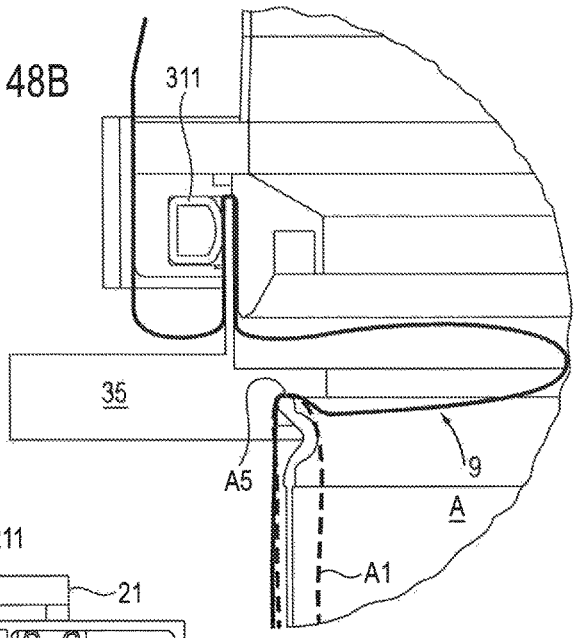
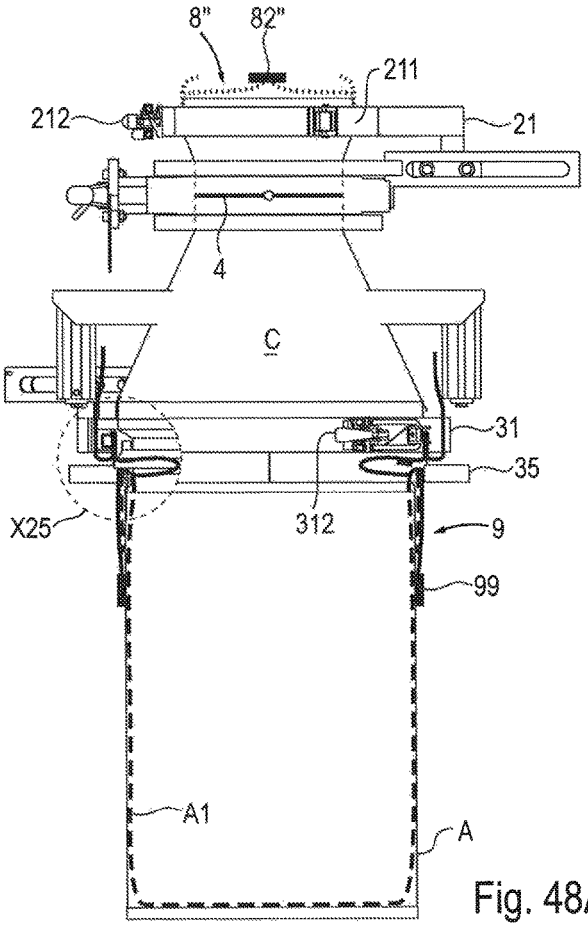
Fig. 48A

Fig. 50B
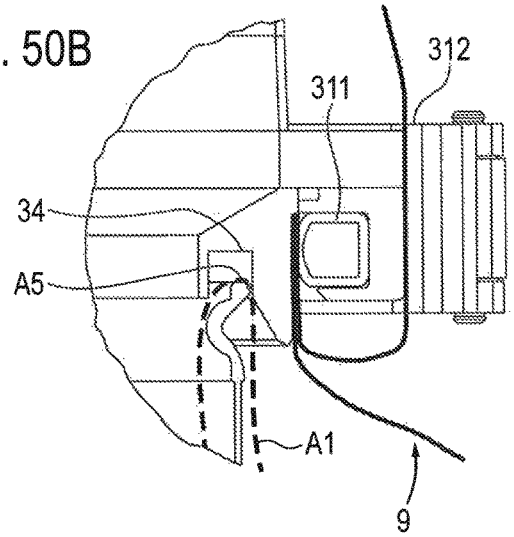
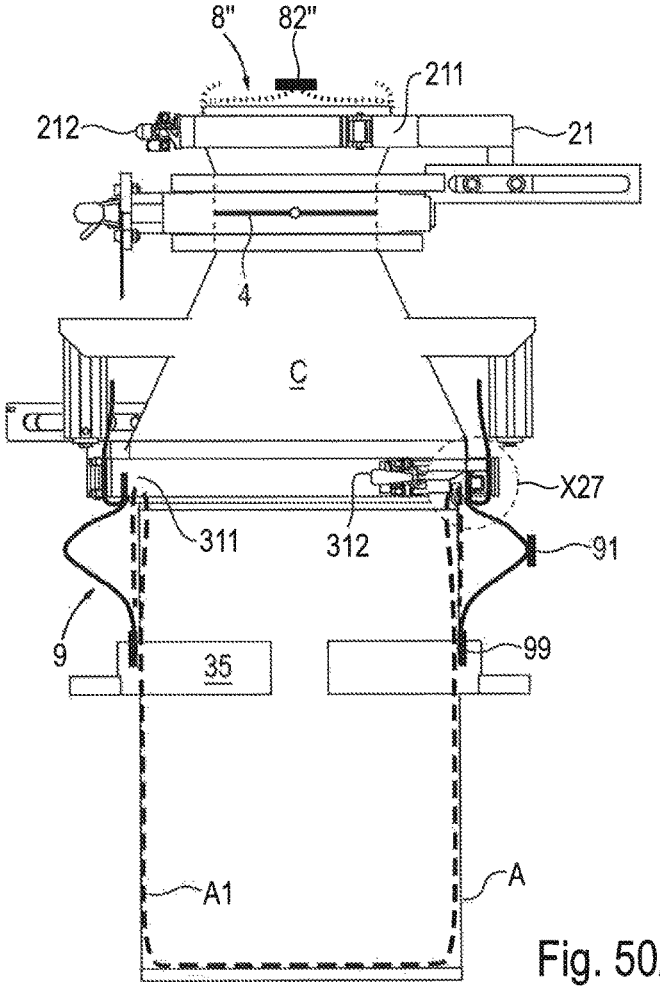
Fig. 50A

Fig. 55A
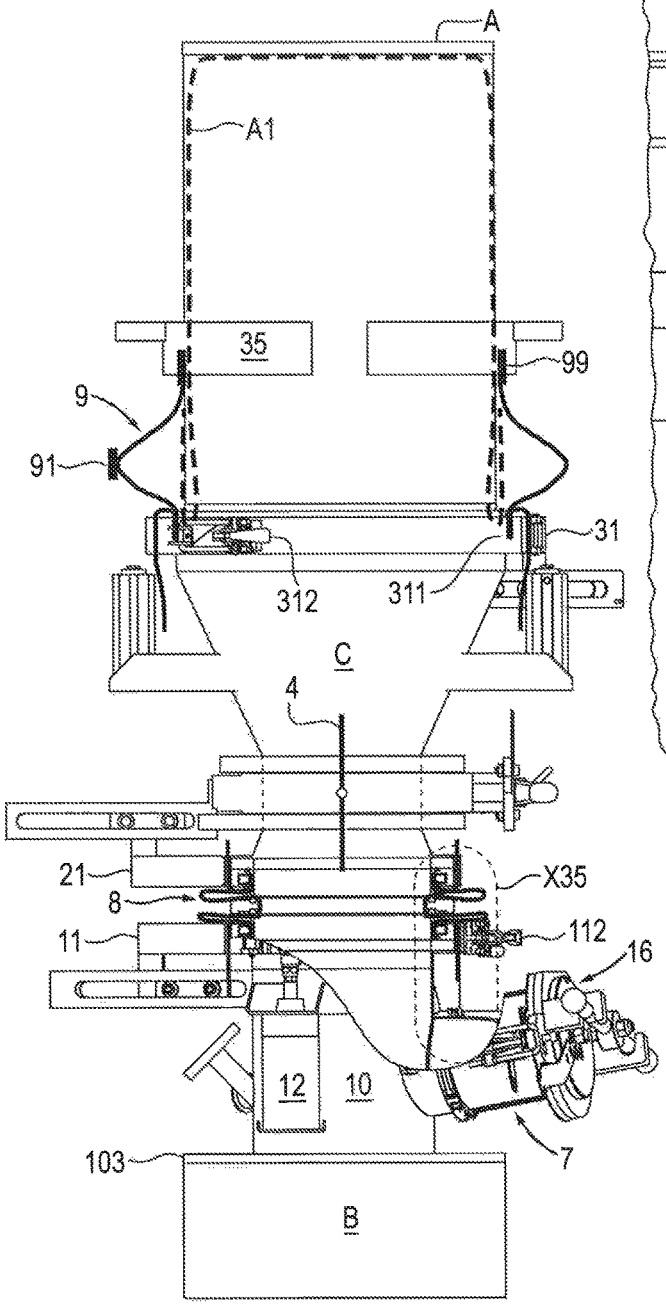
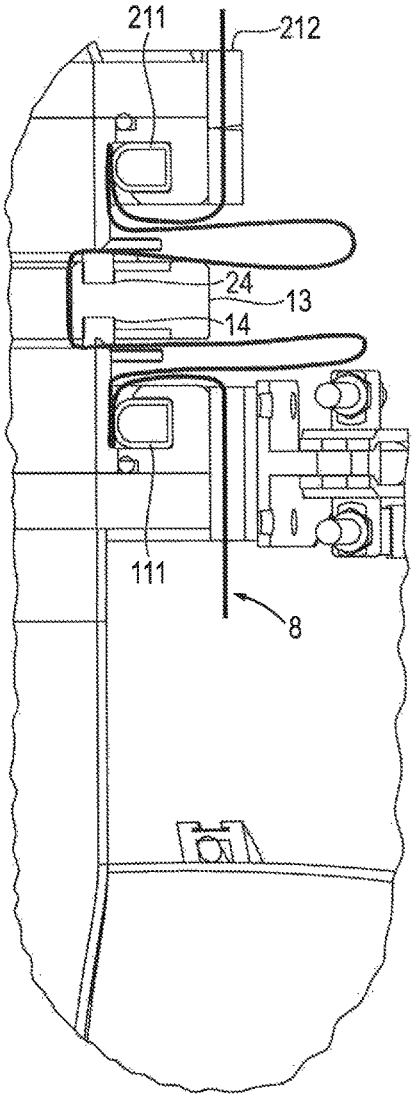
Fig. 55B

Fig. 56A
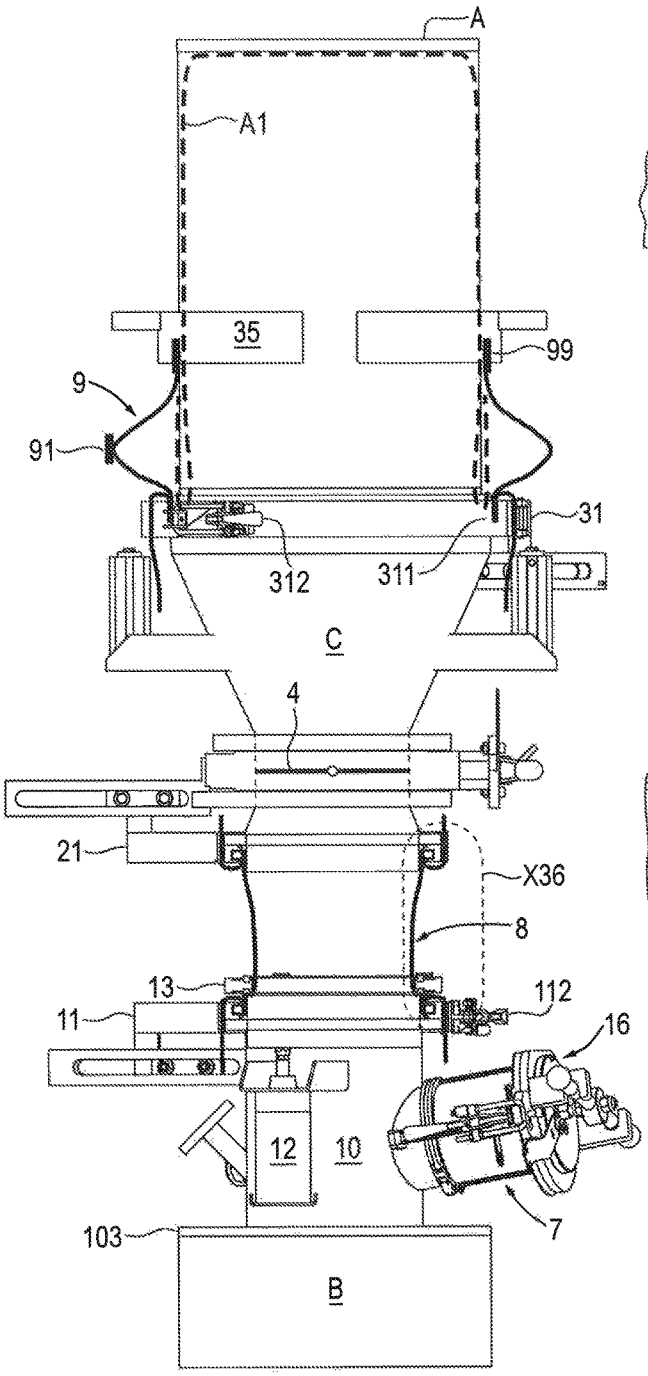
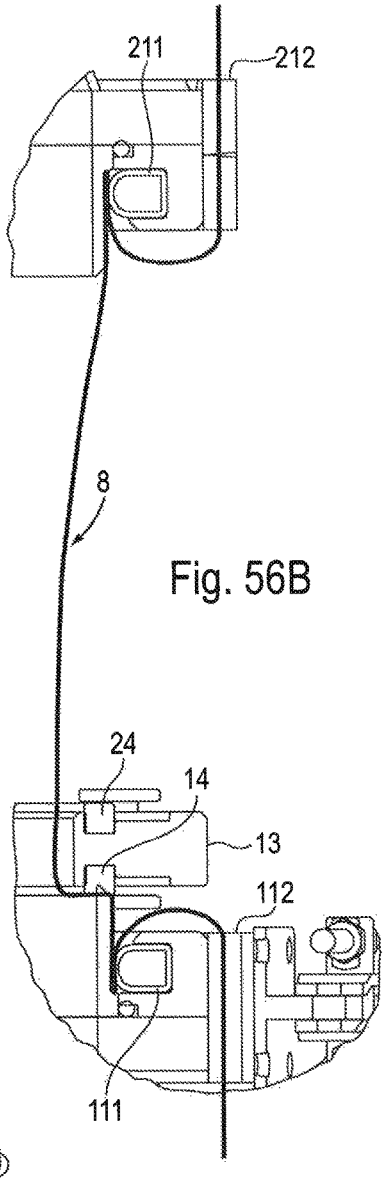
Fig. 56B

APPARATUS FOR TRANSFERRING PROCESS MATERIAL BETWEEN A FIRST CONTAINER AND A SECOND CONTAINER, AND METHOD FOR THIS PURPOSE

RELATED APPLICATIONS

This application is a U.S. National Phase Application under 35 U.S.C. 371 of International Application No. PCT/CH2014/000126 filed Sep. 2, 2014, which was published on Mar. 5, 2015 under International Publication Number WO 2015/027350 A1, which claims the benefit of Switzerland Patent Application No. 1485/13 filed on Sep. 2, 2013. The disclosures of these applications are incorporated herein by reference in their entireties.

FIELD OF THE INVENTION

The present invention relates to a method for transferring process material between a first container and a second container. Essential constituent parts of the apparatus are at least one tensioning unit, which has a first tensioner and a second tensioner, which can be actuated independently of one another, and also a tubular liner piece, which extends indirectly between the containers, in order to seal off the transition between the containers from the exterior. The tensioning unit has fixed in it, temporarily, the near end portion of the liner piece and the near end portion of a tubular liner remainder left over from a previous transfer operation. In specific applications, a transfer means is installed between the containers. The process material may be of a sensitive nature—e.g. a pharmaceutical component—and must be neither contaminated by the exterior surroundings nor pass into the surroundings. The containers are typically constituent parts of a production installation, such as big bags, containers or drums. The invention also relates to a method for using the apparatus.

PRIOR ART

The method described in EP 1 708 941 B1 is used for the emptying and filling of filling material, in a manner avoiding contamination, from/to a container having a flexible or rigid outlet into a downstream device via a connection tube. A film carrier is mounted on the connection tube, on which film carrier there is stored an endless liner, such that the film is available for a number of transfer cycles. The film is guided through between the upper rim of the connection tube and an axial seal provided thereon. The film is tied above the connection tube, wherein a funnel-shaped end piece is formed adjacently of the tying point. The end piece is inserted in a receptacle having a radial expansion ring embedded therein and is clamped there to the flexible outlet rim of a container arranged above the connection tube by means of a counter ring formed as a disposable part. The radial expansion ring is activated only when the counter ring is inserted. Here, a free end piece of the film remains outside the receptacle and also protrudes from the container beyond the part of the flexible outlet rim projecting beyond the receptacle, said container still being closed at this point. The tying point of the film is then released, and the closure at the container is then opened, such that filling material present in the container flows through the connection tube into the downstream device. As soon as the container is empty, the free end piece of the film is gathered together above the receptacle and connected to the flexible outlet rim of the container, for example by means of a strapping. The film is then pulled until it can be closed in the clean region by means of two tying points distanced from one another. The radial expansion ring is then deactivated, and the film is severed between the tying points just produced. The container can now be disposed of contamination-free, together with the enclosed counter ring. Film is pulled from the film carrier until there is sufficient film below the provided tying point for a new connection funnel. The film is then tied again above the connection tube, and a funnel-shaped end piece is produced again, as at the start, with removal of the upper tying point. Here, it is disadvantageous that the counter ring must be arranged within the receptacle, wherein the free end piece of the film and the flexible outer rim of the container have to be manually inserted between the counter ring and receptacle, which requires a lot of practice, is time-consuming, and does not exclude a certain residual risk.

CH 699 603 A2 relates to a method and an associated apparatus for transferring filling material, with low contamination, from a first container into a second container. The first container has a casing, which leads into an outlet, which is provided with a first closure. In continuation from the casing, a flexible extension extends beyond the first closure. A filling apparatus comprising a tube is arranged between the first container and the second container. The tube is intended for the passage of the filling material during the transfer from the first container into the second container and is also intended for the storage, on its outer periphery, of an endless liner in the form of a film. A second seal point is formed from an arrangement comprising an activatable seal, a flexible extension of the film guided over the outer periphery of the seal, a flexible extension of the casing guided in the region of the seal externally over the flexible extension of the film, and a first tensioning element applied externally over the flexible extension in the region of the seal.

EP 1 958 900 B1 discloses a method for emptying a liner connected to a first container. The apparatus used for this purpose has a chamber-like guide tube and an upper opening, through which the first container can be emptied into the guide tube. The process material flows through the lower opening into a second container. In order to secure the liner, a first securing apparatus is provided at the upper opening. The liner can be fitted on the opening in a sealed-off manner by means of a sealing flange, wherein a lever serves to lift the sealing flange from the opening and to place said flange against said opening. The guide tube has an intervention point with a second securing apparatus for a film bag or an endless tubular film. Two tensioners running circularly around the guide tube and lying one beneath the other are provided on the first securing apparatus, the free ends of the liner or a liner remainder from the previous transfer operation being fixed in said tensioners. The second securing apparatus has two adjacently arranged tensioners running circularly around the guide tube, said tensioners being used to fix an outwardly closed film bag or a second film remainder that is closed by means of a crimp. During the transfer operation, once the second and then the first liner remainder have been discharged, it is necessary to put the film bag on the second securing apparatus and to put the liner on the first securing apparatus. This handling is somewhat cumbersome and means that the system is opened twice, which is not uncritical.

OBJECT OF THE INVENTION

In relation to the previously known apparatuses and practiced methods for transferring process material, the problem addressed by the invention is that of creating an apparatus having a method sequence which enables more efficient and safe handling and which uses only little consumable material. Here, the outlay in respect of the installation technology is to be kept as low as possible.

SUMMARY OF THE INVENTION

The apparatus for transferring process material between a first container and a second container has at least one tensioning unit, which has a first tensioner and a second tensioner, which can be actuated independently of one another. The at least one tensioning unit is intended to temporarily fix, in a sealed-off manner:

a) just an end portion, near to the tensioning unit in question, of a tubular liner piece, which extends indirectly between the containers, in order to seal off the transition between the containers from the exterior;

b) just an end portion, near to the tensioning unit in question, of a tubular liner remainder left over from a previous transfer operation, which liner remainder is closed at the other end by a first crimp; and c) the end portion of the liner piece simultaneously with the end portion of the liner remainder left over from a previous transfer operation, wherein: both tensioners of the respective tensioning unit are intended to temporarily fix, in a sealed-off manner, jointly the near end portion of the liner piece or jointly the near end portion of the liner remainder left over from a previous transfer process.

Particularly advantageous details of the apparatus will be specified hereinafter: Both tensioners of the respective tensioning unit are arranged circularly and concentrically with one another in relation to the longitudinal extension of the liner piece. The function of at least one of the two tensioners of the respective tensioning unit is based on intrinsic resilience or external control.

A first tensioner of the respective tensioning unit is designed with an expansion seal, which is to be acted on or can be activated by media pressure, or has intrinsically resilient clamping jaws. A second tensioner of the respective tensioning unit is provided as a clamp, which is constricted in the closed state and expanded in the open state and has a manually actuatable closure.

The first tensioner of the respective tensioning unit may advantageously be formed with an expansion seal, which is to be acted on or can be activated by media pressure, or has intrinsically resilient clamping jaws and, within the concentric arrangement, is arranged inwardly in relation to the second, externally arranged tensioner of the same tensioning unit, said tensioner being provided as a clamp.

The second tensioner of the respective tensioning unit is intended for the temporarily sealed-off fixing of the end portion, near to the tensioning unit in question, of the liner piece or of the liner remainder. The first tensioner of the tensioning unit in question is intended for the temporary sealed-off fixing of the near end portion of the liner piece or of the liner remainder by means of folding in with a looped course, wherein, on the end portion of the liner piece or liner remainder, the sealed-off fixing point in the respective first tensioner lies closer to the rest of the liner piece or to the rest of the liner remainder than the sealed-off fixing point in the respective second tensioner.

Between the first container and the second container there is arranged a transfer means, which comprises:

a) a guide tube, which is intended to guide the process material between the containers and on the one hand has a first aperture and on the other hand has a second aperture;

b) a transfer unit, which leads into the guide tube and allows intervention through the guide tube; and c) the first tensioner of a first tensioning unit arranged in a collar surrounding the guide tube; wherein:

d) the end of the liner piece near the first tensioning unit can be drawn over the outer surface of the collar and the second tensioner belonging to the first tensioning unit serves, in the closed state, to seal off and fix this end of the liner piece; and e) on one side of the first tensioner there is provided an outwardly opening annular gap, into which the relevant end of the liner piece can be folded in a looped manner and against which the first tensioner presses in a sealing manner under application of a force.

A tubular liner stock that can be drawn off from the transfer unit is stored thereon. A utility portion removed from the liner stock can be introduced through the transfer unit into the guide tube and is intended to sheath, in an insulating manner, a liner remainder left over from the previous transfer operation and remaining at the first tensioning unit, and to transfer this liner remainder externally.

The utility portion is closed toward the mouth into the guide tube by means of a first crimp, lies in the transfer unit, and is advanced toward the mouth by a stopper, which can be introduced from the free end of the transfer unit.

The utility portion is sealed off from the liner stock in a releasable front seal point. The front seal point is formed by a flange, which can be slid toward the free end of the transfer unit and which has a head seal provided thereon, which head seal is placed circularly onto the utility portion wound around the free end of the transfer unit. The stopper, which can be removed from the transfer unit through the flange, is connected to a cover that can placed in front of the flange. The transfer unit is formed in the manner of a side support and leads at an incline into a wall of the guide tube via a through-opening. The end of the liner stock is fixed in a sealed-off manner by means of a termination element on the transfer unit.

The transfer means also has a lifting link and a press ring transported thereby, which initially serves to be placed with compressive force congruently against the first tensioning unit in order to create an additional seal at the end of the liner piece fixed here in a sealed-off manner or at the liner remainder remaining in the first tensioning unit from a previous transfer operation, wherein the liner piece or the liner remainder are guided through the press ring. The press ring additionally can be used to fold the end of the liner piece near the first tensioning unit into the first tensioner by means of an inwardly pressing annular folding element.

The first container may have the form of a big bag to the emptied, wherein an inner liner provided with a closure extends out from the big bag, the free end of said inner liner being usable for the transfer operation as a liner piece for leading to the first tensioning unit on the transfer means. The first container otherwise has the form of a drum to be emptied, wherein, for the transfer operation, a liner piece extends from the tensioning unit at the transfer means to a seal circularly running externally around the first container.

As a further alternative the first container may have the form of a container to be emptied having an inflexible outlet. Here, for the transfer operation, a liner piece extends from a first tensioning unit at the transfer means to a second tensioning unit, which:

a) is installed directly on the first container to be emptied or on an intermediate installation part connected to the first container; wherein the second tensioning unit is intended to temporarily fix, in a sealed-off manner, the near end of the liner piece and/or a second liner remainder remaining from the previous transfer process; or b) is installed directly on the second container to be filled or on an intermediate installation part connected to the second container; wherein the second tensioning unit is intended to temporarily fix, in a sealed-off manner, the near end of the liner piece and/or a second liner remainder remaining from the previous transfer operation.

Lastly, the first container may have the form of a drum to be emptied, and for the transfer operation a special liner piece having an intervention part may extend from a third tensioning unit to a seal circularly running externally around the first container to be emptied. The third tensioning unit is now near the first container, specifically installed on one side of an installation part arranged between the containers. This third tensioning unit is intended to temporarily fix, in a sealed-off manner, the near end of the special liner piece and/or a first special liner remainder remaining from the previous transfer operation. In the case of this installation configuration:

a) a second tensioning unit is arranged on the installation part, remotely from the first container, and is intended to temporarily fix, in a sealed-off manner, the near end of a liner piece, which extends as far as the first tensioning unit on the transfer means and to which the second container is connected; or b) an endless liner head having a liner stock stored thereon is arranged on the installation part, remotely from the first container, and is intended to provide a liner piece which extends as far as the first tensioning unit and to which the second container is connected; or c) a double flap is arranged as isolation valve on the installation part, remotely from the first container, and is connected by the second container.

The essence of the method for use of the apparatus according to the invention for transferring process material between a first container and a second container is initially based on the following structure:

a) at least one tensioning unit, which has a first tensioner and a second tensioner, which can be actuated independently of one another; wherein:

b) the at least one tensioning unit is intended to temporarily fix, in a sealed-off manner:

ba) just an end portion, near to the tensioning unit in question, of a tubular liner piece, which extends indirectly between the containers, in order to seal off the transition between the containers from the exterior;

bb) just an end portion, near to the tensioning unit in question, of a tubular liner remainder left over from a previous transfer operation, which liner remainder is closed at the other end by a first crimp; and bc) the end portion of the liner piece simultaneously with the end portion of the liner remainder left over from a previous transfer operation, wherein c) both tensioners of the respective tensioning unit are intended to temporarily fix, in a sealed-off manner, jointly the near end portion of the liner piece or jointly the near end portion of the liner remainder left over from a previous transfer process.

The method comprises the following sequence of steps:

1. fixing, in a sealed-off manner, the open end of the liner piece, which is near the associated tensioning unit, in the second tensioner thereof;
2. discharging the liner remainder;
3. pressing so as to be folded in, in a looped course, and fixing, in a sealed-off manner, an end portion, which is set back from the open end of the liner piece held in the second tensioner, in the first tensioner;
4. transferring the process material between the two containers; and
5. providing crimps on the liner piece and dividing off a new liner remainder, which remains fixed in the at least one tensioning unit for the next transfer operation.

Particularly advantageous method details for specific applications will be specified hereinafter: A transfer means is used to discharge the liner remainder remaining from a previous transfer operation and left over from a liner piece. Alternatively, a special liner piece having an intervention part intended for separation is used to discharge the special liner remainder remaining from a previous transfer operation and left over from a special liner piece of this type.

The transfer means comprises:

a) a guide tube, which is intended to guide the process material between the containers and on the one hand has a first aperture and on the other hand has a second aperture;

b) a transfer unit, which leads into the guide tube and allows intervention through the guide tube; and c) the first tensioner of a first tensioning unit arranged in a collar surrounding the guide tube; wherein:

d) the end of the liner piece near the first tensioning unit can be drawn over the outer surface of the collar and the second tensioner belonging to the first tensioning unit serves, in the closed state, to seal off and fix this end of the liner piece;

e) on one side of the first tensioner there is provided an outwardly opening annular gap, into which the relevant end of the liner piece can be folded in a looped manner and against which the first tensioner presses in a sealing manner under application of a force;

f) a tubular liner stock is stored on the transfer unit and can be drawn off therefrom; and g) a utility portion removed from the liner stock can be introduced through the transfer unit into the guide tube and is intended to sheath, in an insulating manner, a liner remainder left over from the previous transfer operation and remaining at the first tensioning unit, and to transfer this liner remainder externally.

The method in the event of discharge of the liner remainder comprises the following sequence of steps:

1. introducing a utility portion from the liner stock through the transfer unit and guide tube to the liner remainder;
2. detaching the liner remainder from the first tensioner;
3. extracting externally the utility portion with encased liner remainder through the transfer unit; and
4. dividing off a separation part at the extracted utility portion with liner remainder enclosed therein.

BRIEF DESCRIPTION OF THE ATTACHED DRAWINGS

Figure 2:
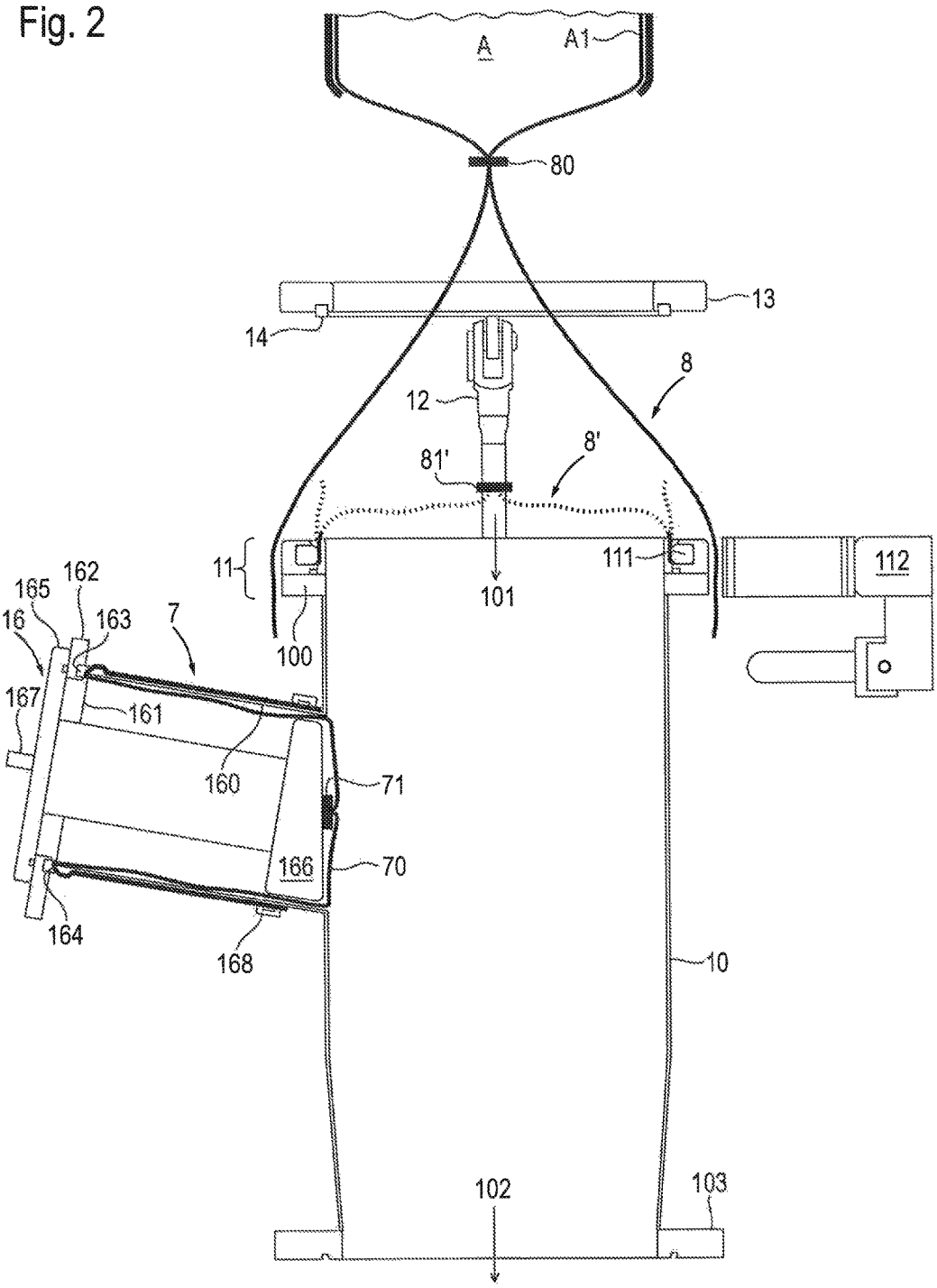
Figure 3:
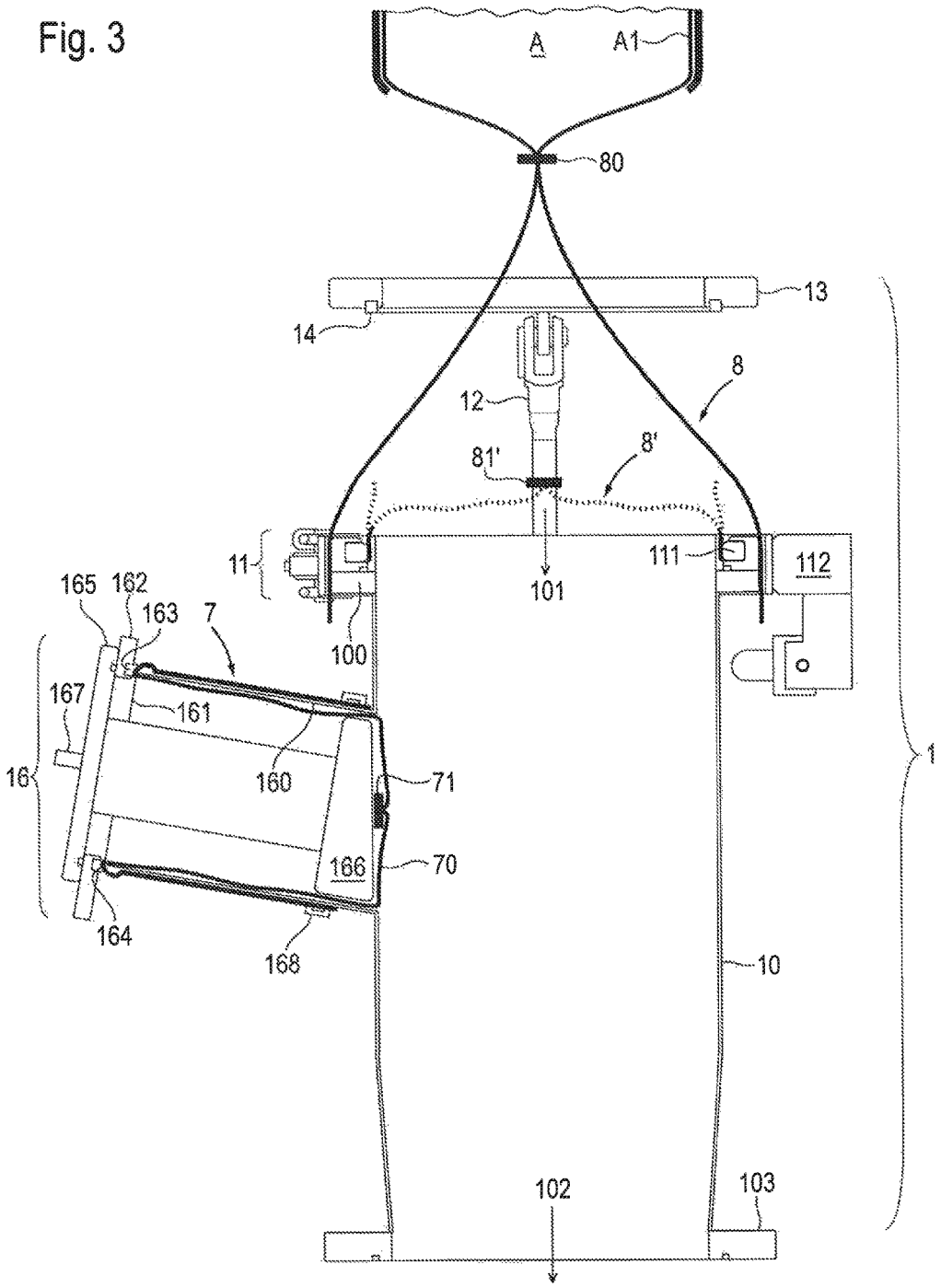
Figure 4:
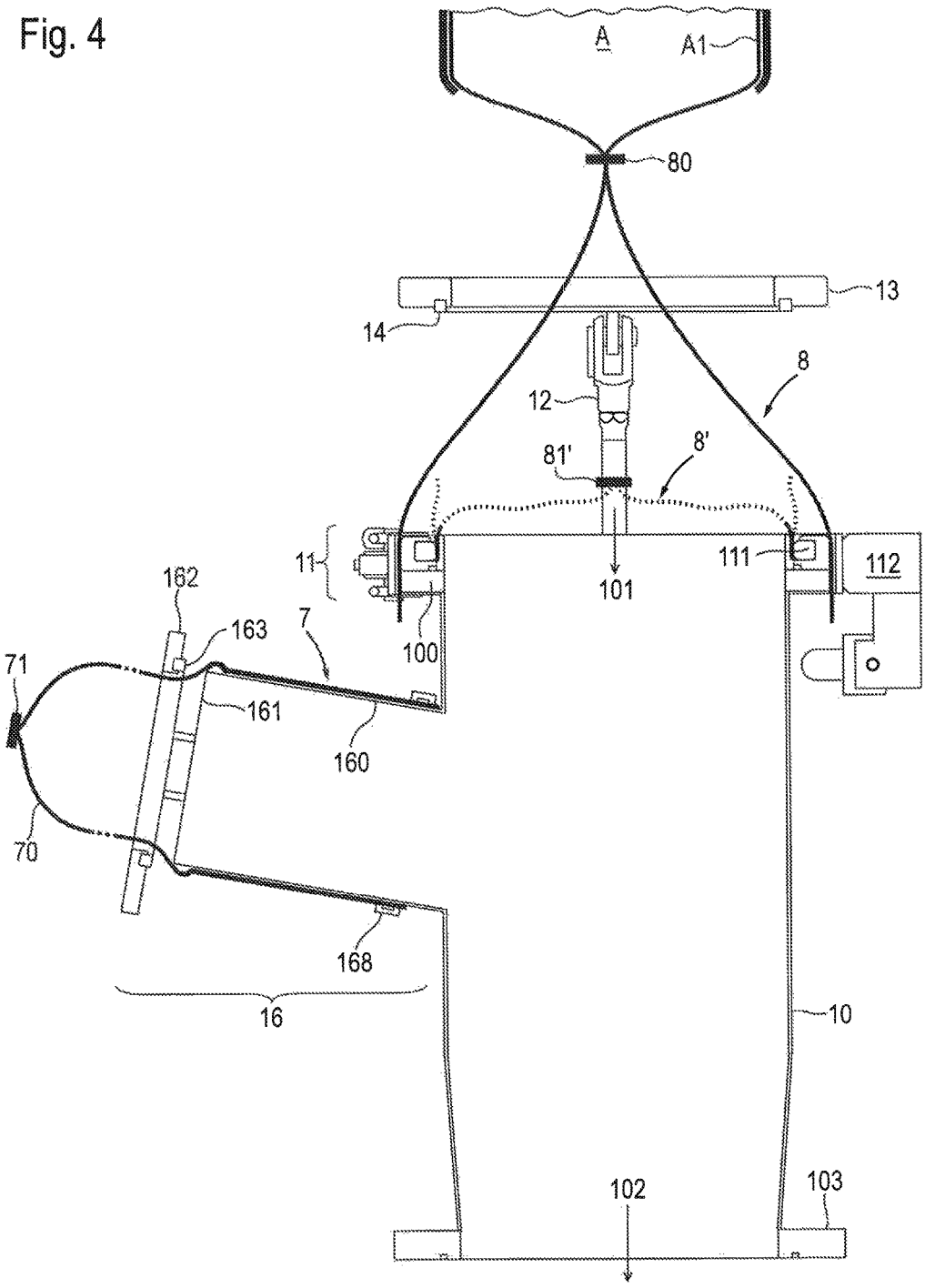
Figure 5:
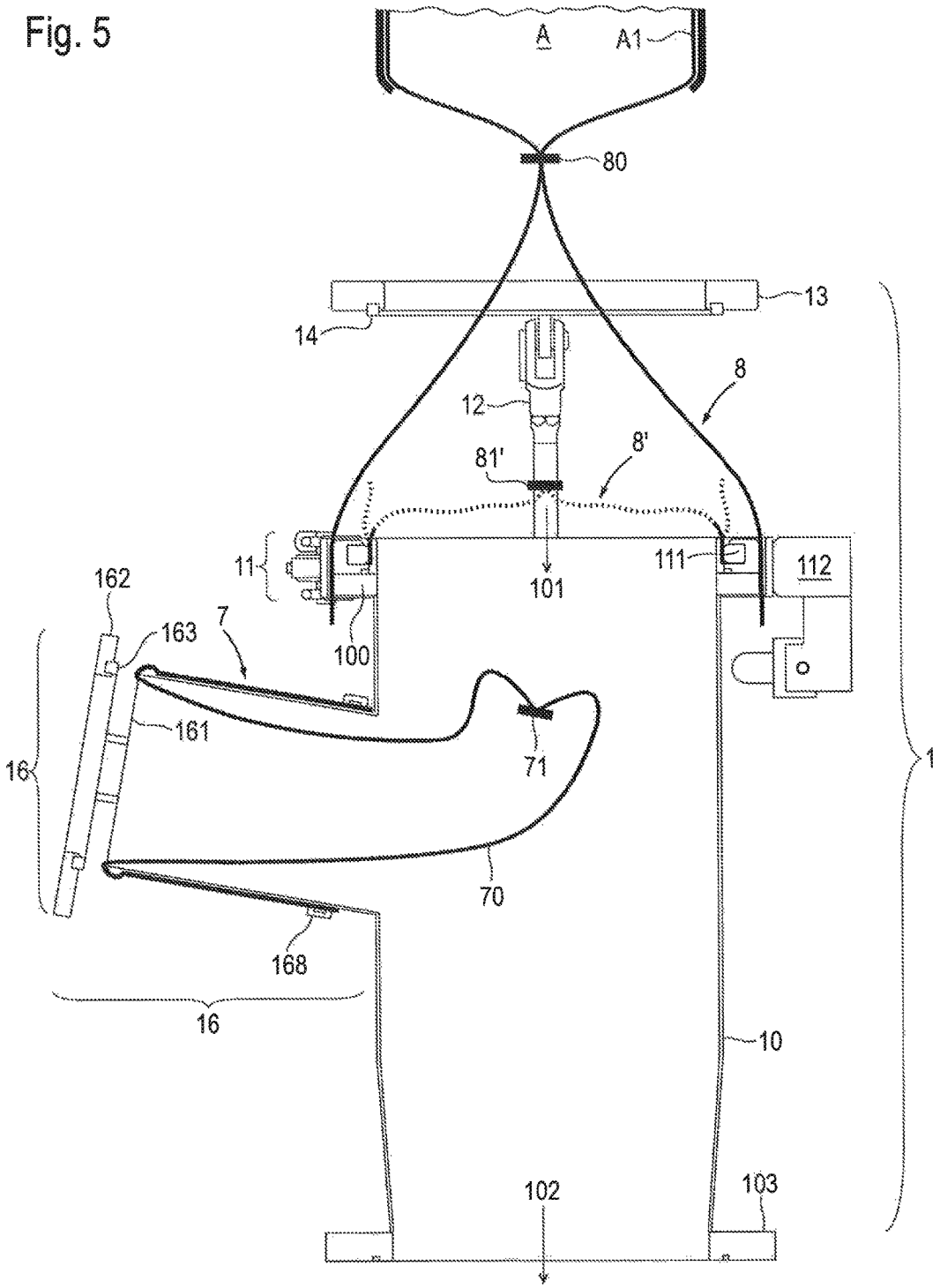
Figure 6:
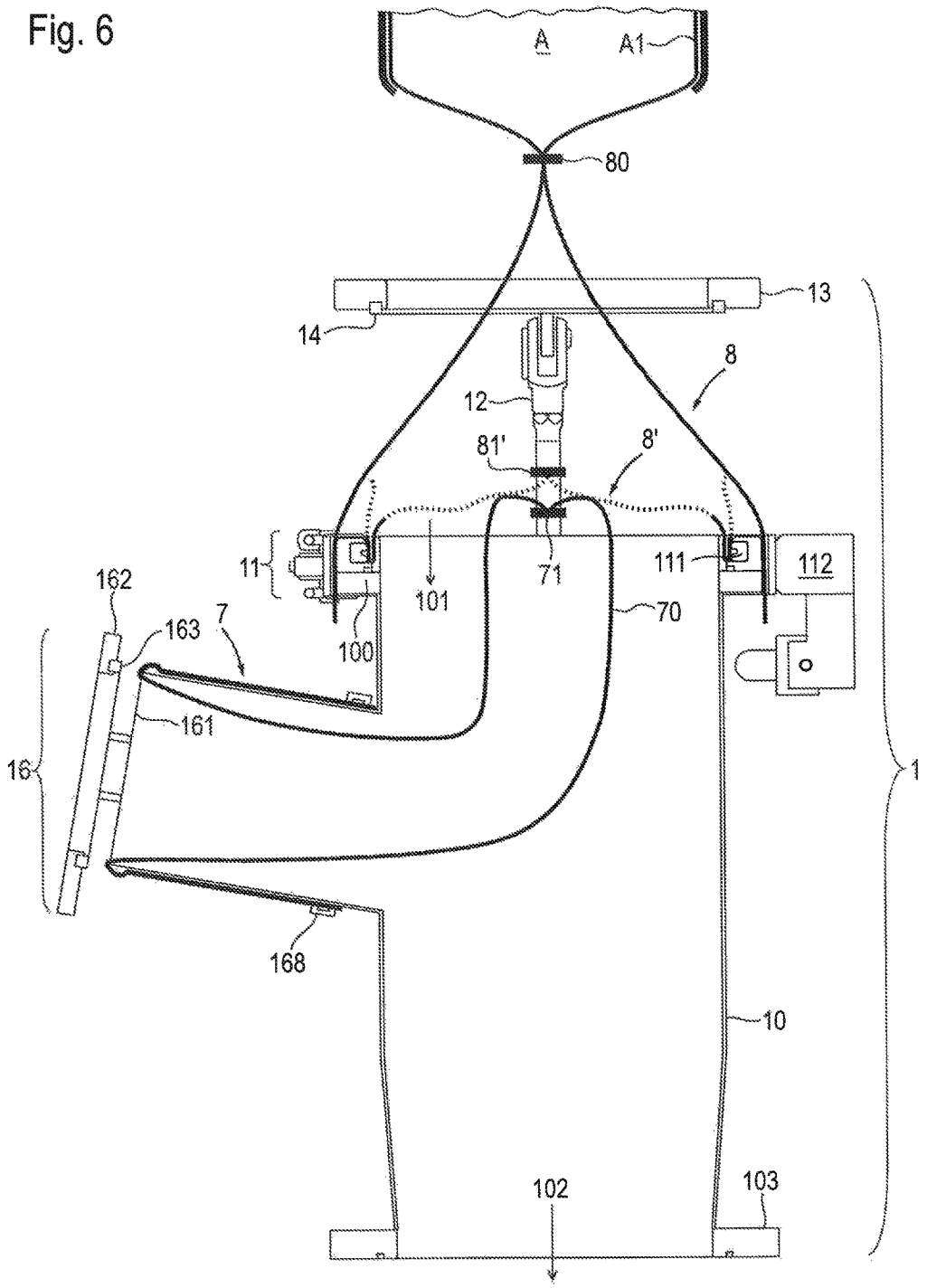
Figure 7:
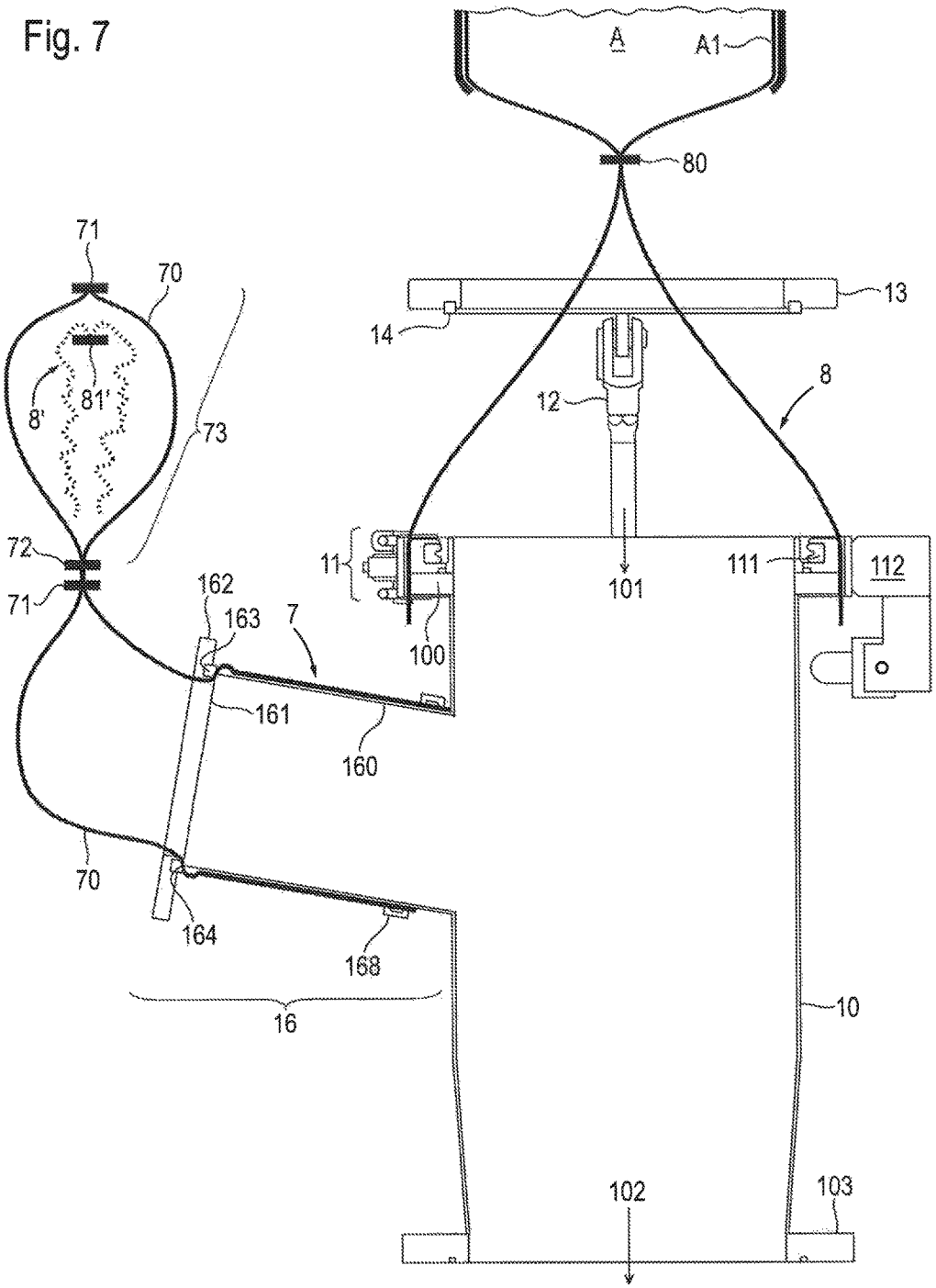
Figure 8:
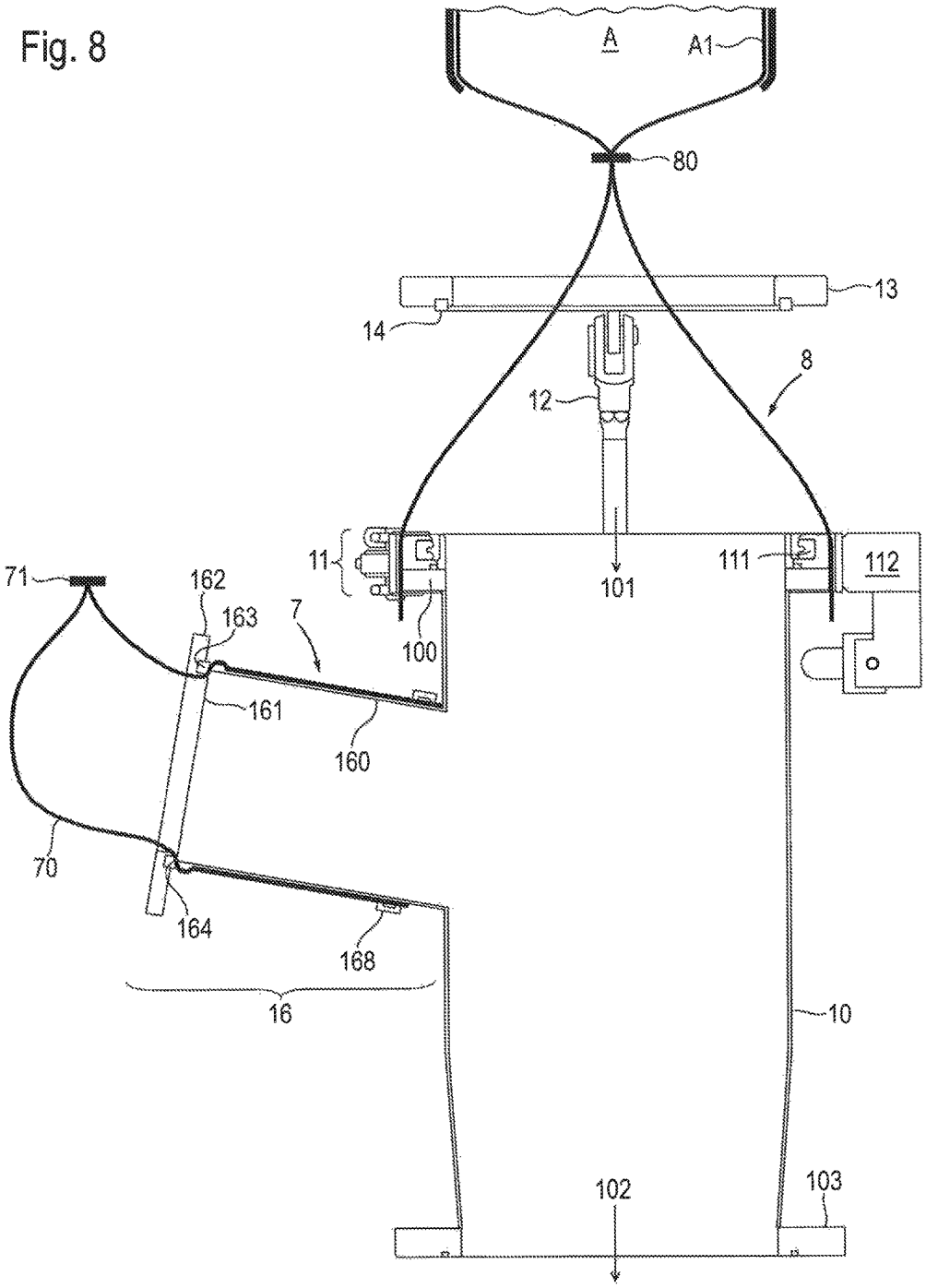
Figure 9:
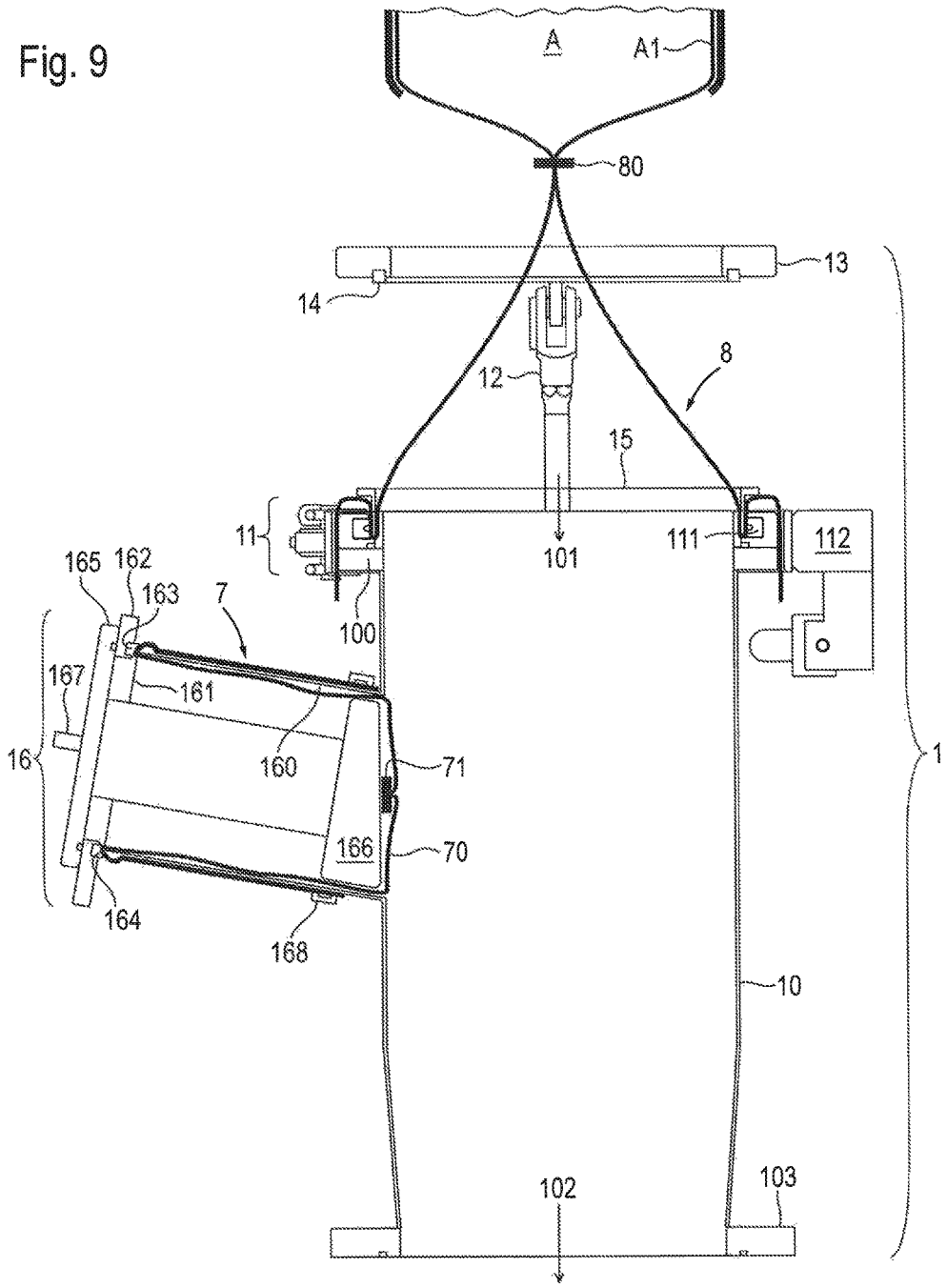
Figure 10:
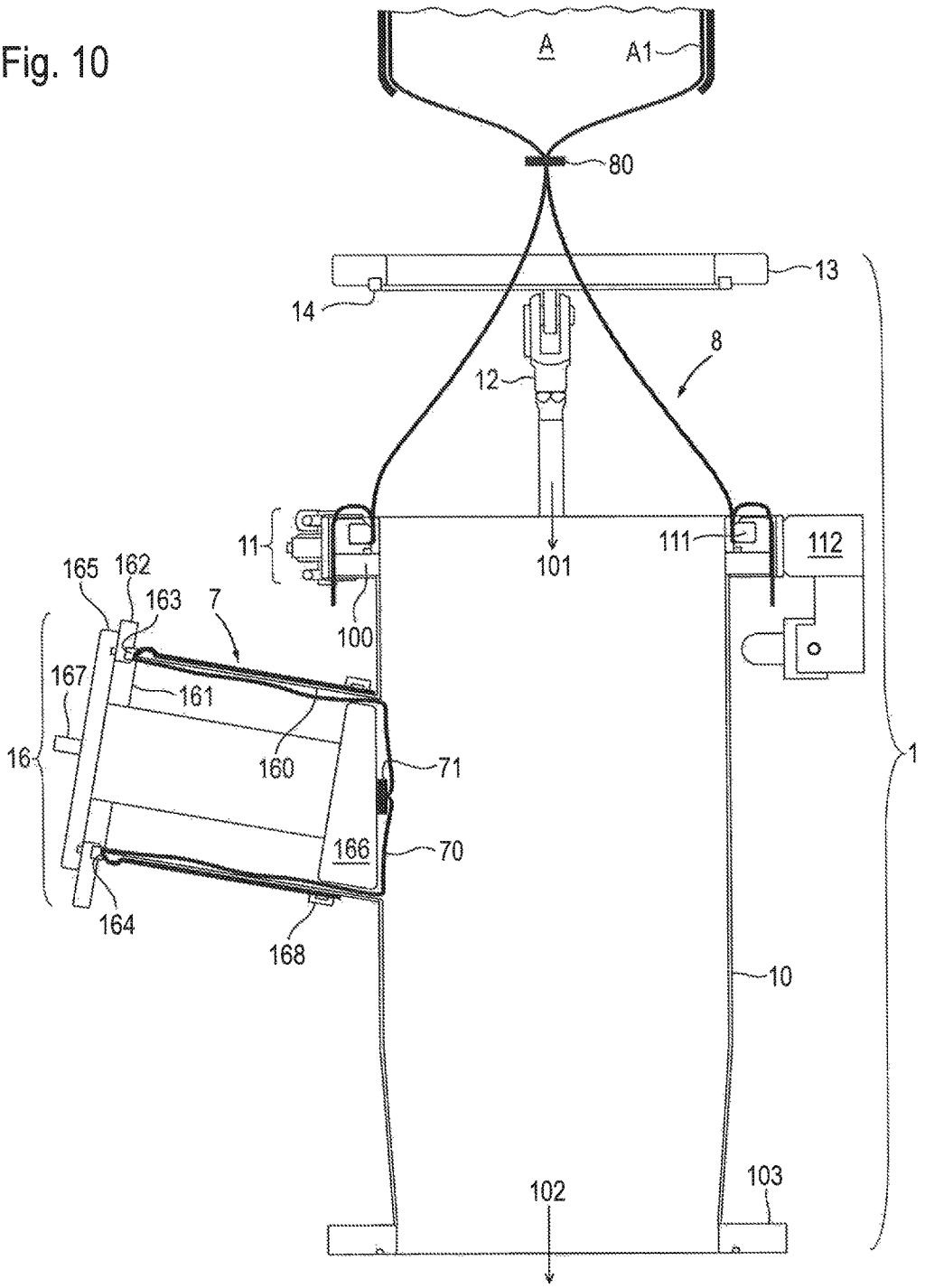
Figure 11:
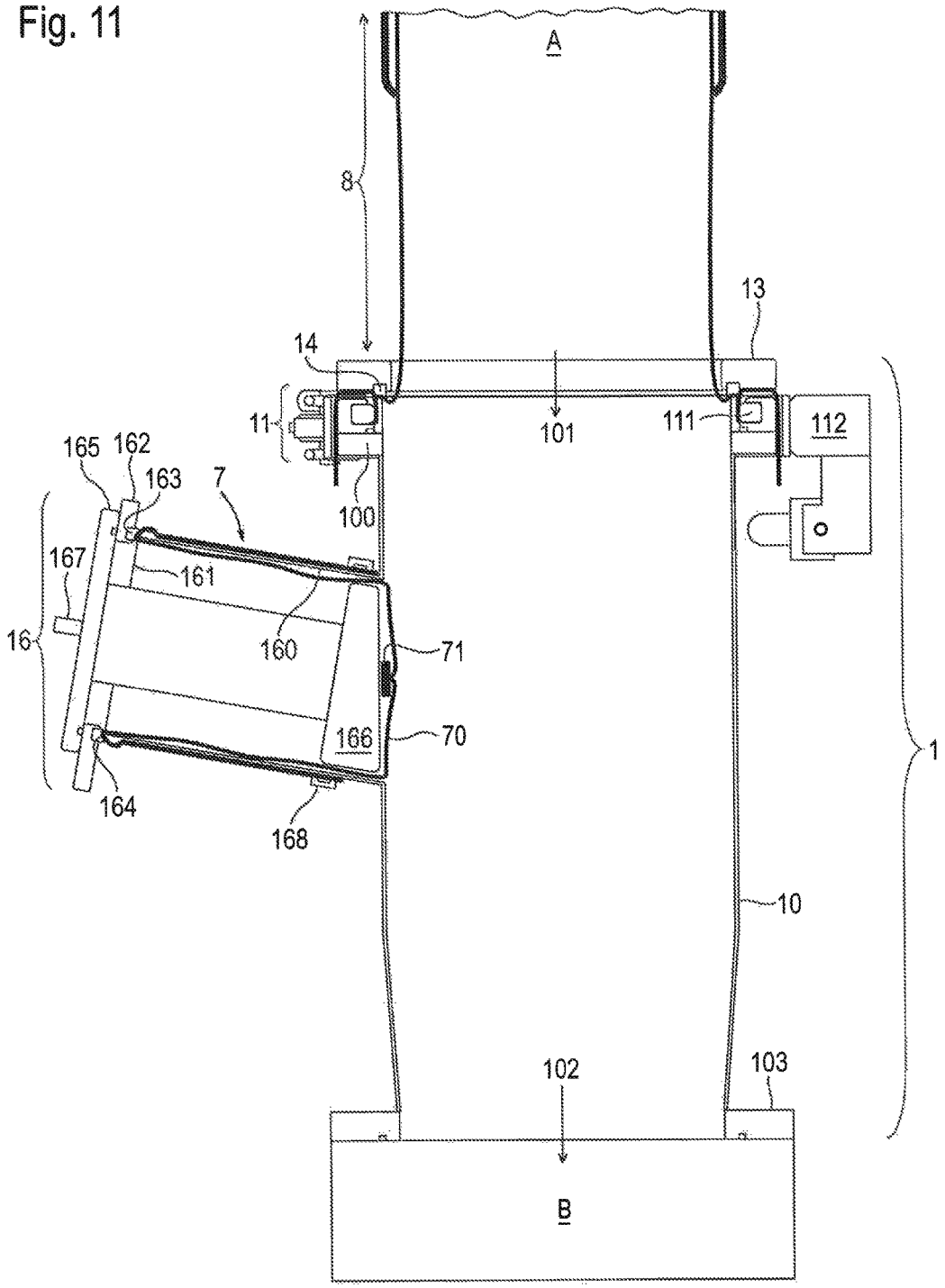
Figure 12:
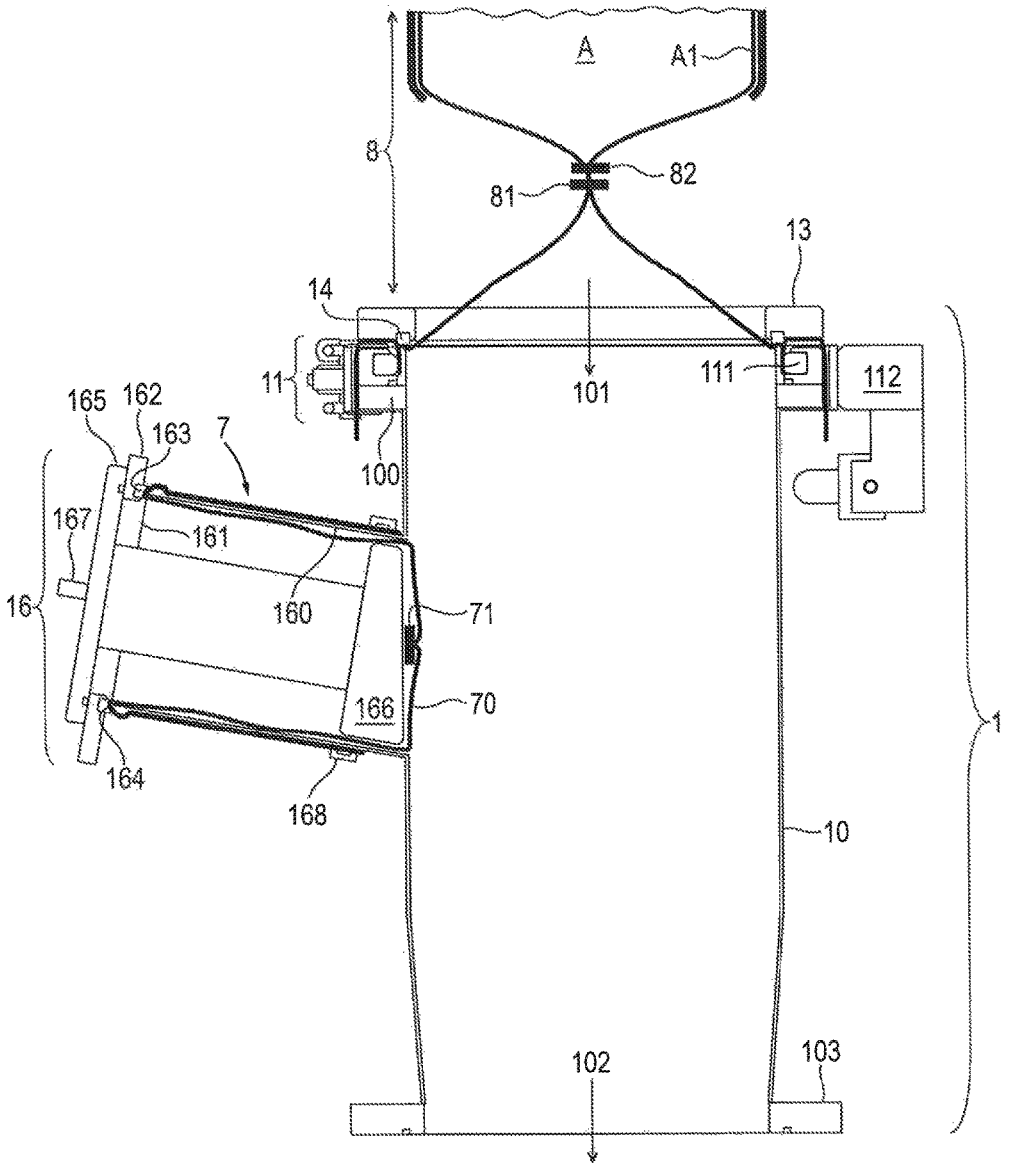
Figure 13:
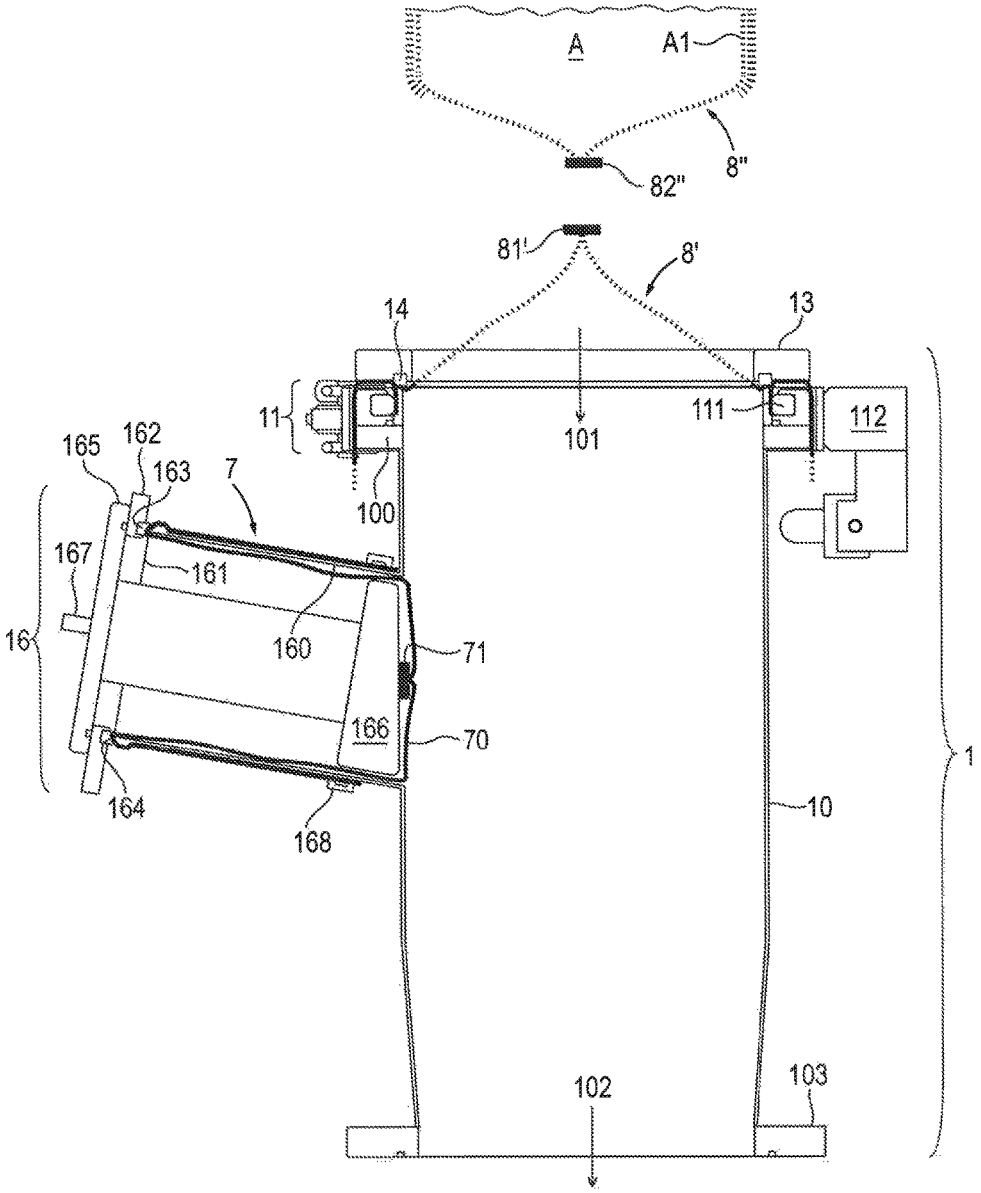

In the drawings:

FIGS. 1 to 13: show a first exemplary application of the apparatus according to the invention in conjunction with a transfer means for emptying a first container in the form of a big bag for process material in the form of flowable solid materials, with the key situations during a transfer operation, as schematic diagrams;

FIG. 1—first situation: utility portion from liner stock with first crimp advanced by stopper in the transfer unit of the transfer means, front seal point at transfer unit closed by flange pressed in abutment via head seal, liner remainder of a previous container closed by first crimp and fixed, in a sealed-off manner, to guide tube by means of activated first tensioner and by means of seal, resting against said liner remainder, on press ring moved toward said liner remainder, end of the liner remainder additionally fixed to guide tube by means of closed second tensioner;

FIG. 2—second situation: press ring with seal lifted from guide tube, second tensioner opened, free end of the liner remainder of the first previous container directed upwardly, free end of a new liner piece, provided with closure, of the first subsequent container guided through open second tensioner and drawn loosely over guide tube;

FIG. 3—third situation: free end of the new liner piece of the first subsequent container fixed in a sealed-off manner by means of closed second tensioner;

FIG. 4—fourth situation: cover with stopper removed from transfer unit, flange with head seal pulled forward and front seal point released, production of a utility portion by drawing off externally from the liner stock through transfer unit;

FIG. 5—fifth situation: utility portion from liner stock advanced into guide tube through transfer unit;

FIG. 6 sixth situation: with inactive first tensioner, grasping of the liner remainder of the first previous container by means of utility portion through transfer unit and guide tube, extraction of the utility portion externally with grasped liner remainder through transfer unit;

FIG. 7—seventh situation: front seal point on transfer unit closed by flange pressed in abutment via head seal; division of a separation part at the extracted utility portion with liner remainder enclosed therein by providing a second crimp and, close thereto, a next first crimp, producing a next utility portion at the liner stock;

FIG. 8—eighth situation: severing between second and next first crimp, removal of the separation part with liner remainder enclosed therein from the next utility portion;

FIG. 9—ninth situation: insertion of the next utility portion with next first crimp provided thereon toward the guide tube through flange in transfer unit by means of stopper, pressing of the free end of the new liner piece of the first subsequent container by means of folding element against inactive first tensioner;

FIG. 10—tenth situation: activation of the first tensioner, removal of the folding element, twofold fixing in the tensioning unit, in a sealed-off manner, of the end of the new liner piece near the tensioning unit;

FIG. 11—eleventh situation: moving of the press ring with seal toward the guide tube, fixing, in a sealed-off manner, of the near end of the new liner piece of the first subsequent container, removal of the closure at the new liner piece, process material from subsequent container flows through guide tube into second container;

FIG. 12—twelfth situation: mounting, on the liner piece of the emptied first subsequent container, a second crimp and, close thereto, a next first crimp, division of a new liner remainder; and FIG. 13—thirteenth situation: severing of the liner piece of the empty first subsequent container between second and next first crimp, removal of the empty first subsequent container with its second liner remainder closed by a second crimp; new first liner remainder is fixed, in a sealed-off manner, at the guide tube with activated first tensioner and closed second tensioner.

Figure 14A:
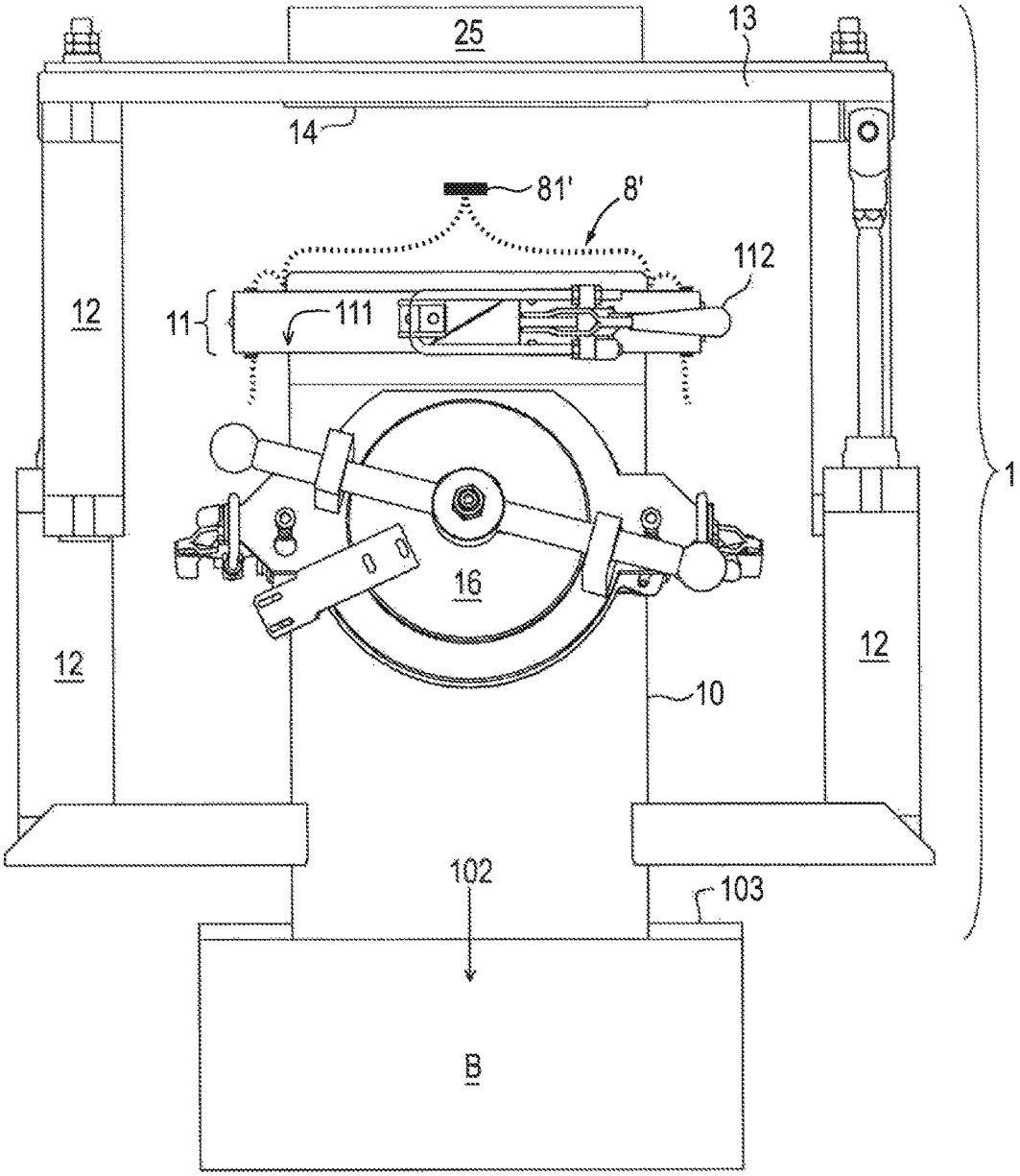
Figure 14B:
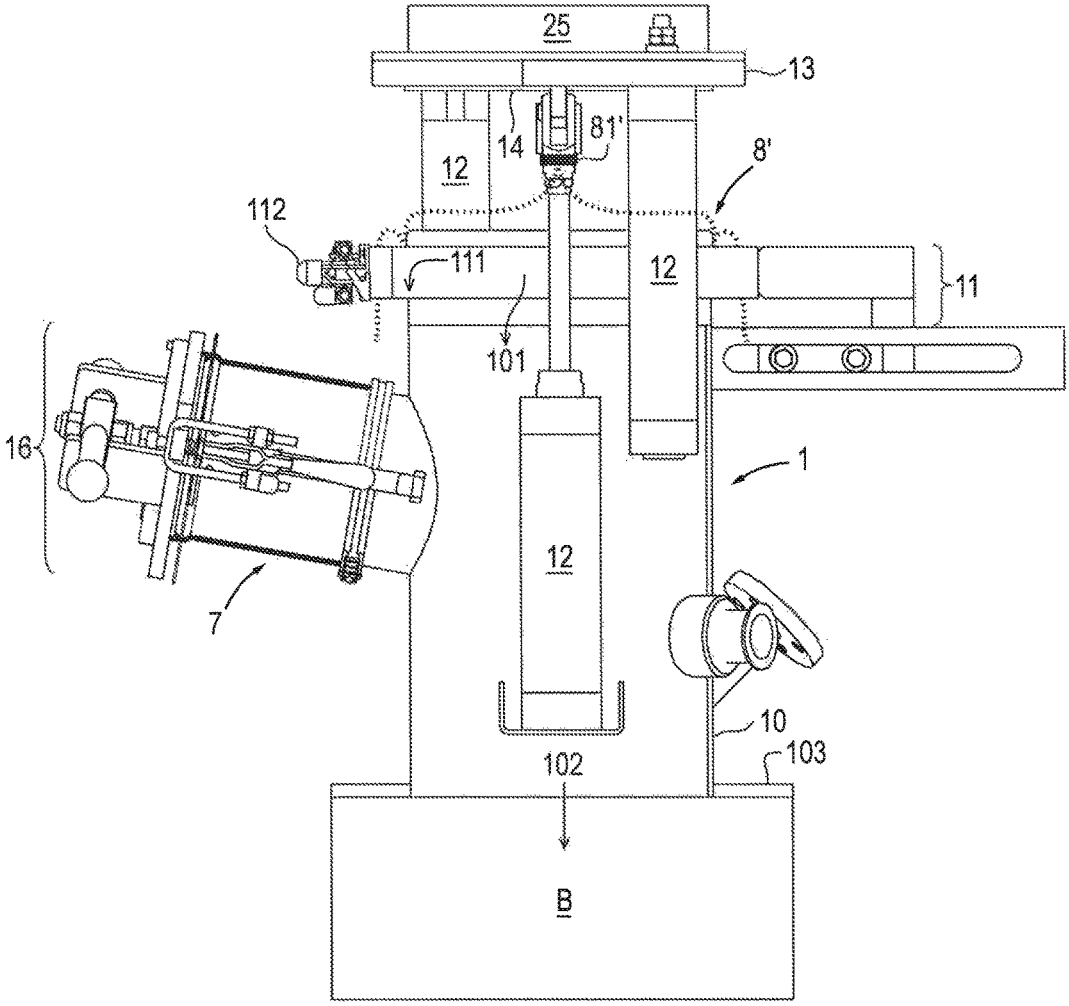
Figure 14C:
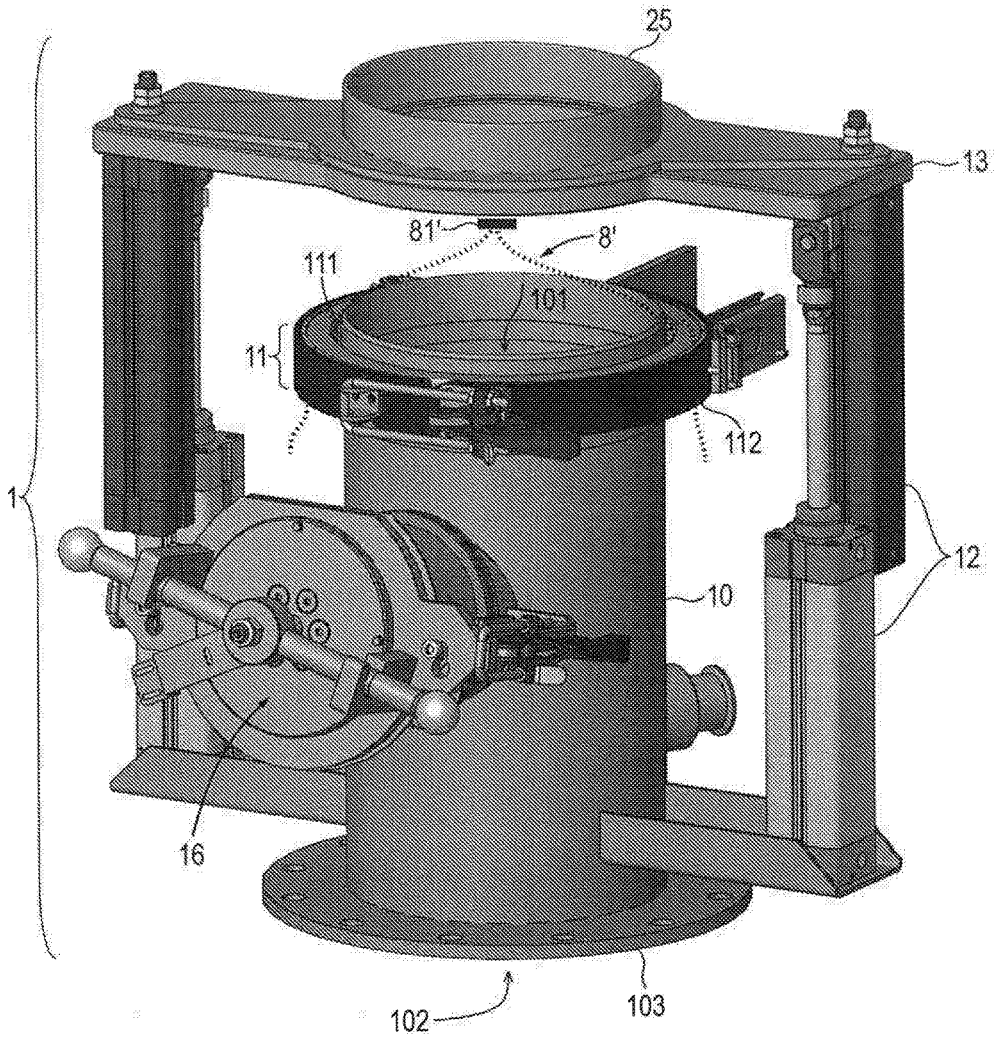
Figure 15A:
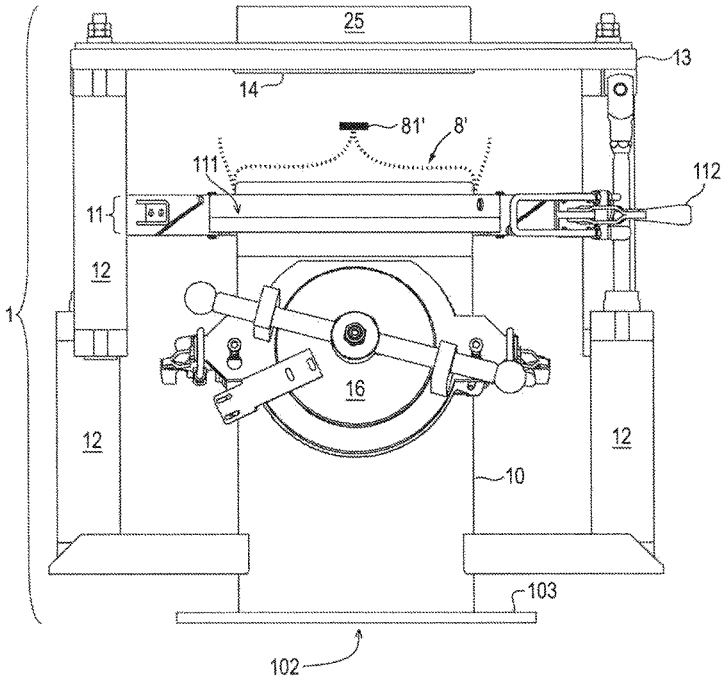
Figure 15B:
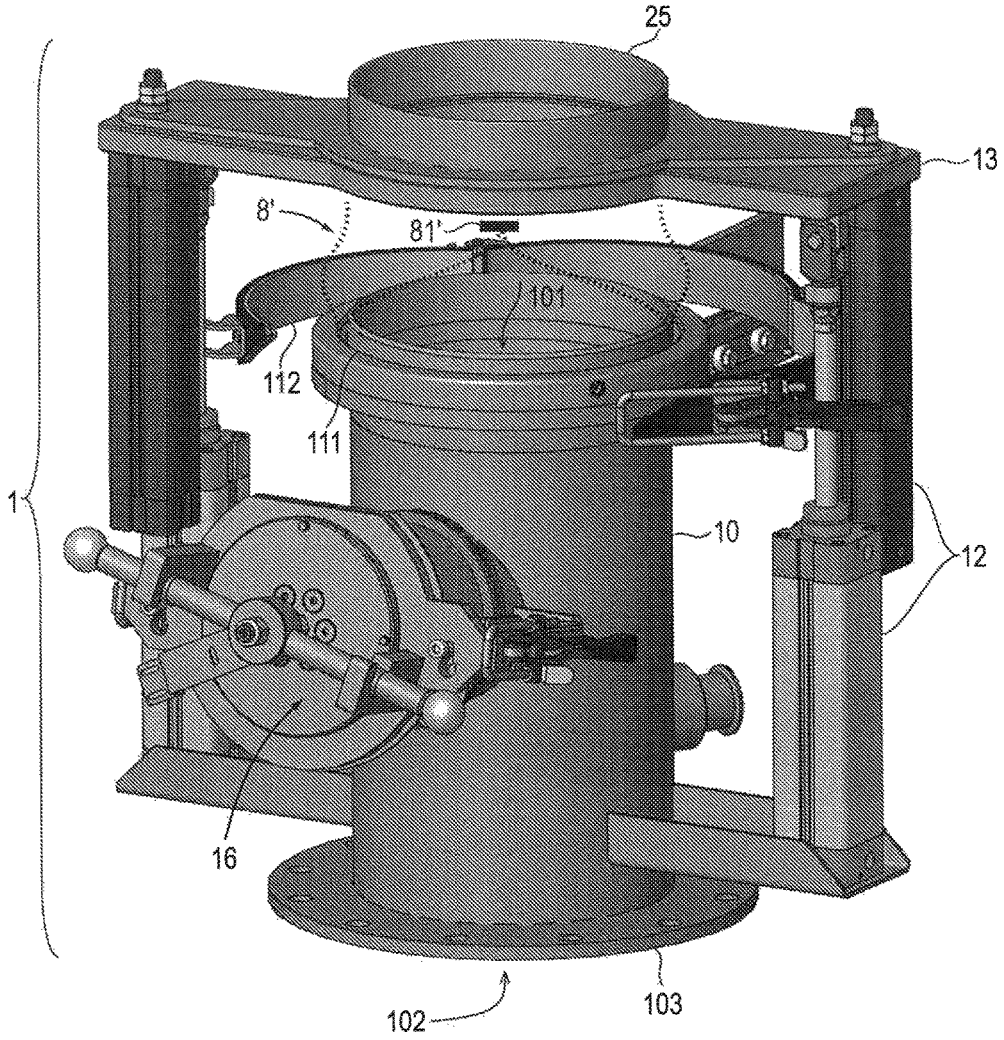
Figure 16A:
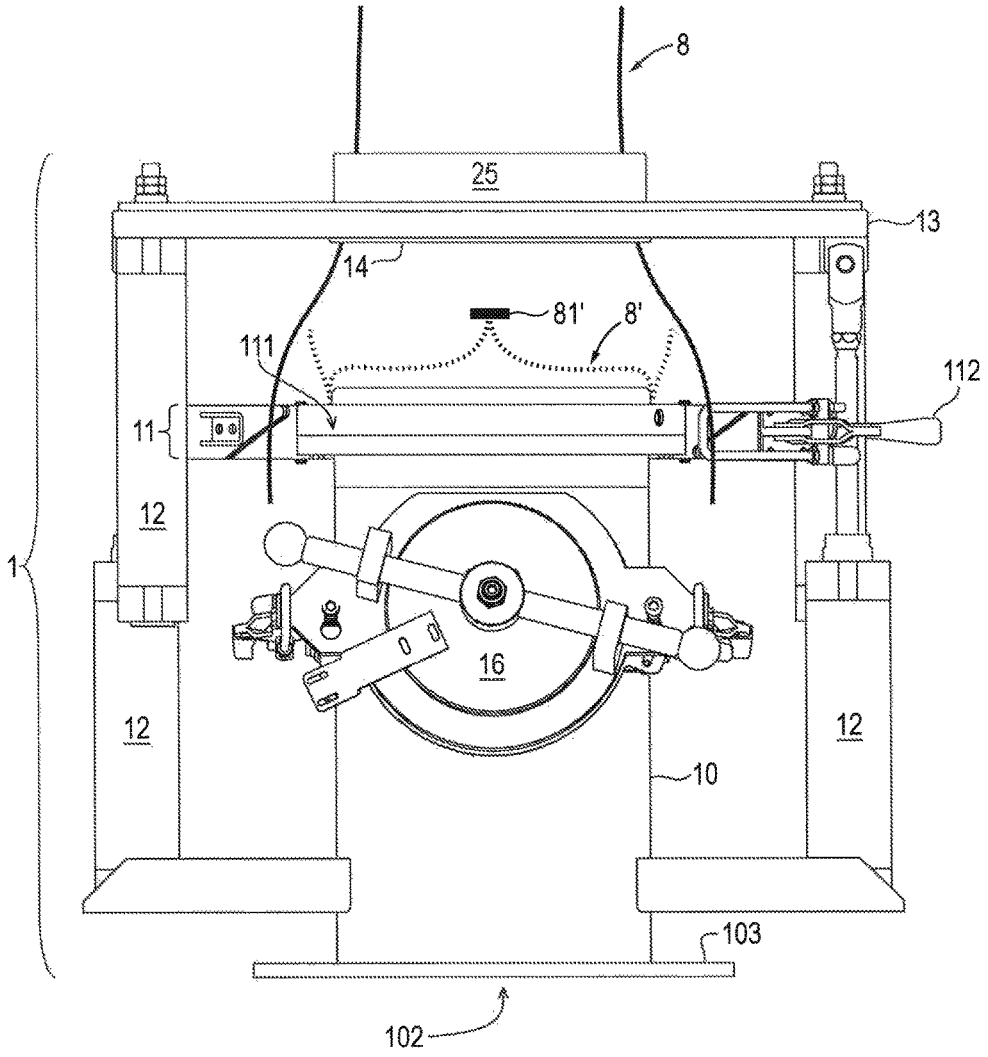
Figure 16B:
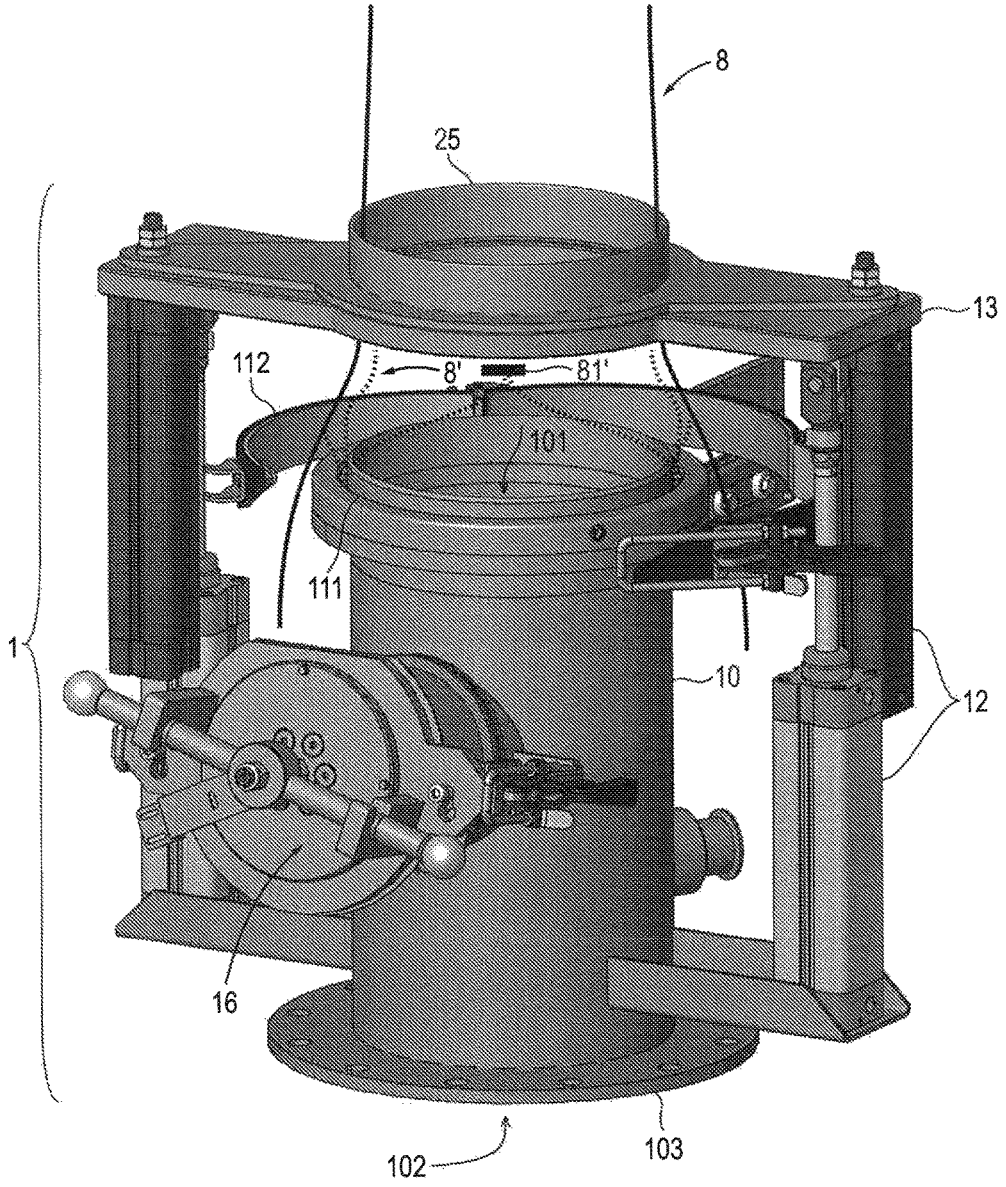
Figure 17A:
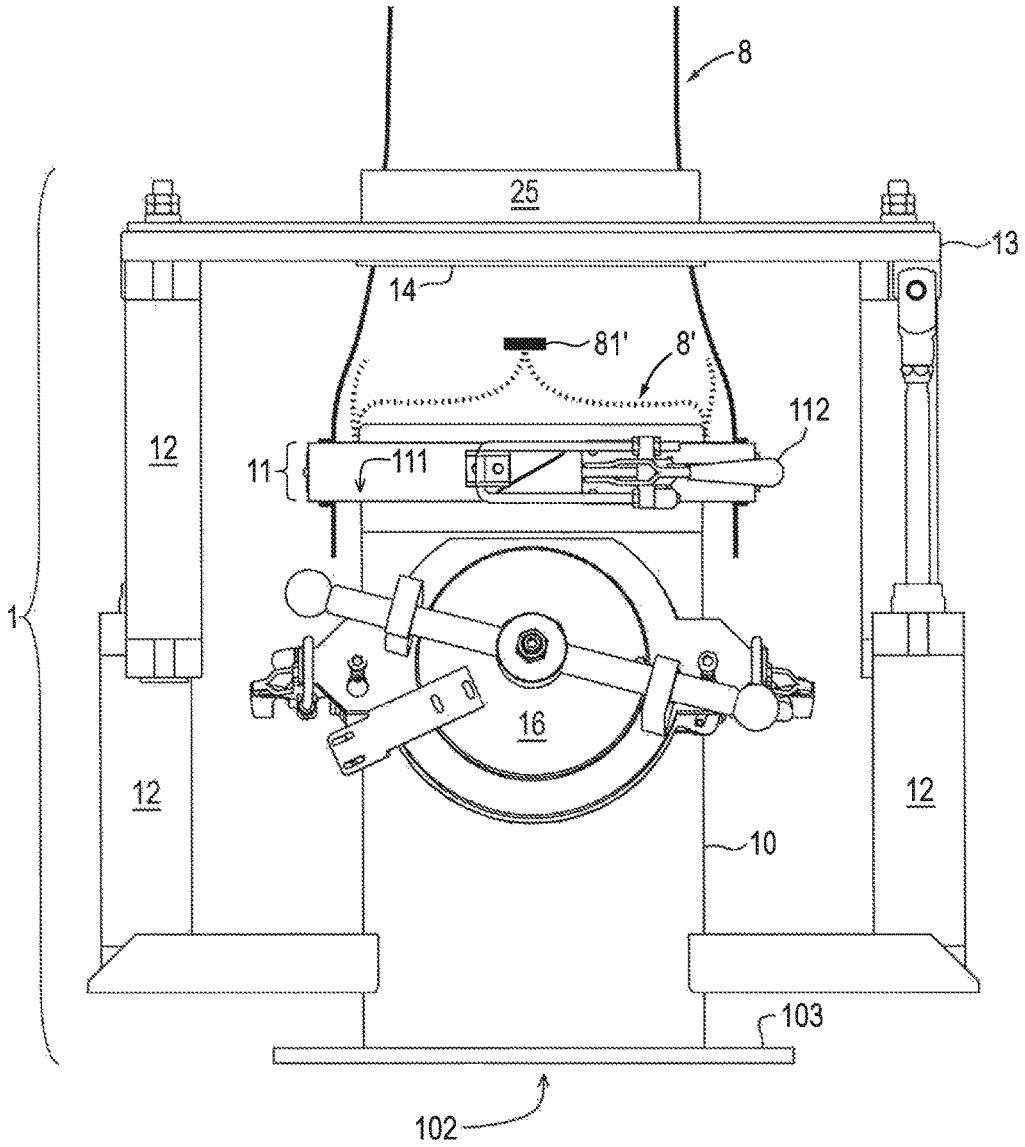
Figure 17B:
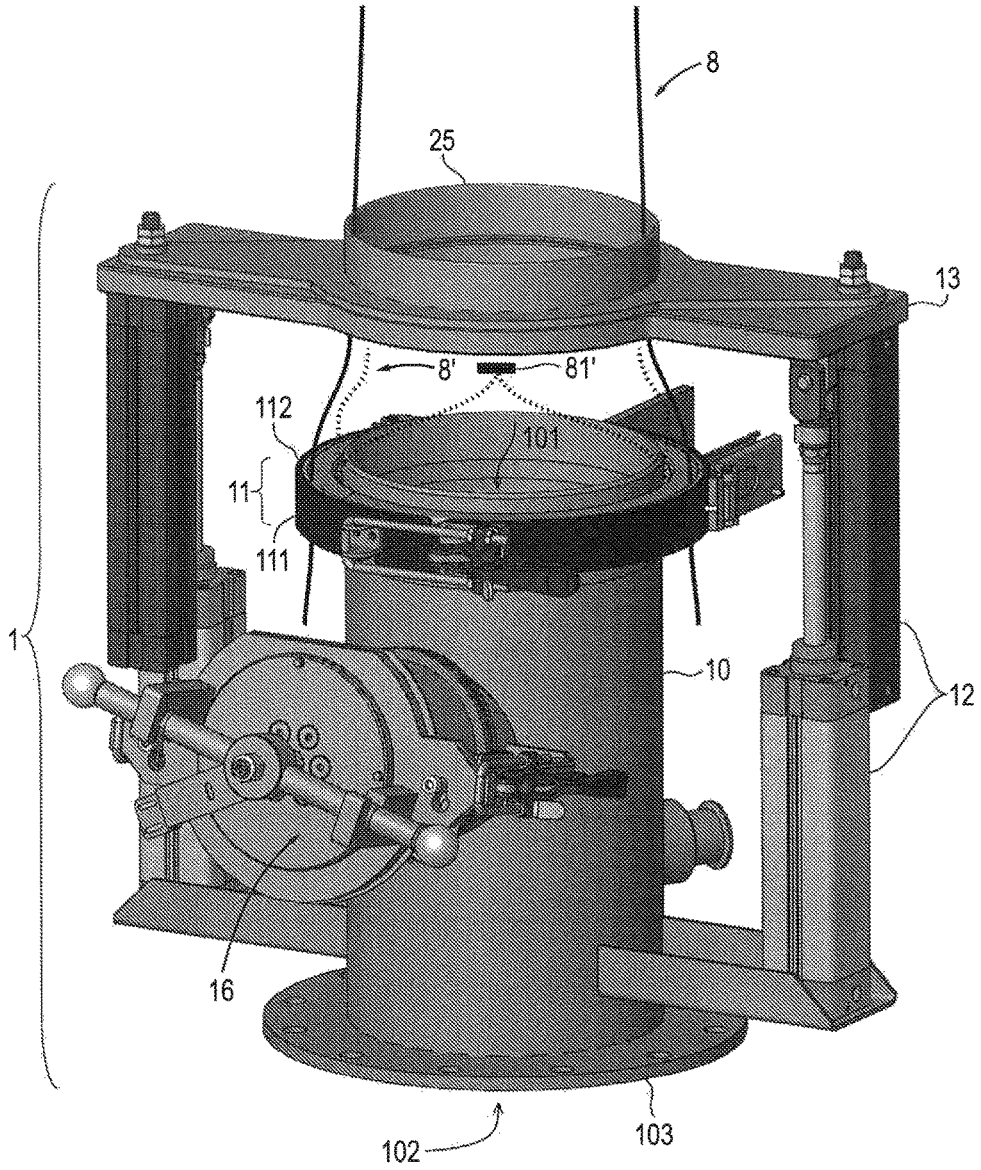
Figure 18A:
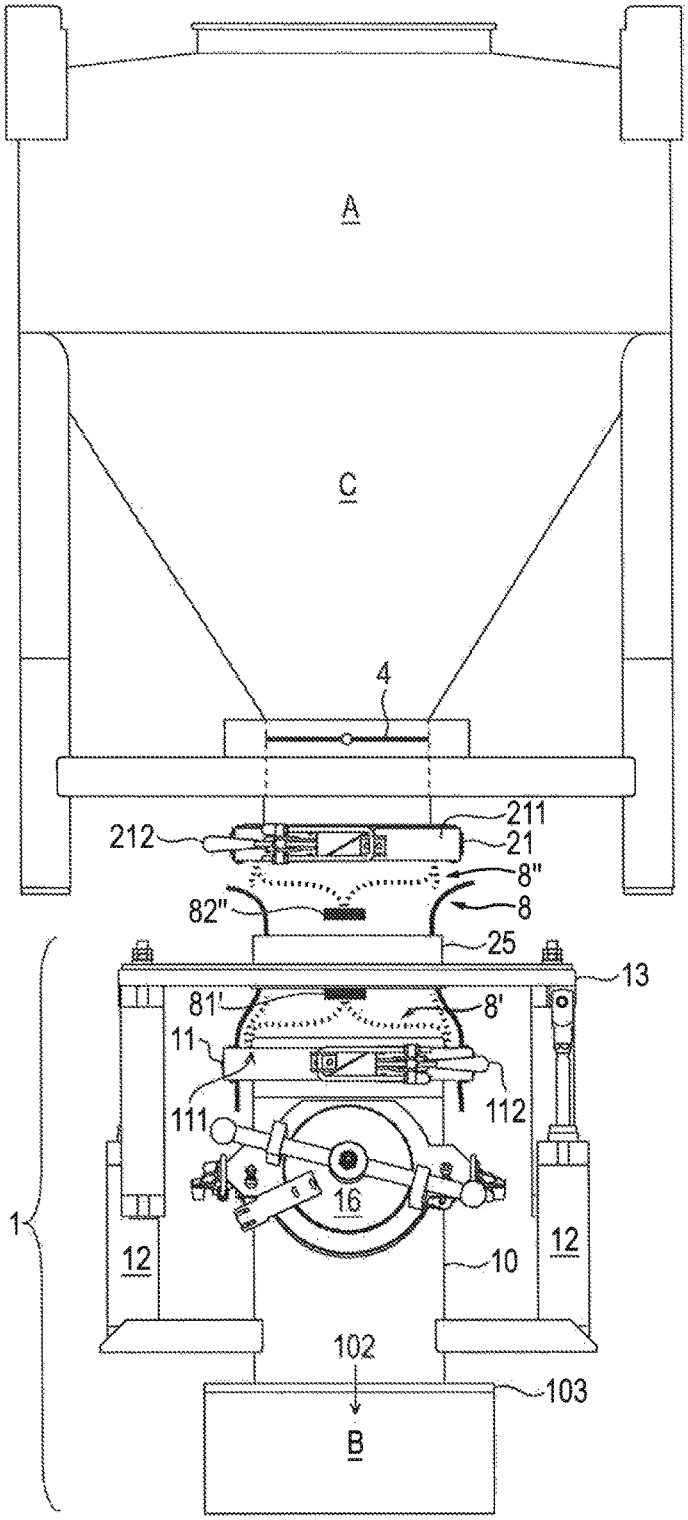
Figure 18B:
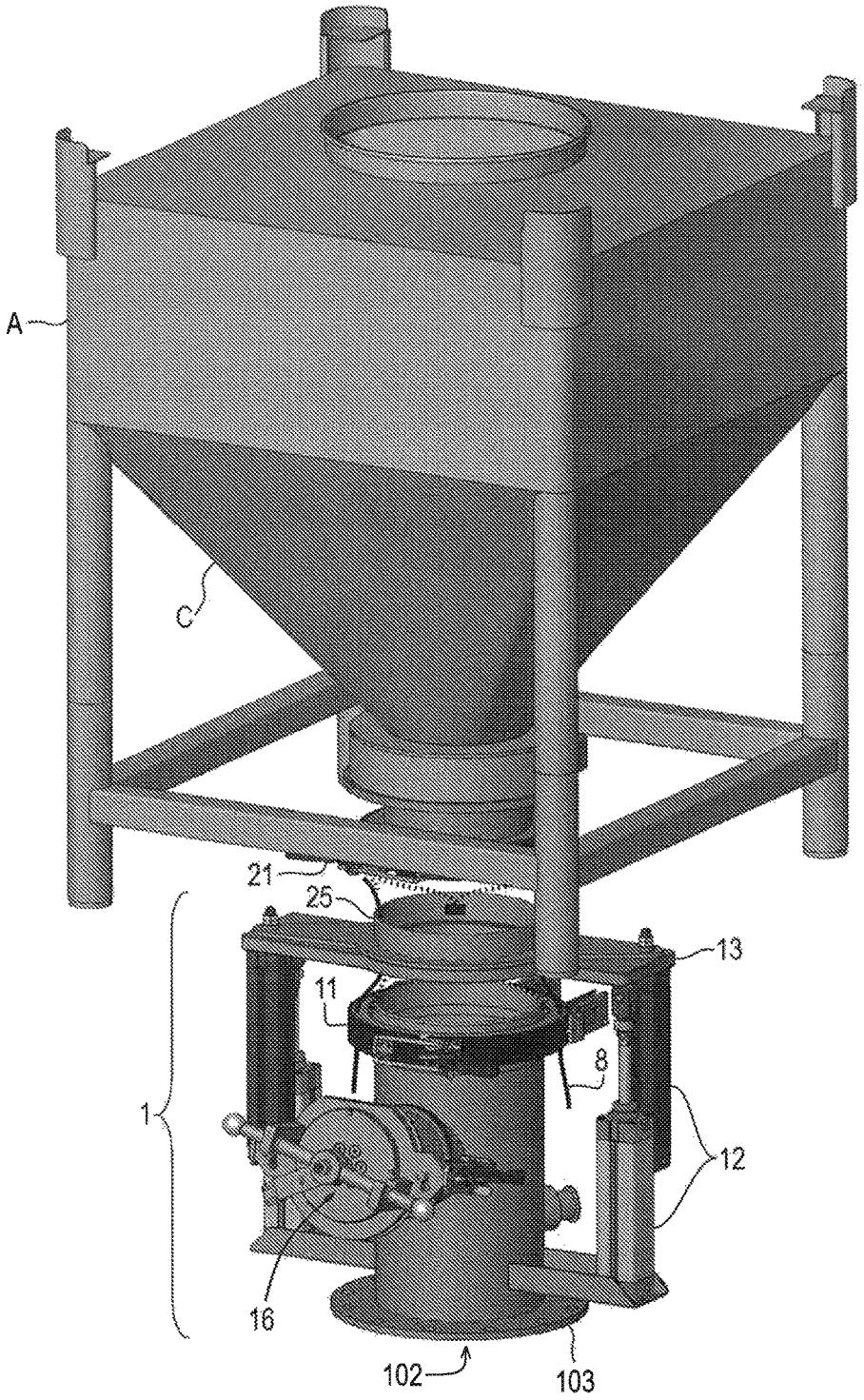
Figure 19:
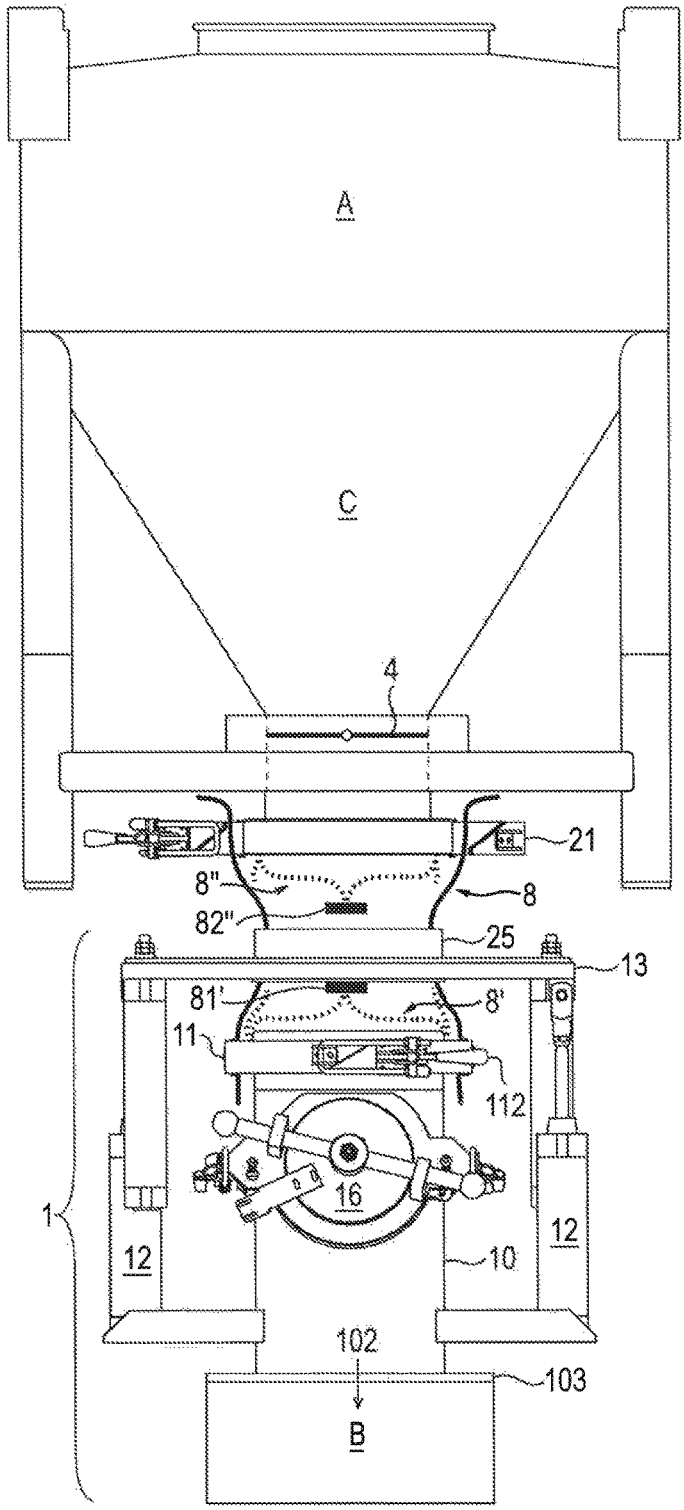
Figure 20A:
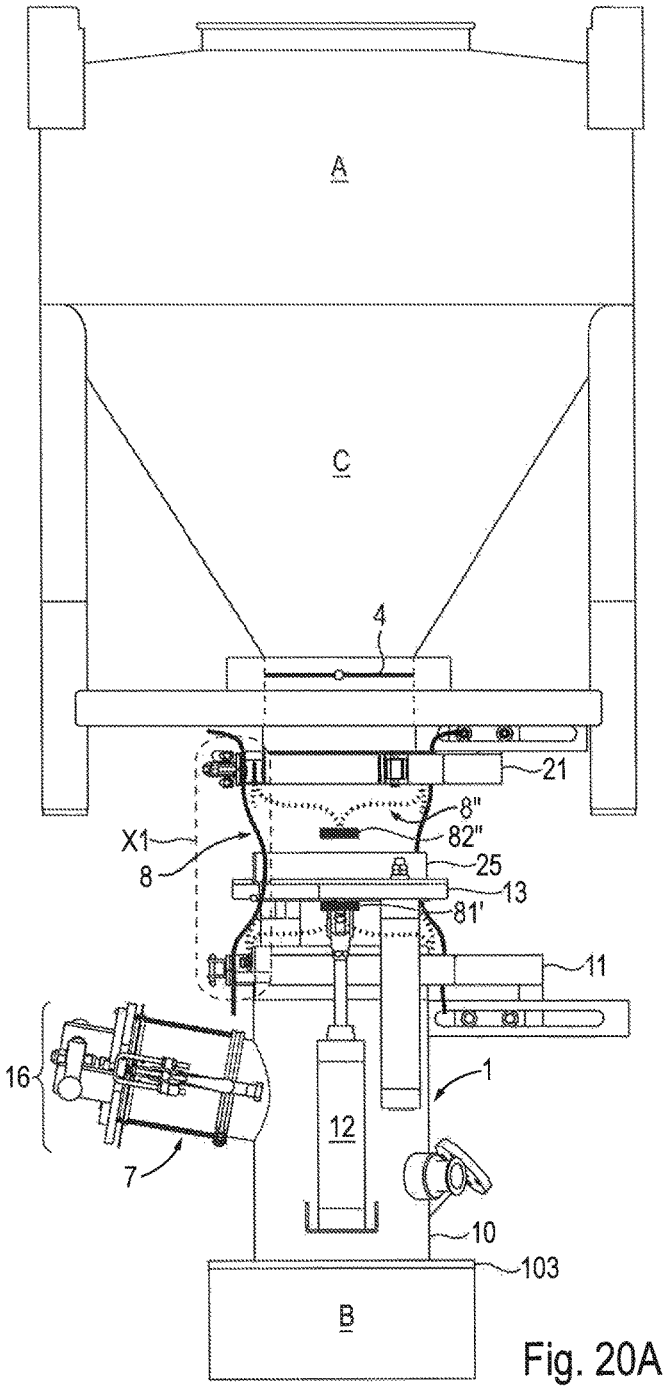
Figure 20B:
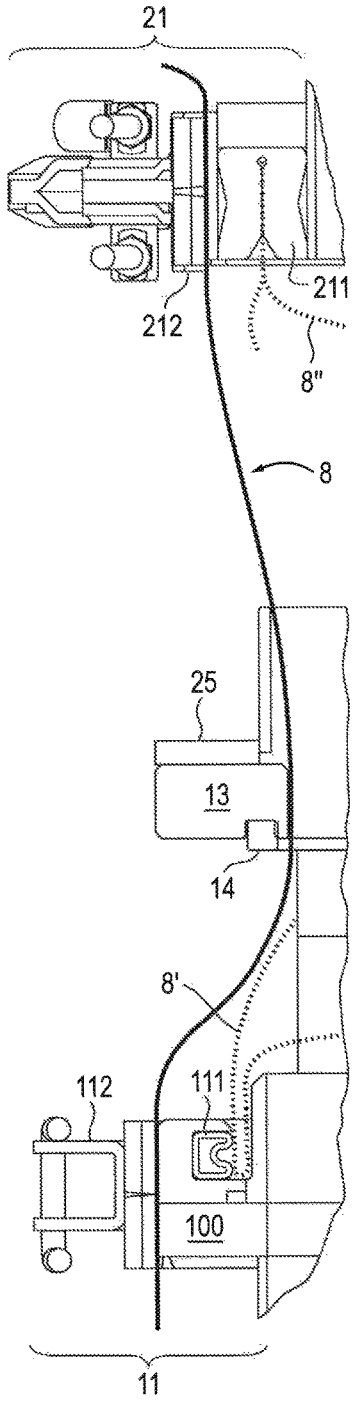
Figure 21A:
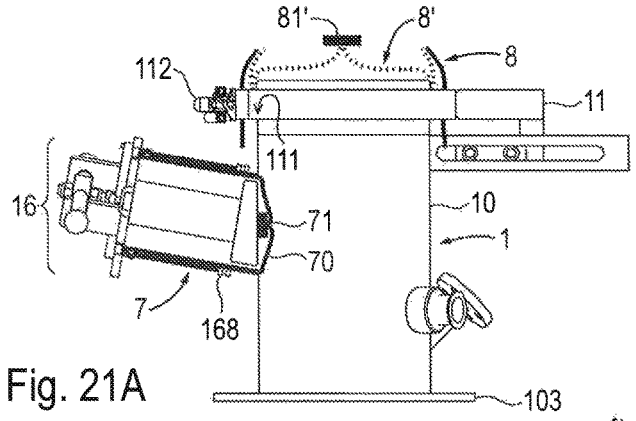
Figure 21B:
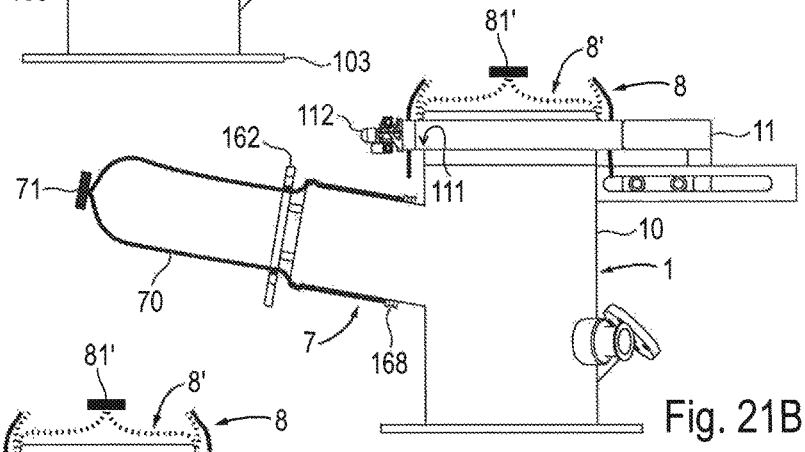
Figure 21C:
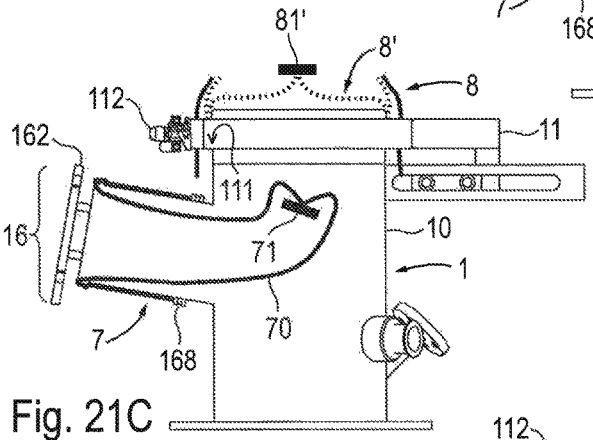
Figure 21D:
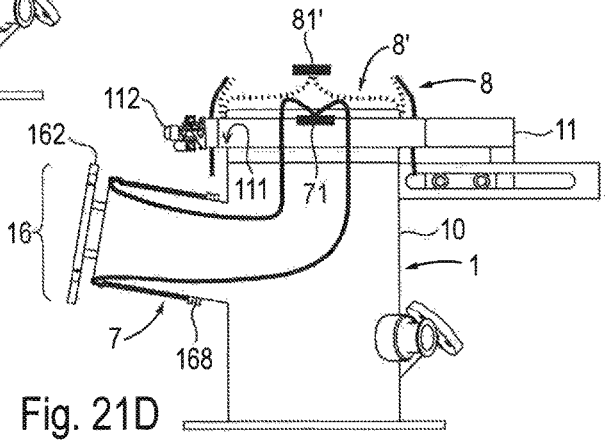
Figure 21E:
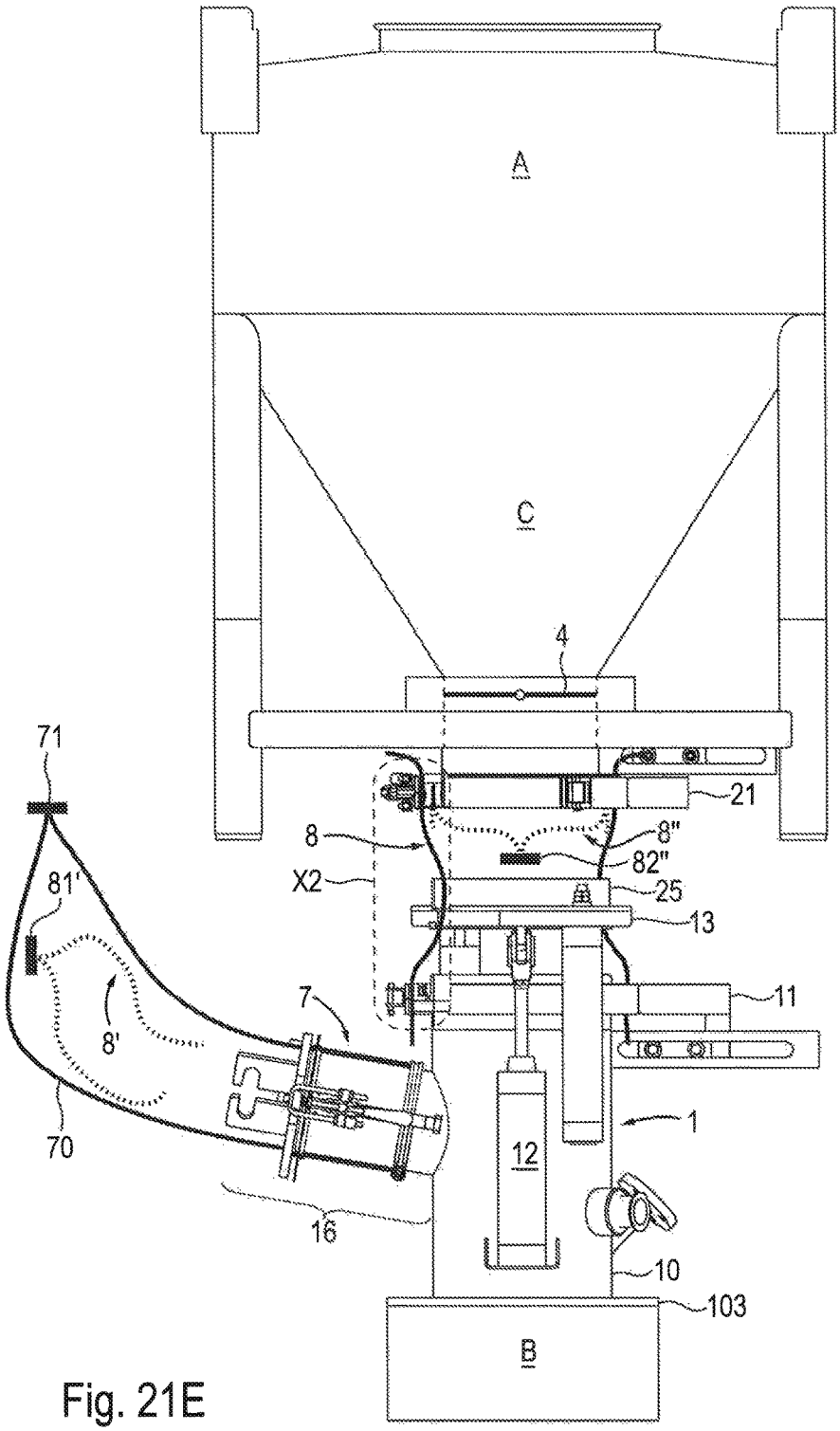
Figure 21G:
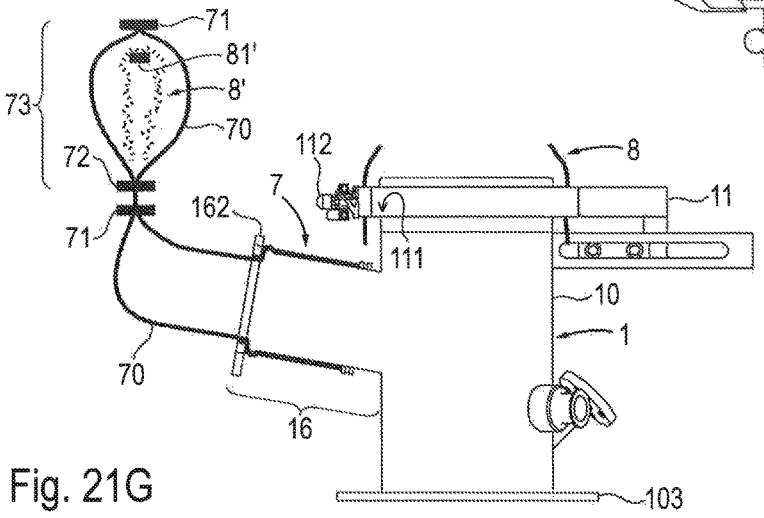
Figure 21H:
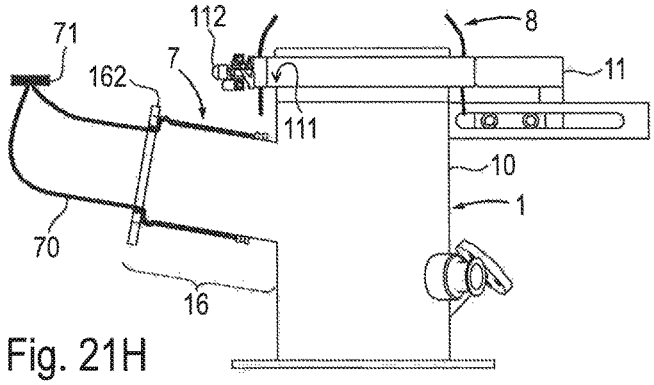
Figure 21F:
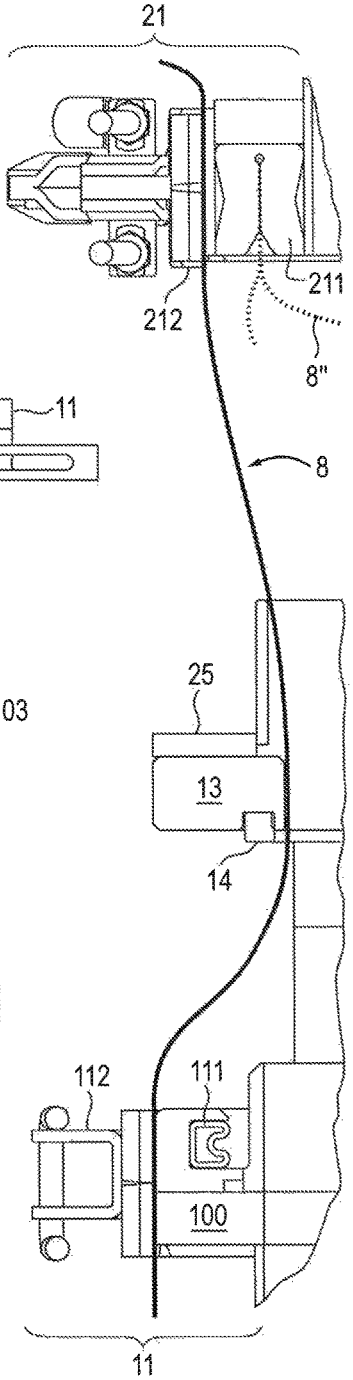
Figure 22A:
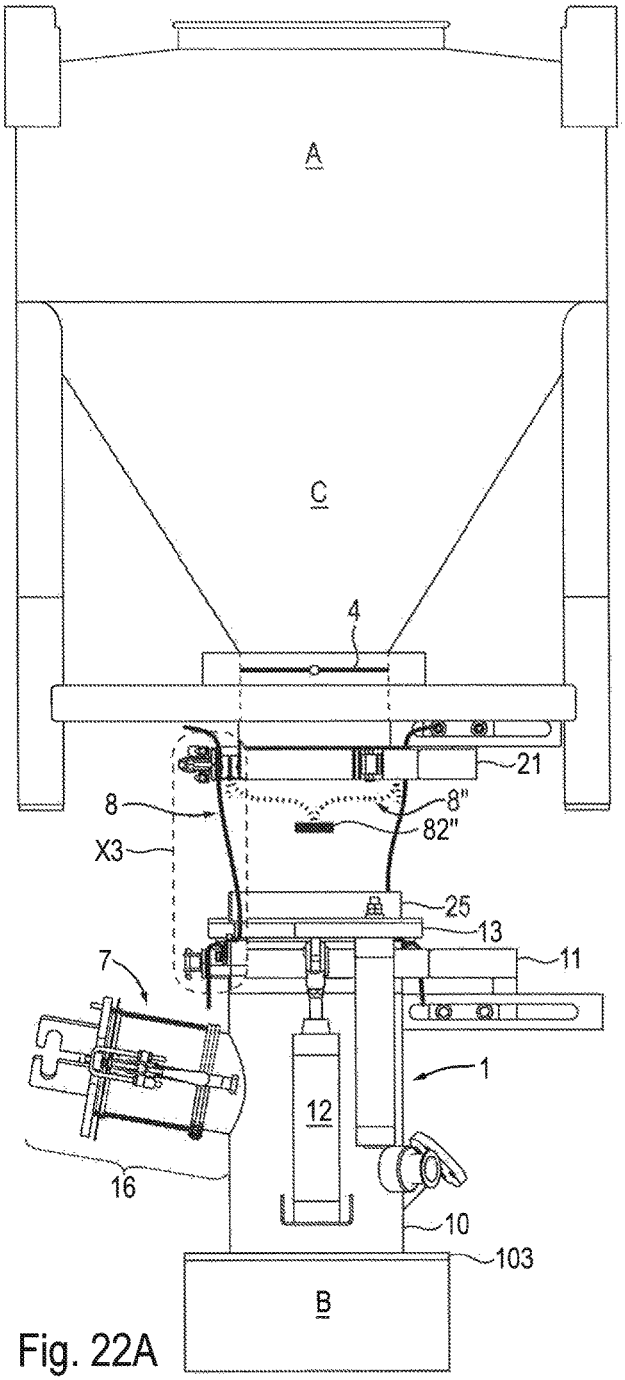
Figure 22B:
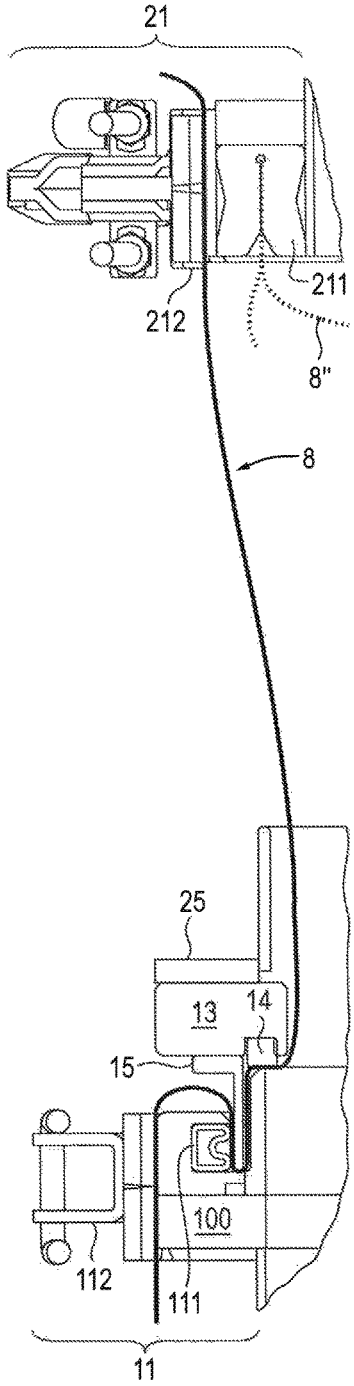
Figure 23A:
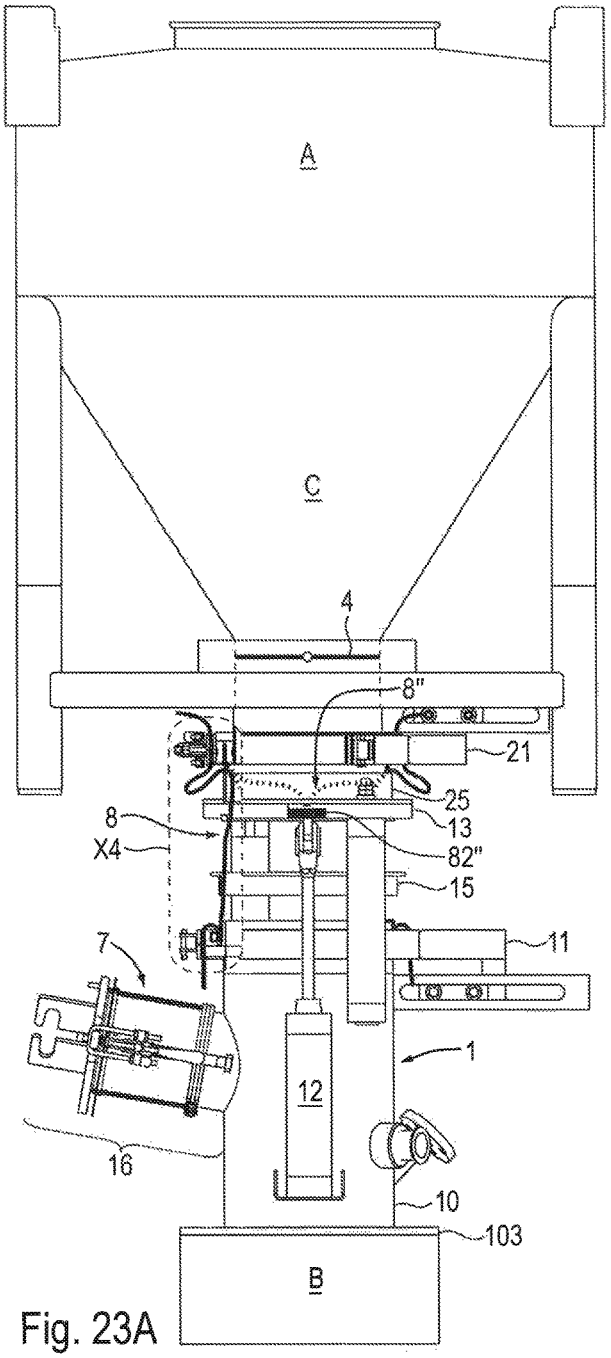
Figure 23B:
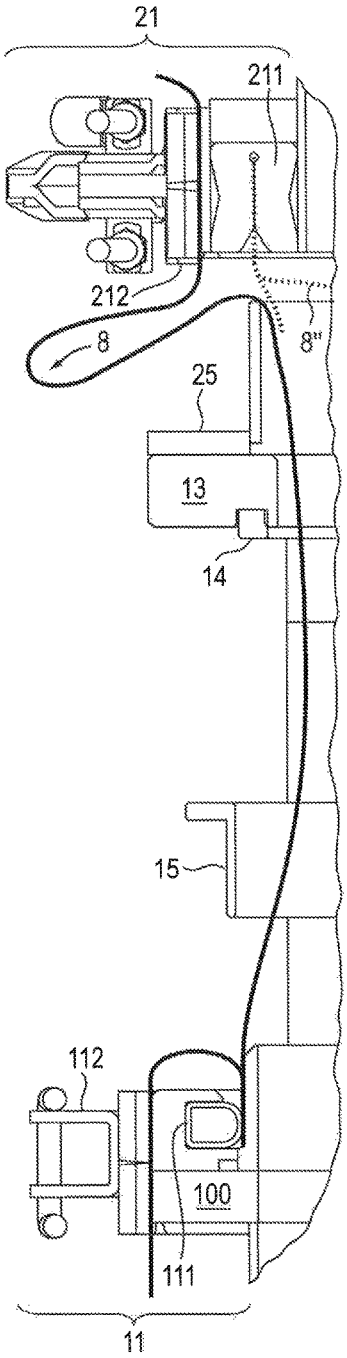
Figure 24A:
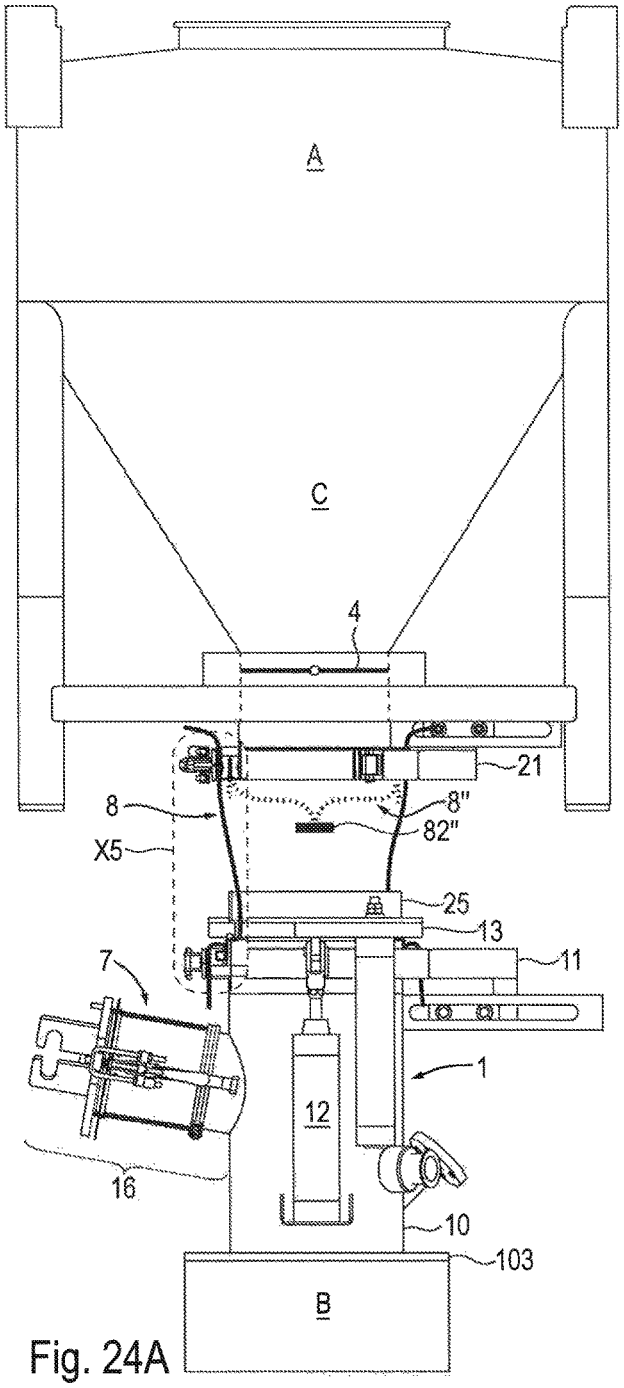
Figure 24B:
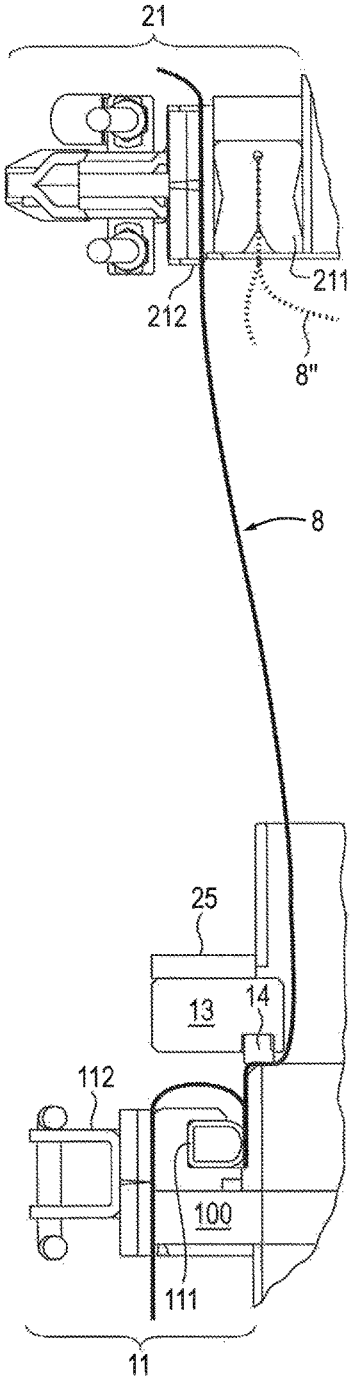
Figure 25A:
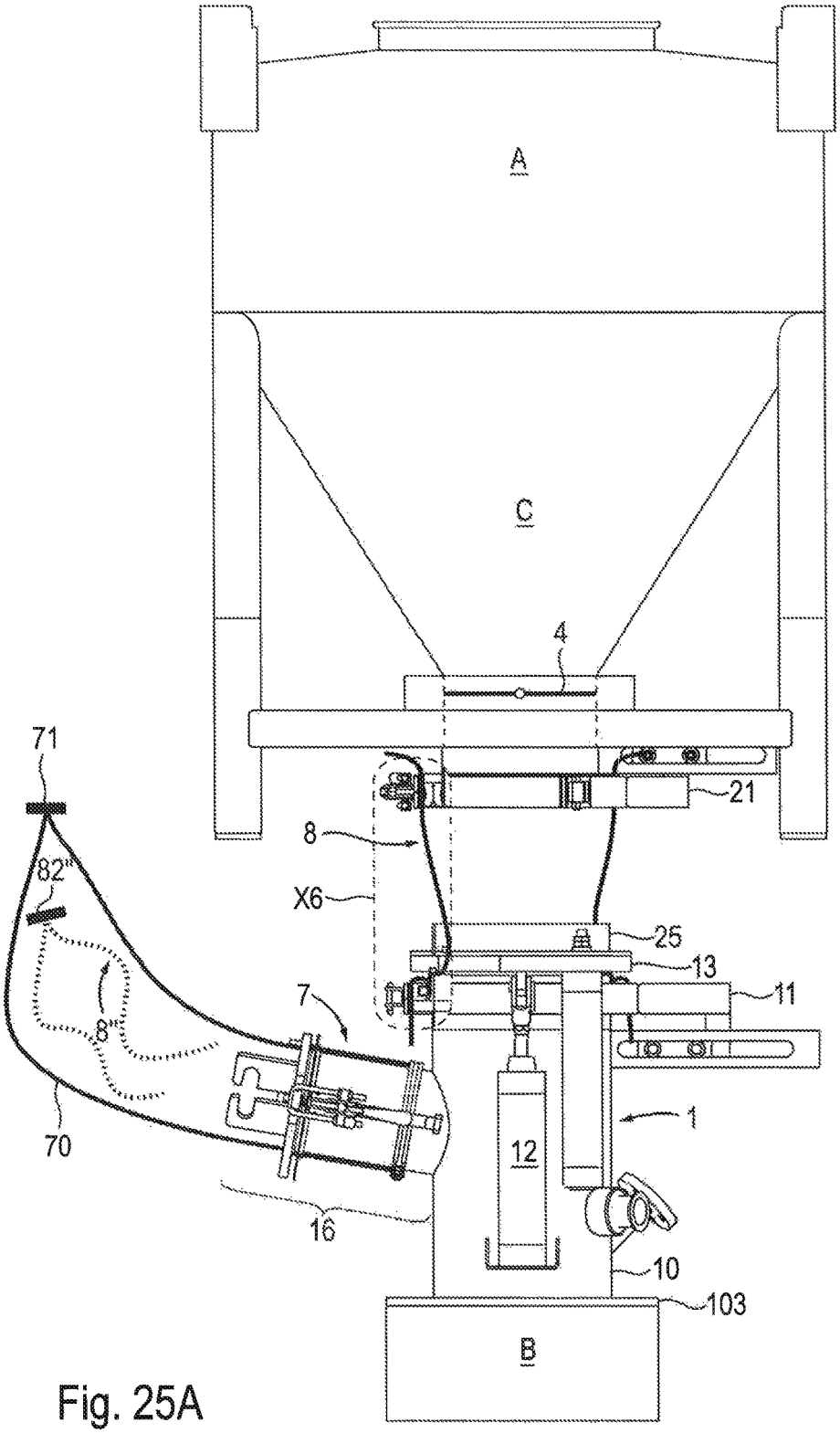
Figure 25C:
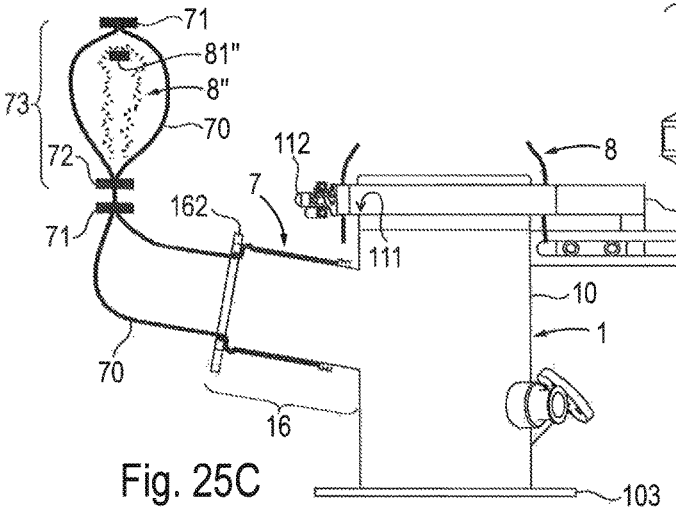
Figure 25D:
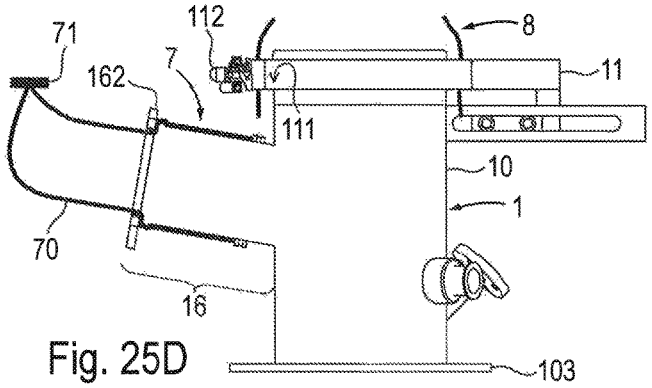
Figure 25E:
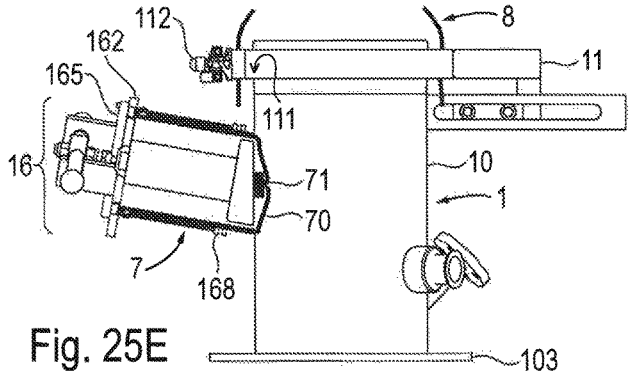
Figure 25B:
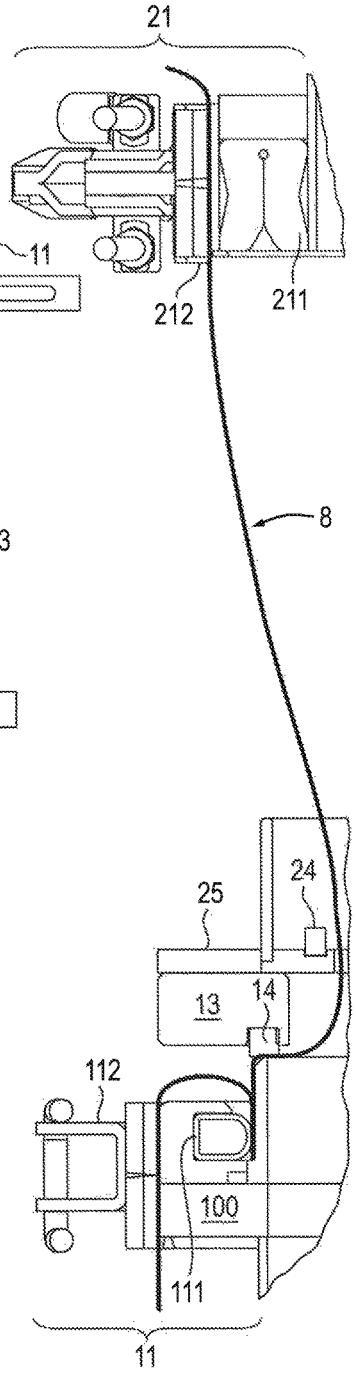
Figure 26A:
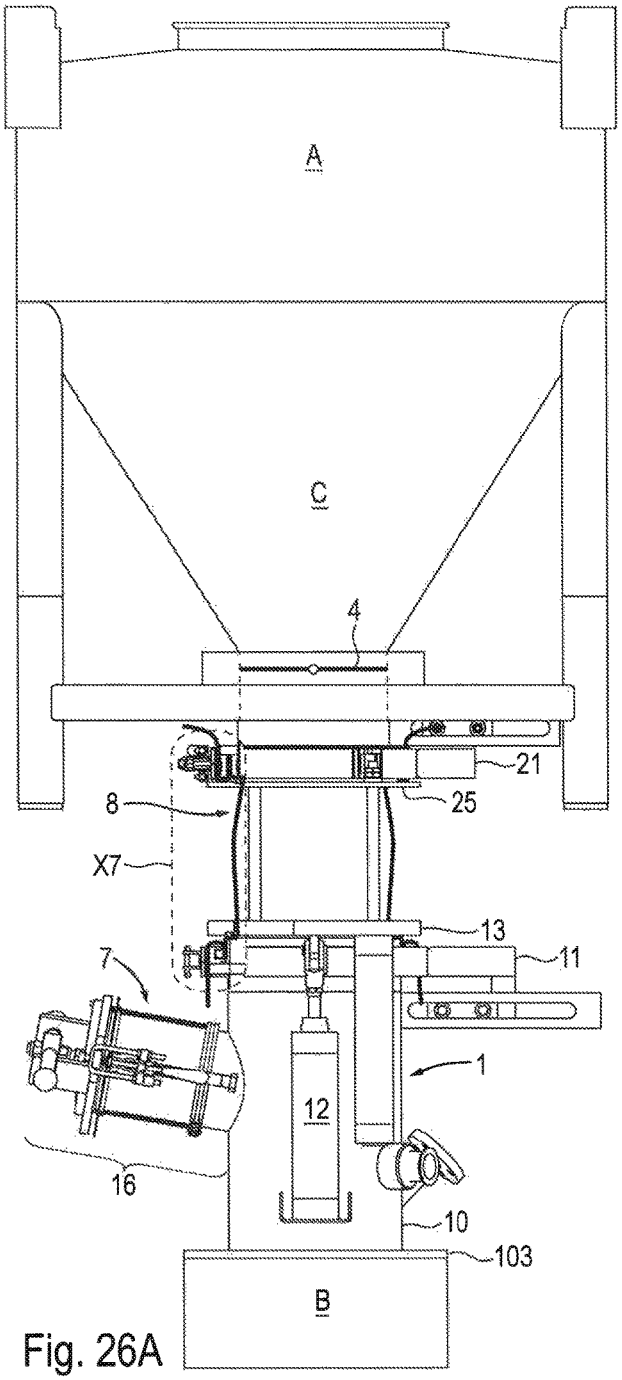
Figure 26B:
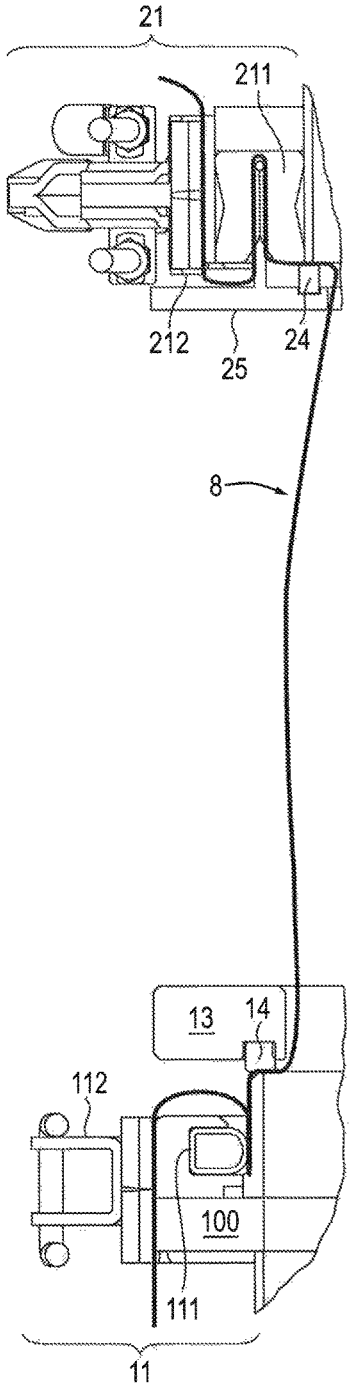
Figure 27A:
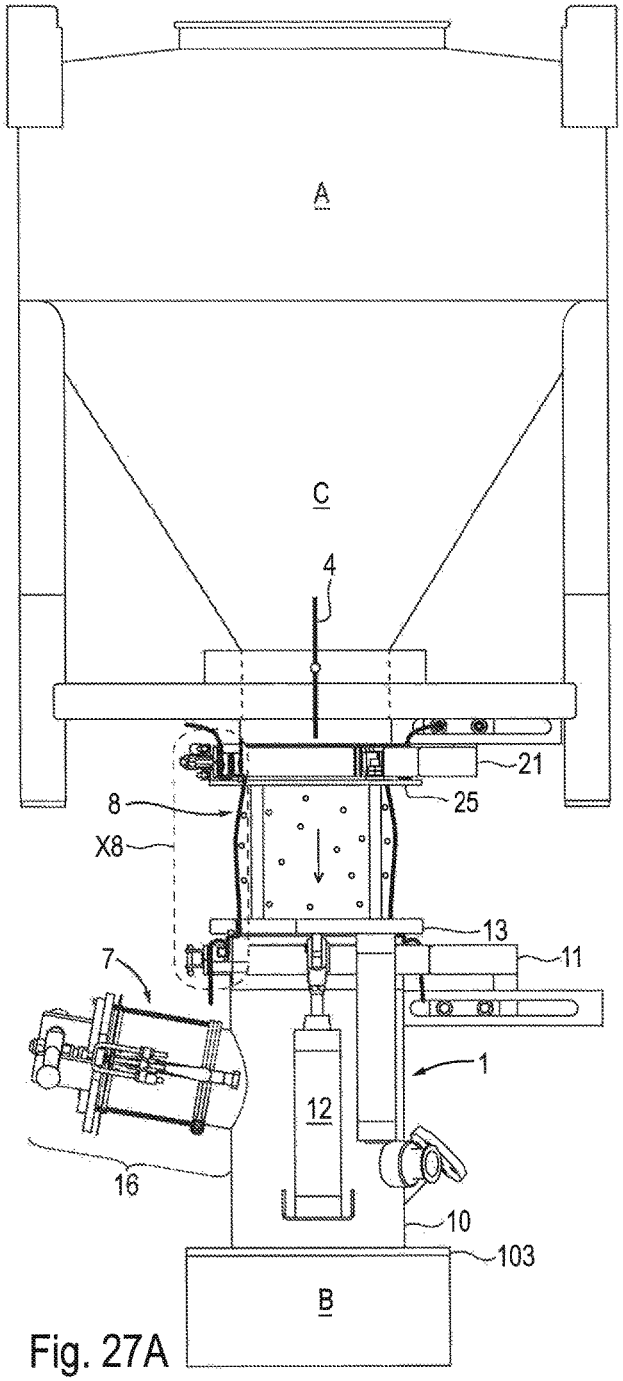
Figure 27B:
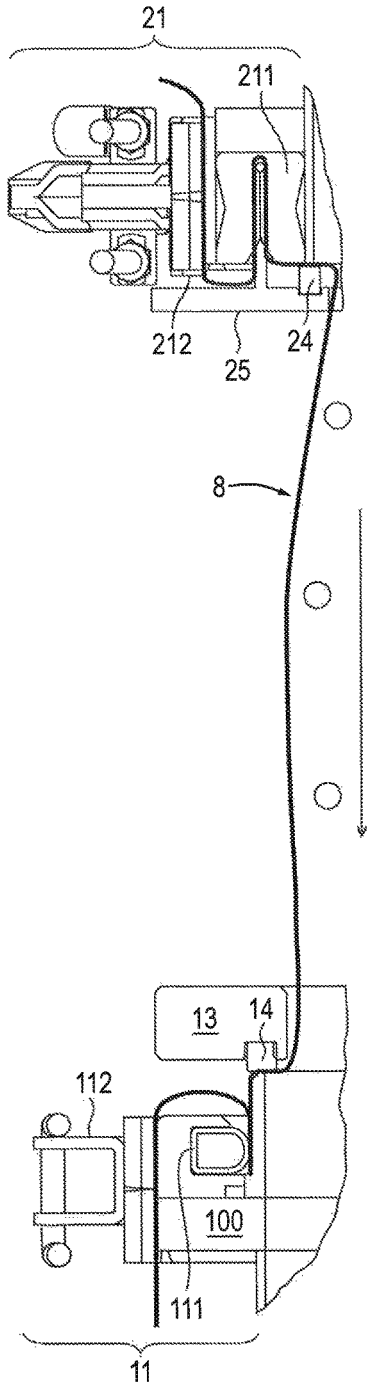
Figures 28A, 28B:
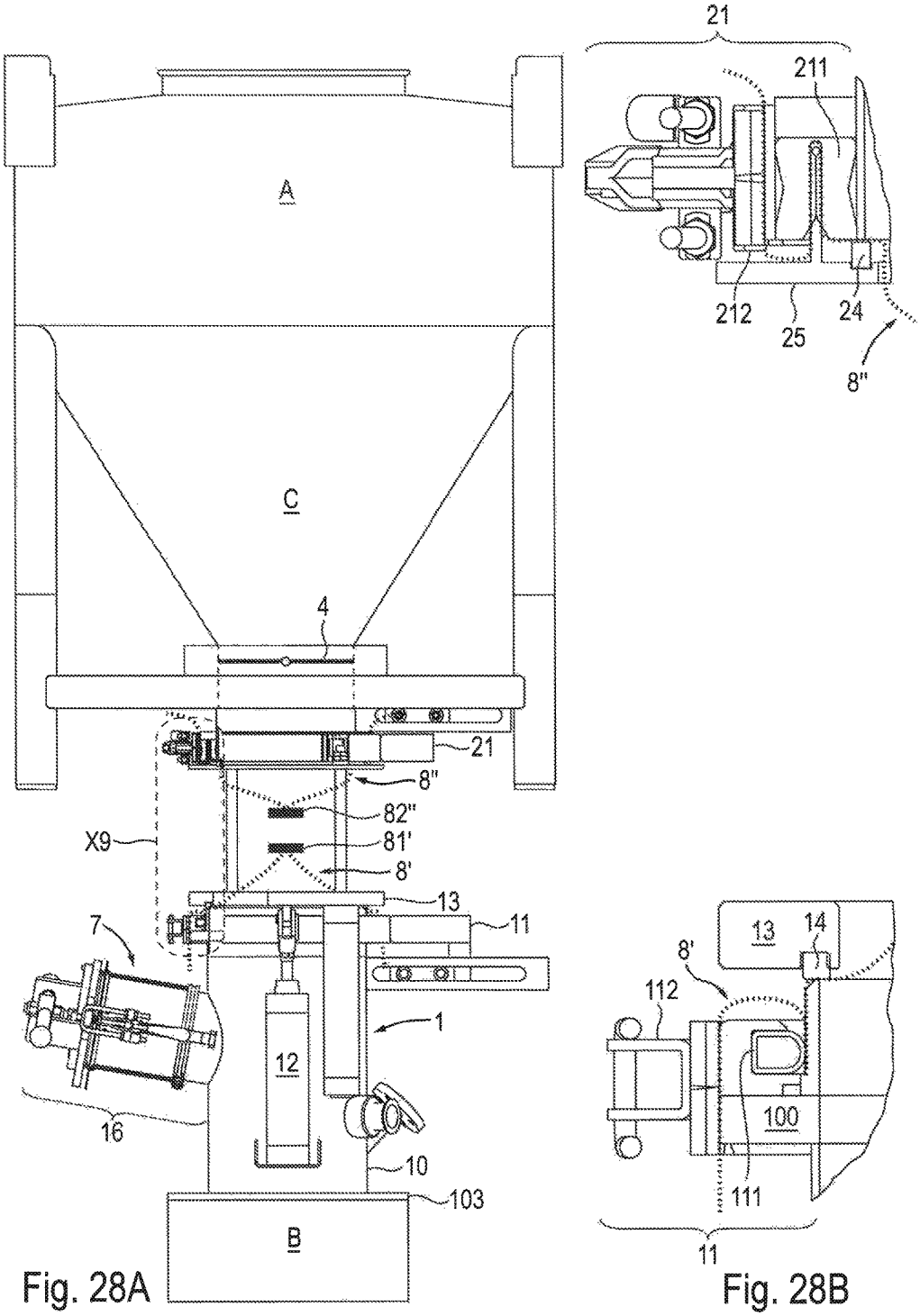
Figure 29A:
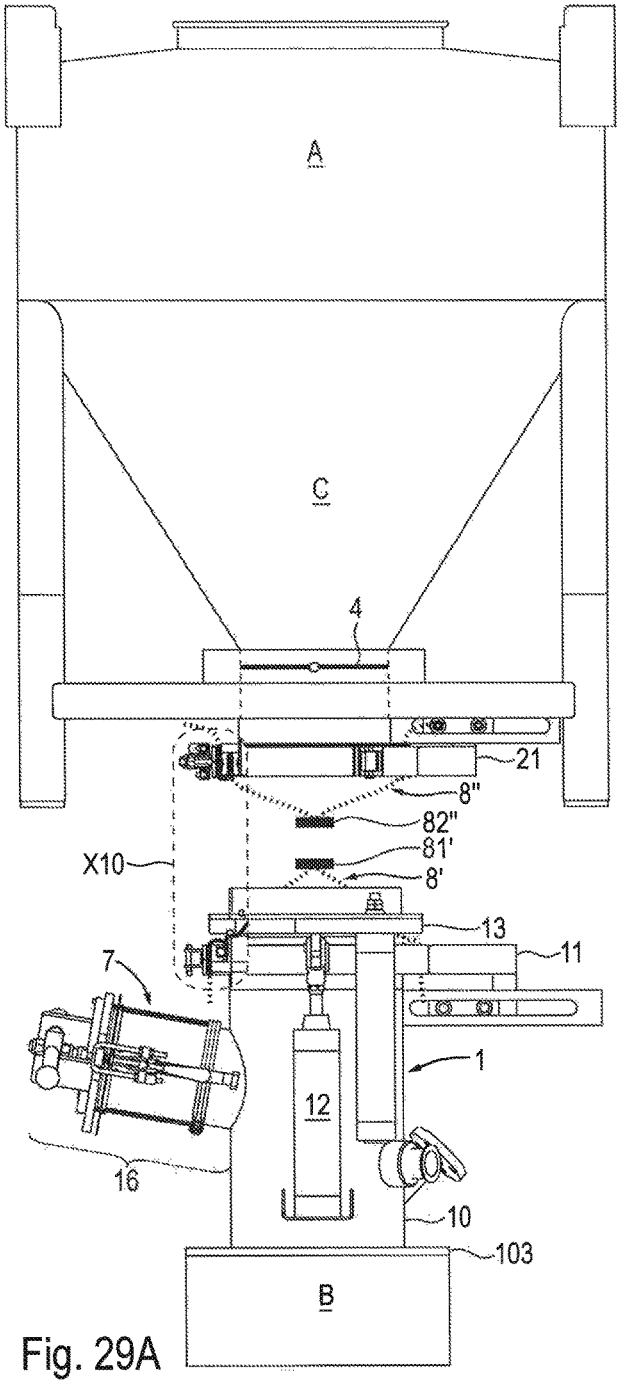
Figure 29B:
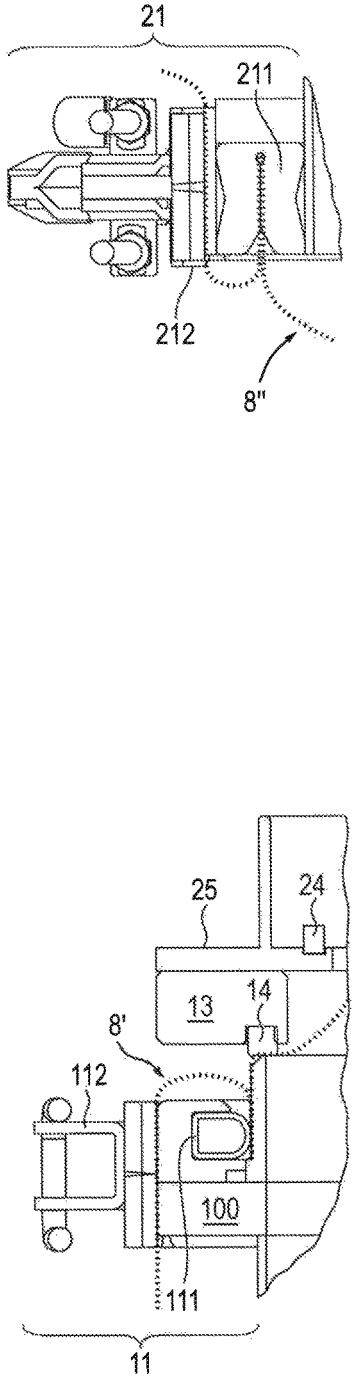

FIGS. 14A to 29B: show a second exemplary application of the apparatus according to the invention in conjunction with a transfer means for emptying a first container in the form of a container having an inflexible outlet for process material in the form of flowable solid materials, with the key situations during a transfer operation, as schematic diagrams;

FIG. 14A—first situation: first liner remainder from a previous transfer operation closed by first crimp and fixed, in a sealed-off manner, at tensioning unit of the transfer means by means of active first tensioner, press ring with seal moved up above guide tube, end of the liner remainder additionally fixed, in a sealed-off manner, at guide tube by means of closed second tensioner;

FIG. 14B—the situation according to FIG. 14A in a different view;

FIG. 14C—the situation according to FIG. 14A in a perspective view;

FIG. 15A—second situation: second tensioner opened, free end of the first liner remainder directed upwardly;

FIG. 15B—the situation according to FIG. 15A in a perspective view;

FIG. 16A—third situation: lower end of the new liner piece for next transfer operation guided through open second tensioner and drawn loosely over guide tube, upper end of the new liner piece guided upwardly through press ring and folding element;

FIG. 16B—the situation according to FIG. 16A in a perspective view;

FIG. 17A—fourth situation: lower end of the new liner piece fixed, in a sealed-off manner, to guide tube by means of closed second tensioner;

FIG. 17B—the situation according to FIG. 17A in a perspective view;

FIG. 18A—fifth situation: first container to be emptied with closed isolation member and second liner remainder from previous transfer operation held in a second tensioning unit and positioned above the transfer means;

FIG. 18B—the situation according to FIG. 18A in a perspective view;

FIG. 19—sixth situation: upper end of the new liner piece at second tensioner guided through open second tensioner;

FIG. 20A—seventh situation: first tensioner at first tensioning unit deactivated; second tensioner at second tensioning unit closed;

FIG. 20B—the enlarged detail X1 from FIG. 20A;

FIGS. 21A to 21H: eighth situation: discharge of the first liner remainder with deactivated first tensioner at first tensioning unit;

FIG. 21A—utility portion from liner stock with first crimp advanced by stopper in transfer unit, front seal point at transfer unit closed by flange pressed in abutment via head seal;

FIG. 21B—cover with stopper removed from transfer unit, flange with head seal moved forward and front seal point released, production of a utility portion by drawing off externally from the liner stock through transfer unit;

FIG. 21C—utility portion of the liner stock advanced through transfer unit into guide tube;

FIG. 21D—grasping of the first liner remainder of the first previous container by means of the utility portion through transfer unit and guide tube;

FIG. 21E—extraction of the utility portion externally with grasped first liner remainder through transfer unit;

FIG. 21F—the enlarged detail X2 from FIG. 21E;

FIG. 21G—front seal point at transfer unit closed by flange pressed in abutment via head seal; division of a separation part at the extracted utility portion with first liner remainder enclosed therein by providing a second crimp and, close thereto, a next first crimp, creation of a next utility portion at the liner stock;

FIG. 21H—severing between second and next first crimp, removal of the separation part with first liner remainder enclosed therein from the next utility part;

FIG. 22A—ninth situation: press ring with seal moved down toward guide tube, pressing of the free end of the new liner piece by means of folding element against inactive first tensioner;

FIG. 22B—the enlarged detail X3 from FIG. 22A;

FIG. 23A—tenth situation: press ring with seal moved up from guide tube, first tensioner activated, folding element removed from the first tensioner, lower end of the new line piece fixed twice, in a sealed-off manner, in first tensioning unit;

FIG. 23B—the enlarged detail X4 from FIG. 23A;

FIG. 24A—eleventh situation: folding element removed from apparatus, press ring moved down, lower end of the new liner piece additionally fixed, in a sealed-off manner, by means of a seal resting against the guide tube;

FIG. 24B—the enlarged detail X5 from FIG. 24A;

FIGS. 25A to 25E: twelfth situation: discharge of the second liner remainder from the second tensioning unit on the first container;

FIG. 25A—grasping of the second liner remainder using next utility portion from liner stock through transfer unit and guide tube; extraction externally of the utility portion with grasped second liner remainder through transfer unit;

FIG. 25B—the enlarged detail X6 from FIG. 25A;

FIG. 25C—front seal point at transfer unit closed by flange pressed in abutment via head seal, division of a separation part at the extracted utility portion with second liner remainder enclosed therein by providing a second crimp and, close thereto, a next first crimp, provision of a next utility portion from the liner stock;

FIG. 25D—severing between second and next first crimp, removal of the separation part with second liner remainder enclosed therein from the next utility portion;

FIG. 25E—next utility portion with new first crimp advanced by stopper in the transfer unit, front seal point at transfer unit closed by flange pressed in abutment via head seal;

FIG. 26A—thirteenth situation: pressing of the upper end of the new liner piece into first tensioner of the second tensioning unit by means of second folding ring;

FIG. 26B—the enlarged detail X7 from FIG. 26A;

FIG. 27A—fourteenth situation: opening of isolation member, process material from first container flows through guide tube into second container;

FIG. 27B—the enlarged detail X8 from FIG. 27A;

FIG. 28A—fifteenth situation: closure of isolation member, provision of a second crimp and, close thereto, a next first crimp on the new liner piece; severing of the liner piece between second and next first crimp; creation of first and second liner remainders;

FIG. 28B—the enlarged detail X9 from FIG. 28A;

FIG. 29A—sixteenth situation: press ring with seal still sits on guide tube, lower end of first liner remainder fixed, in a sealed-off manner, in first tensioning unit in activated first tensioner and closed second tensioner, extraction of the second folding element from first tensioner of the second tensioning unit and lowering onto press ring, upper end of the second liner remainder still fixed, in an inserted and sealed-off manner, in the first tensioner and closed second tensioner of the second tensioning unit; and FIG. 29B—the enlarged detail X10 from FIG. 29A.

Figure 30A:
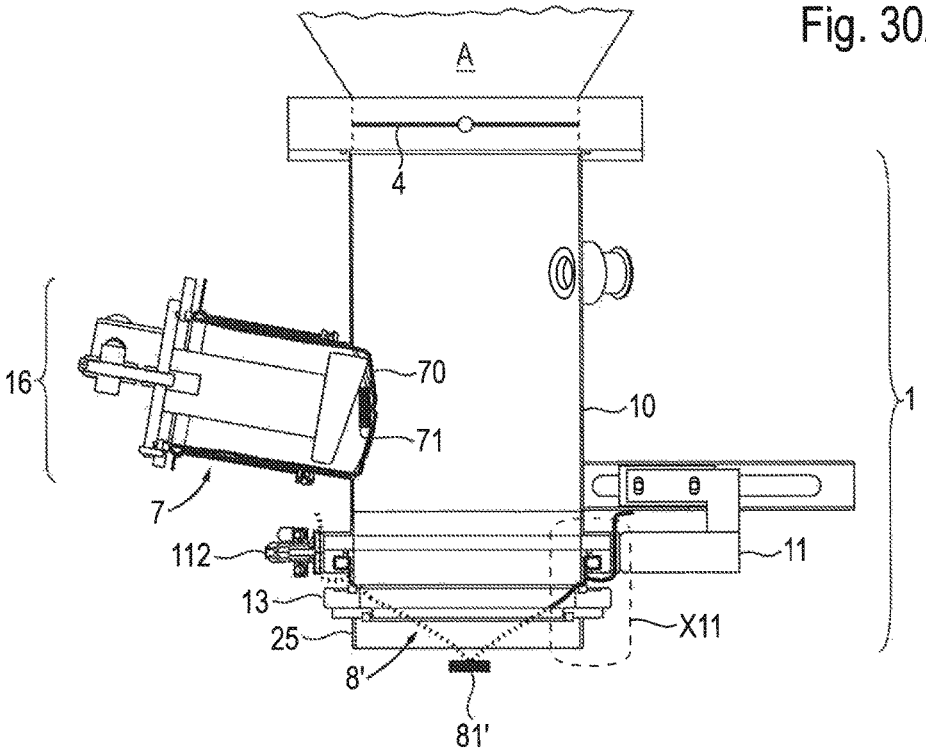
Figure 30B:
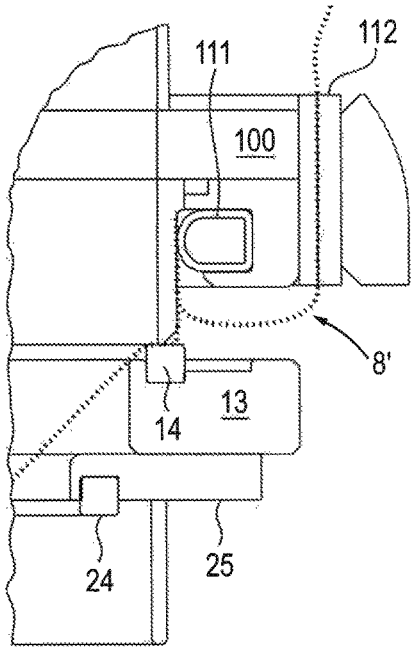
Figure 31B:
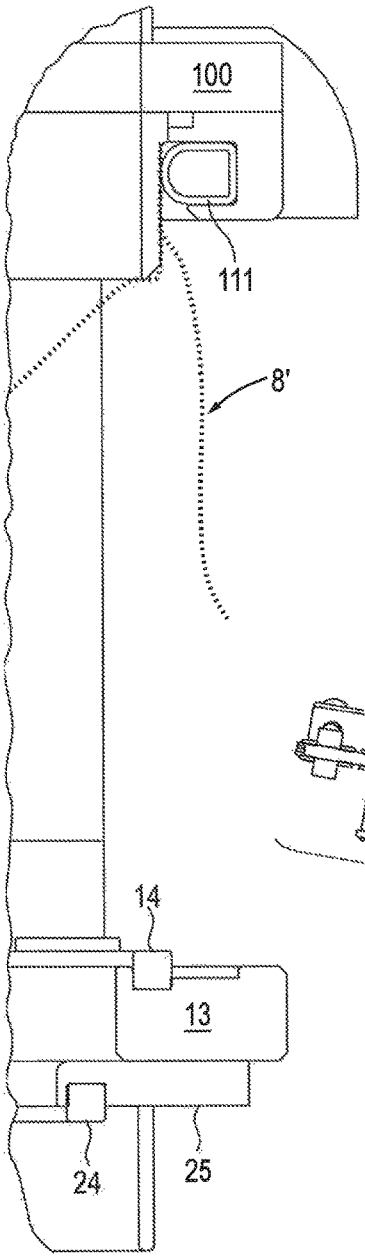
Figure 31A:
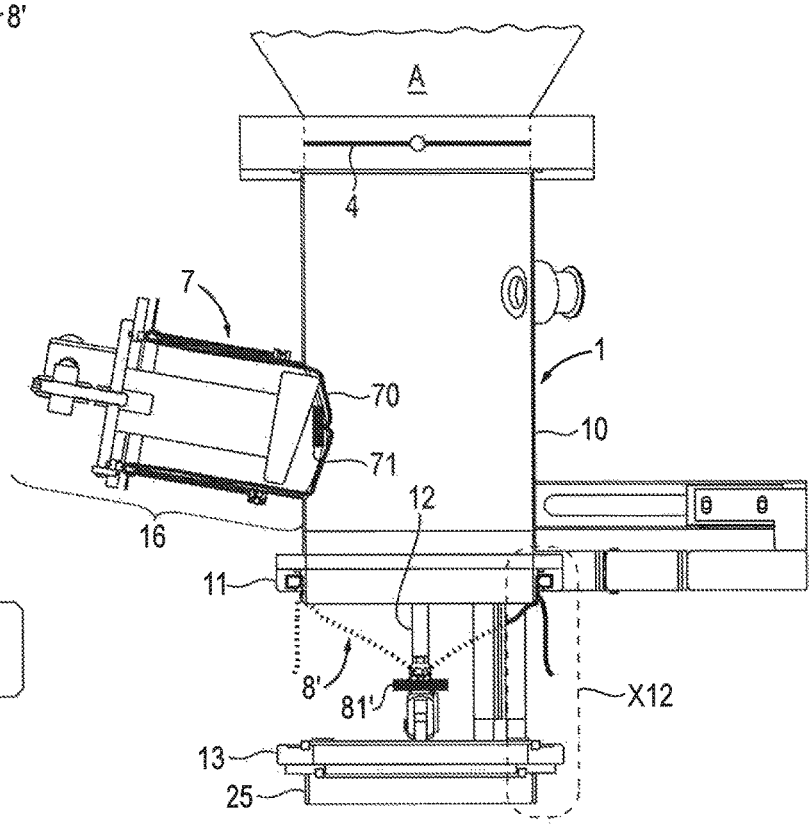
Figure 32B:
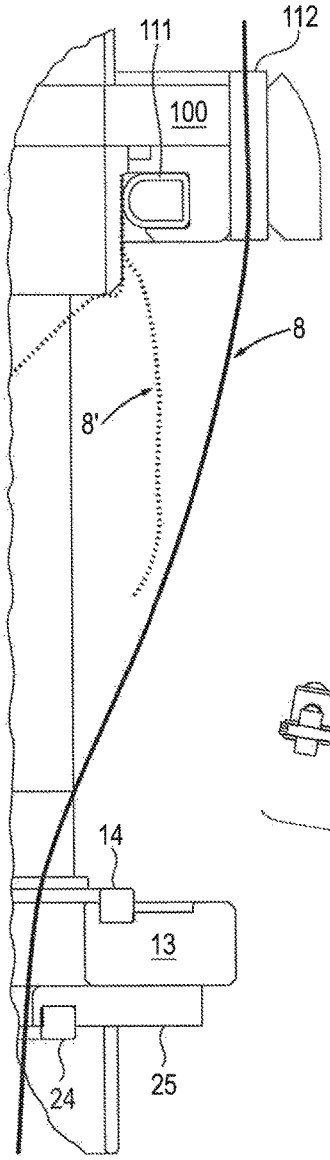
Figure 32A:
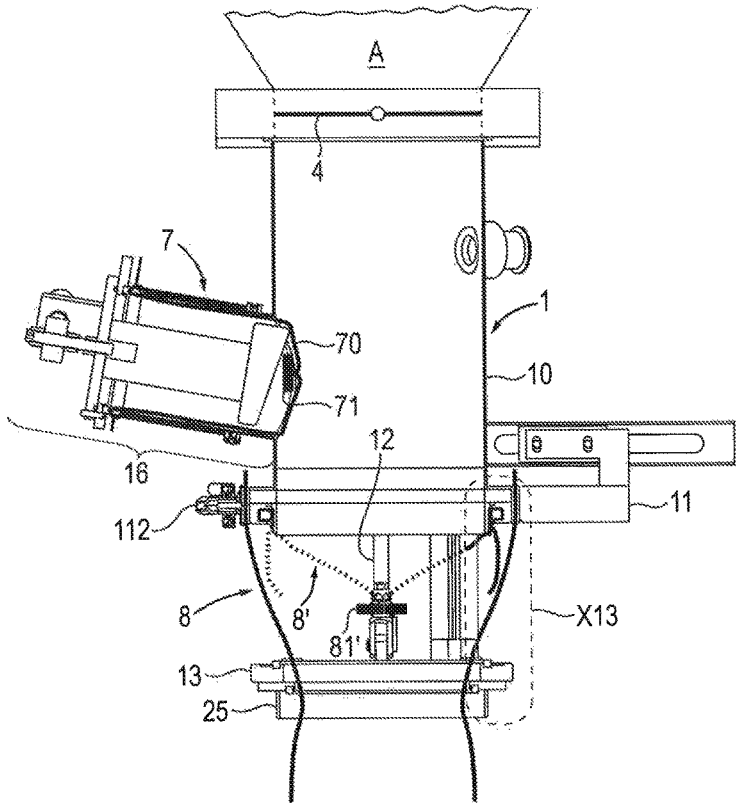
Figure 33B:
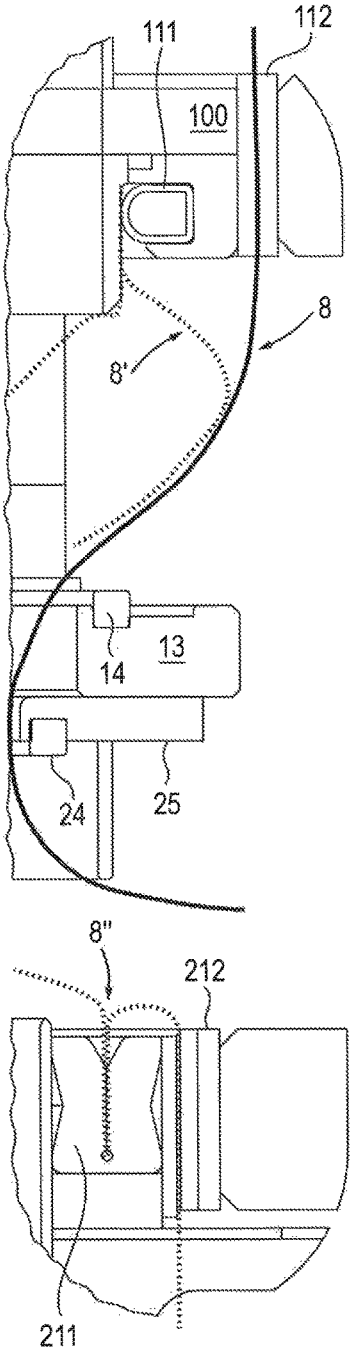
Figure 33A:
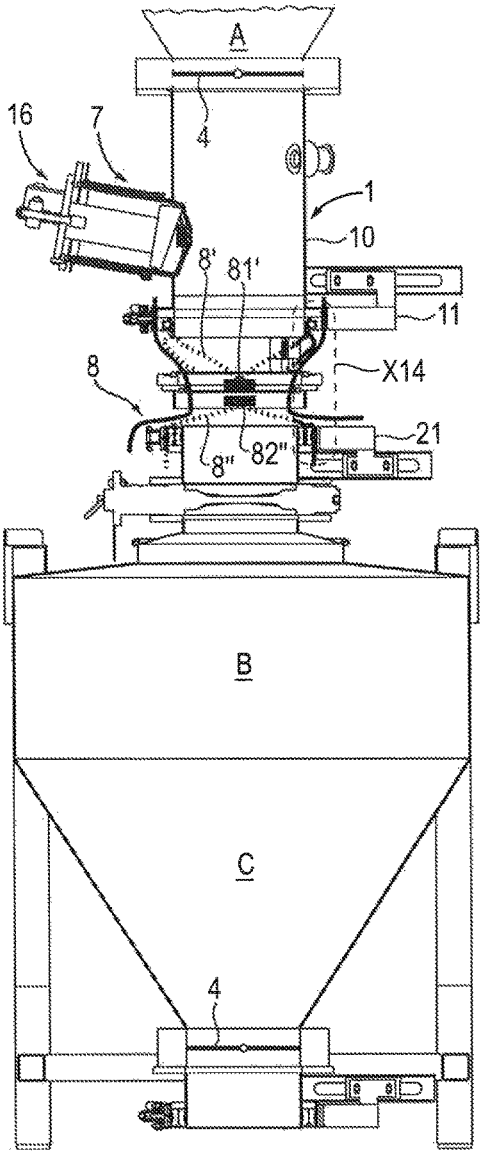
Figure 34B:
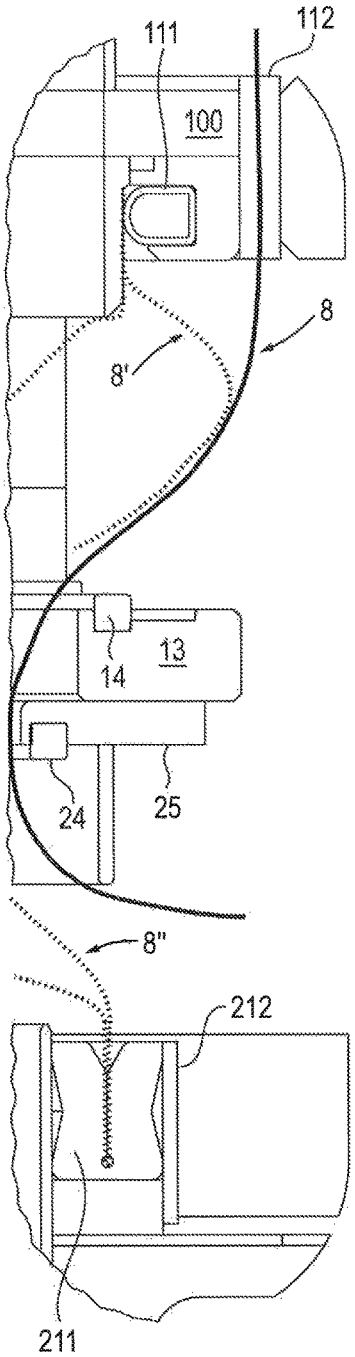
Figure 34A:
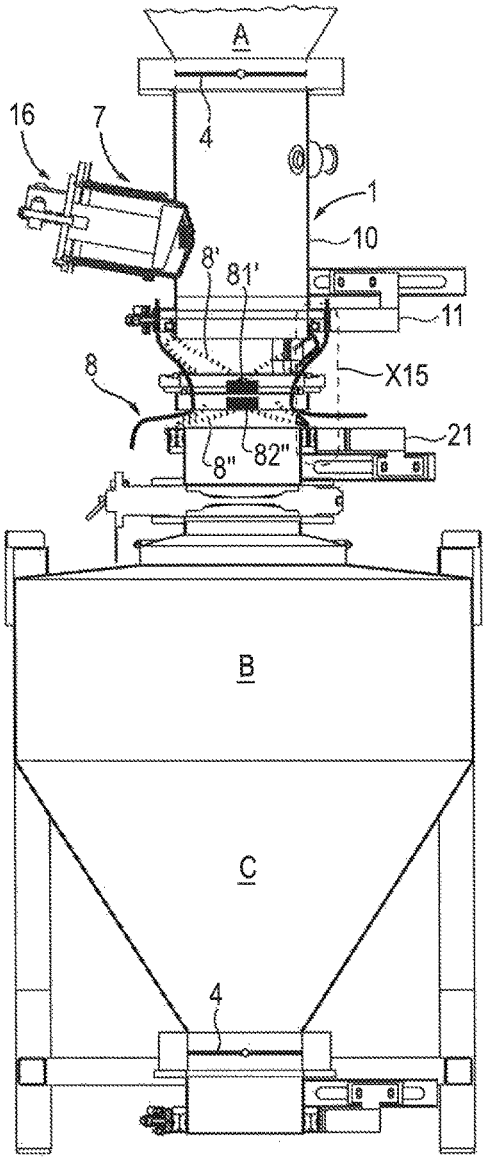
Figure 35B:
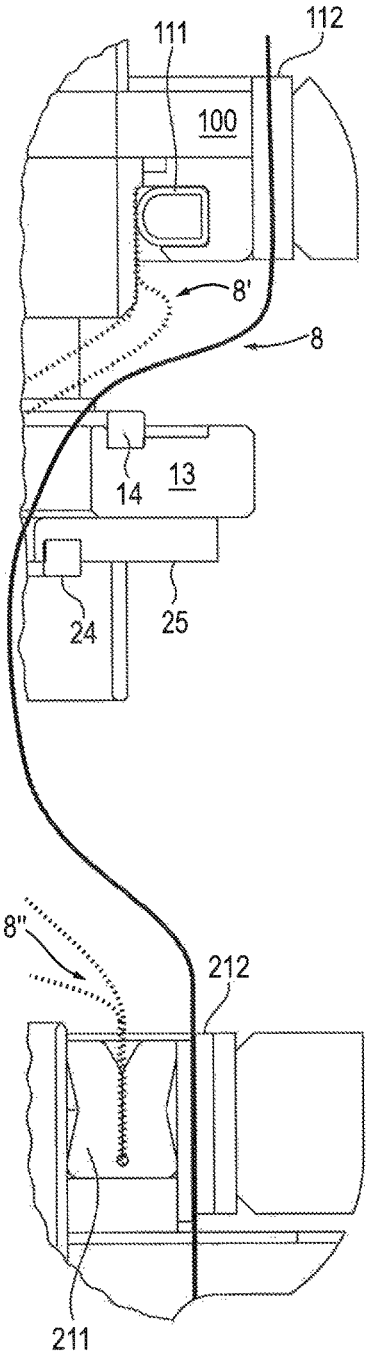
Figure 35A:
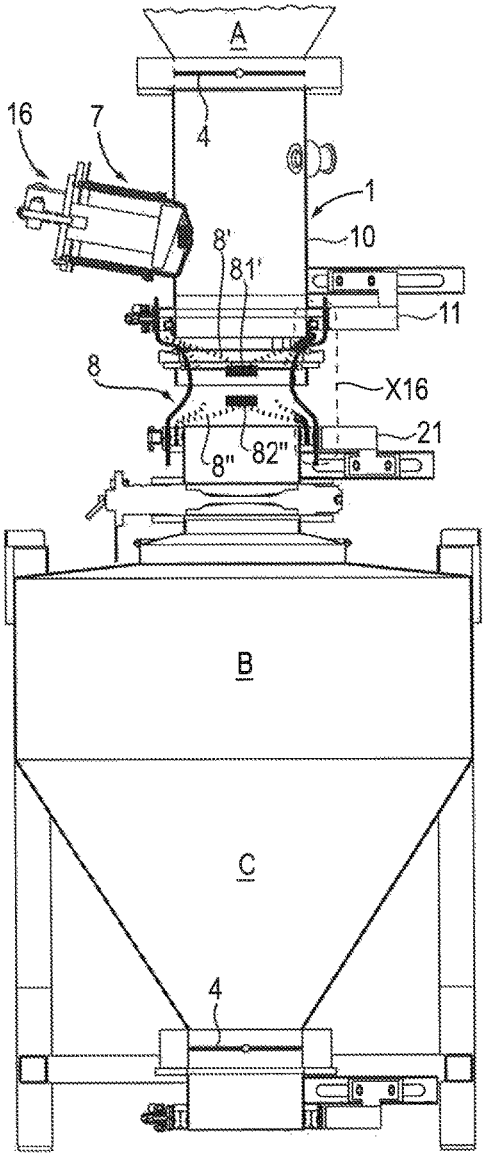
Figure 36B:
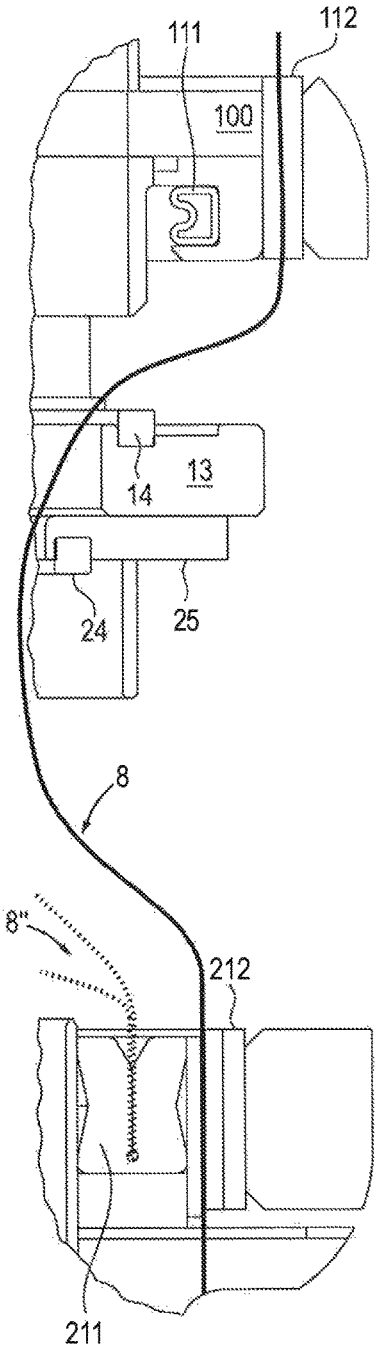
Figure 36A:
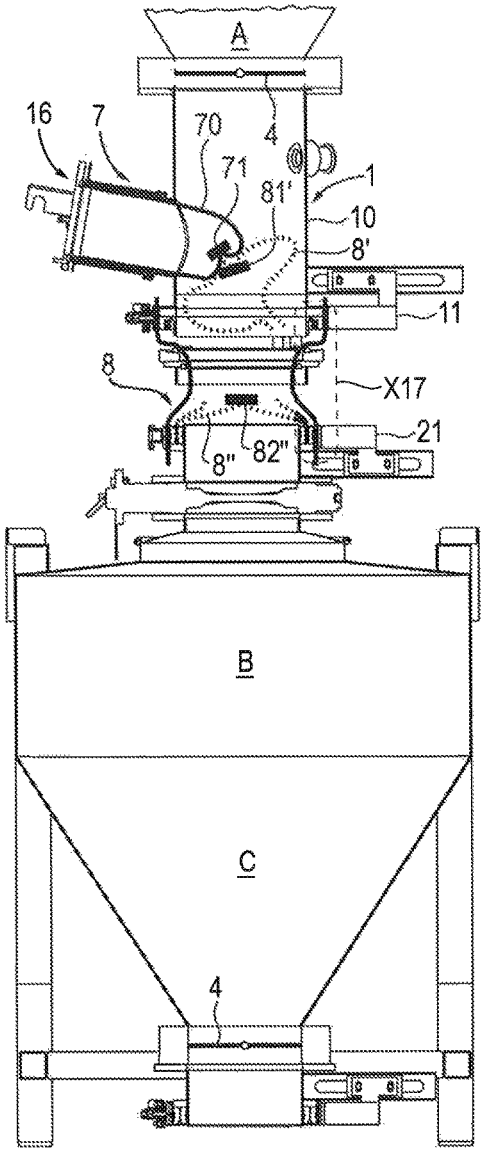
Figure 37B:
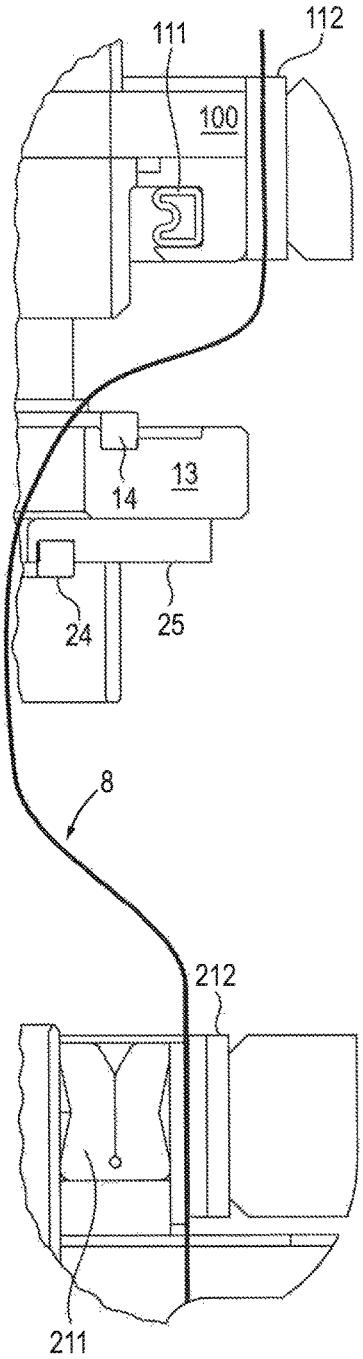
Figure 37A:
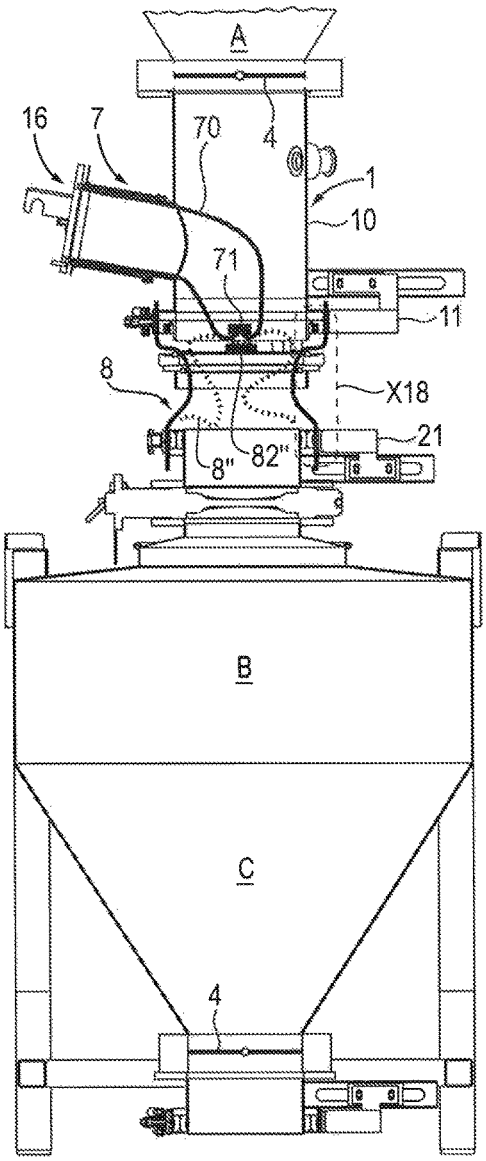
Figure 38B:
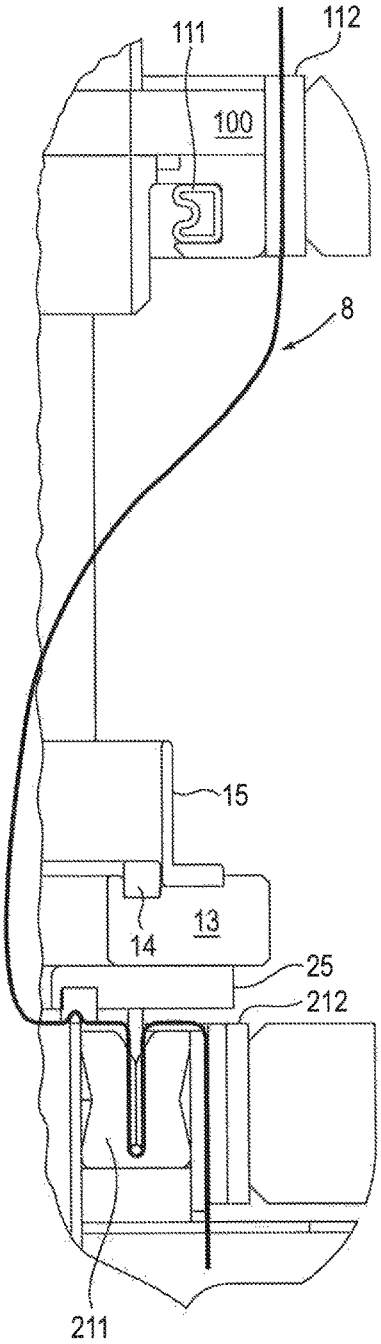
Figure 38A:
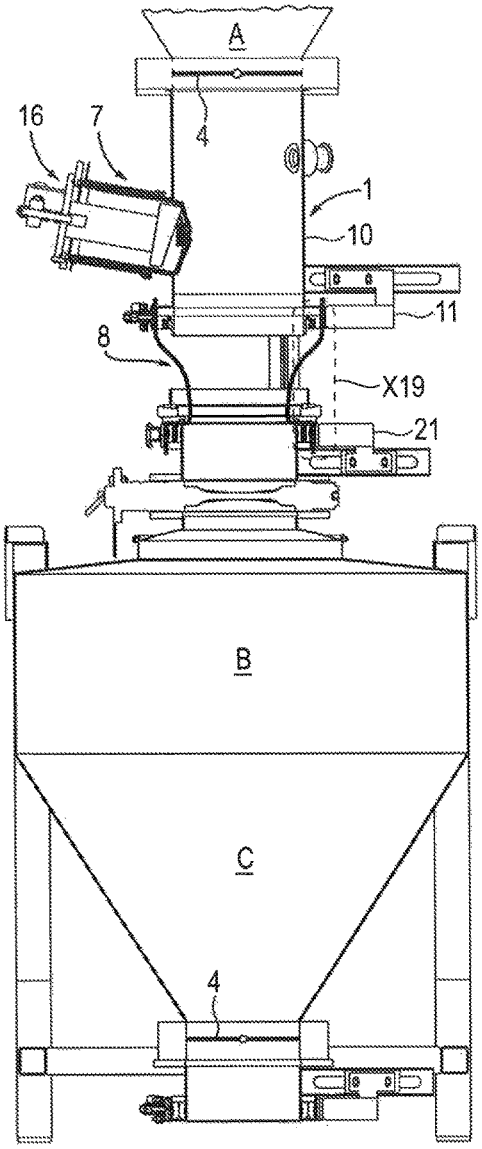
Figure 39B:
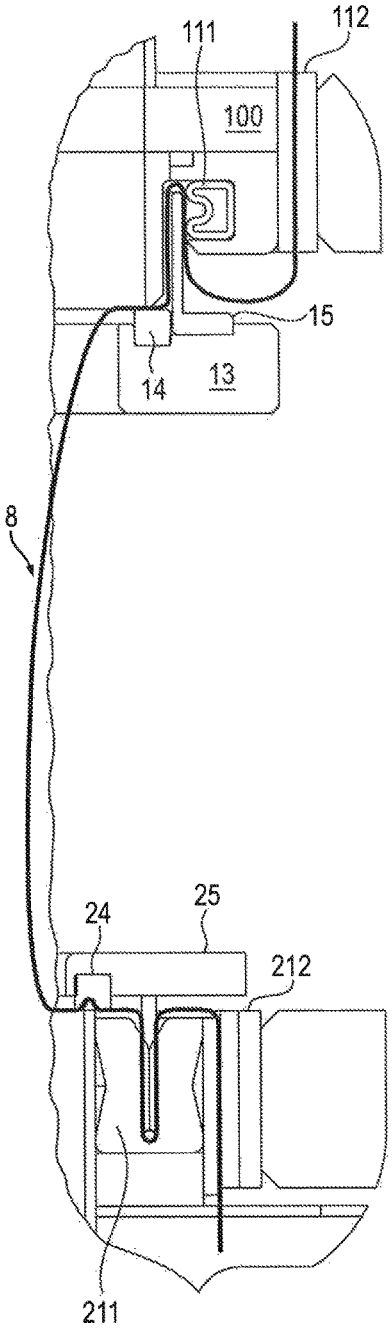
Figure 39A:
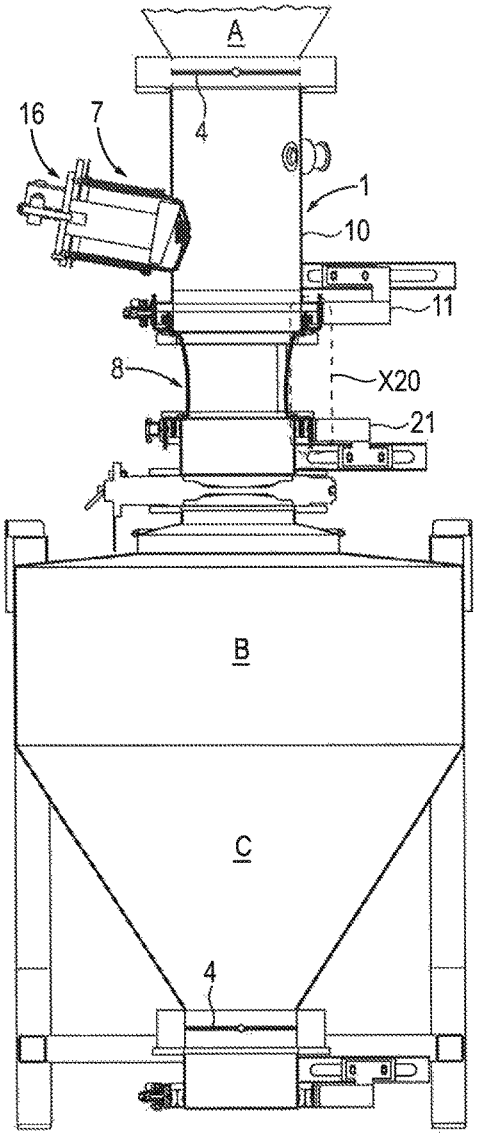
Figure 40B:
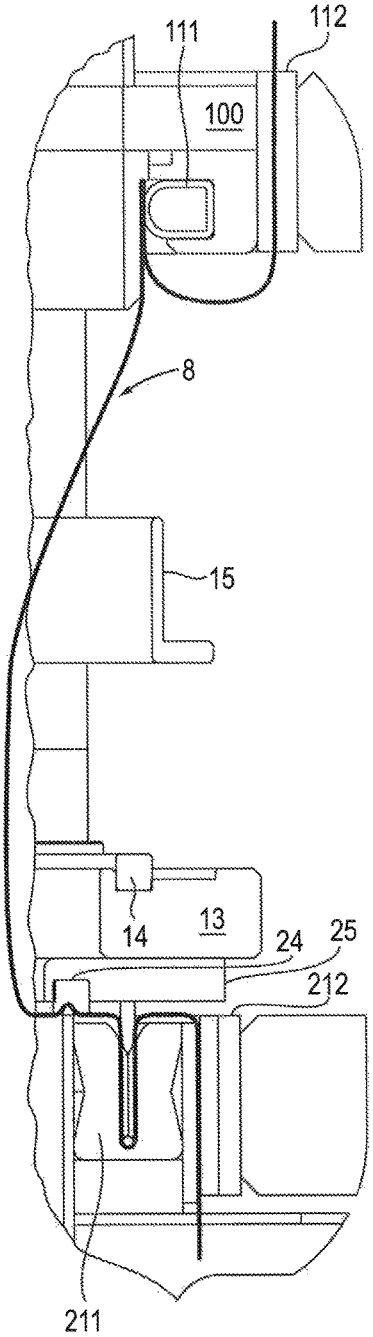
Figure 40A:
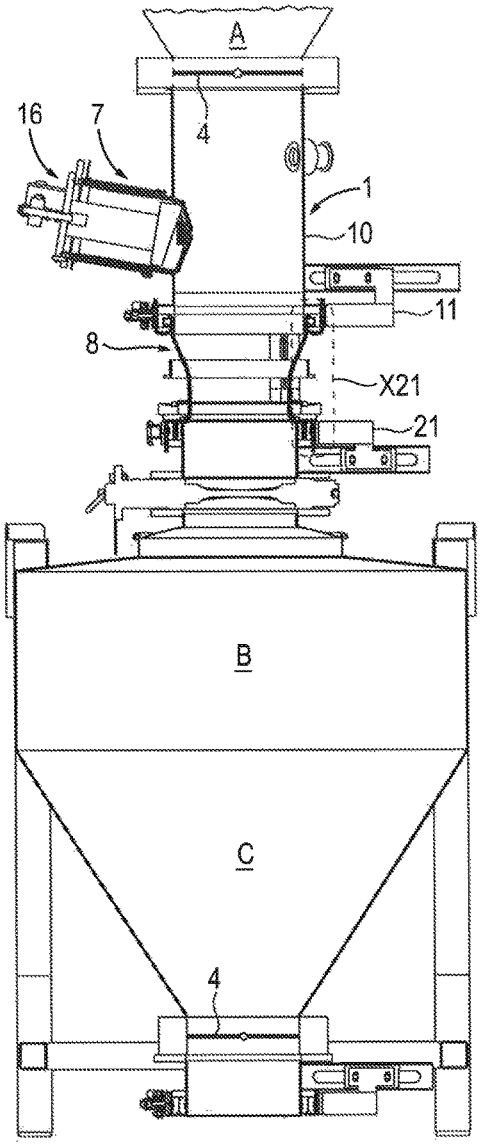
Figure 41B:
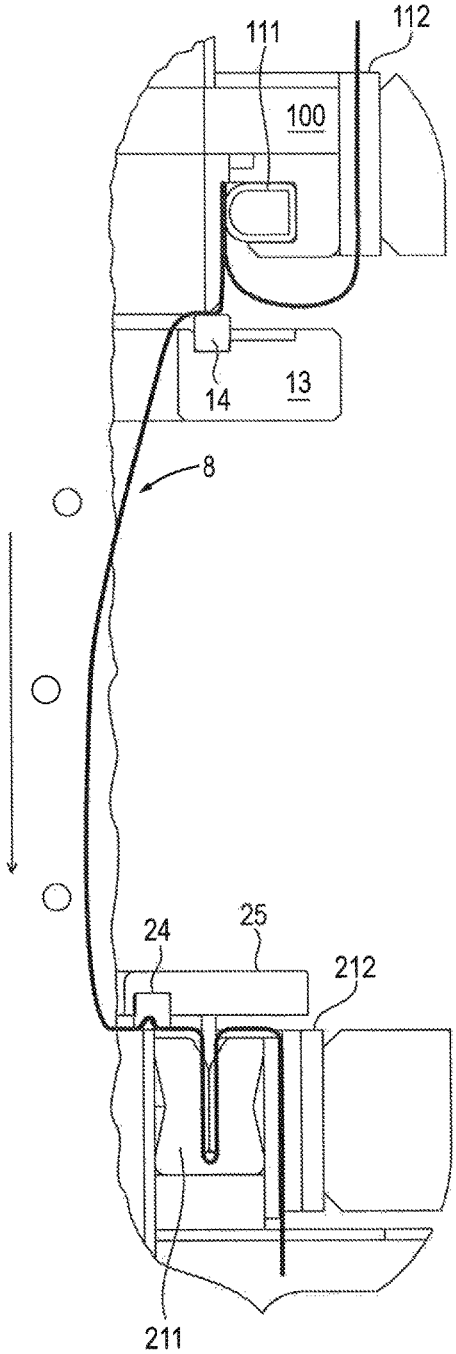
Figure 41A:
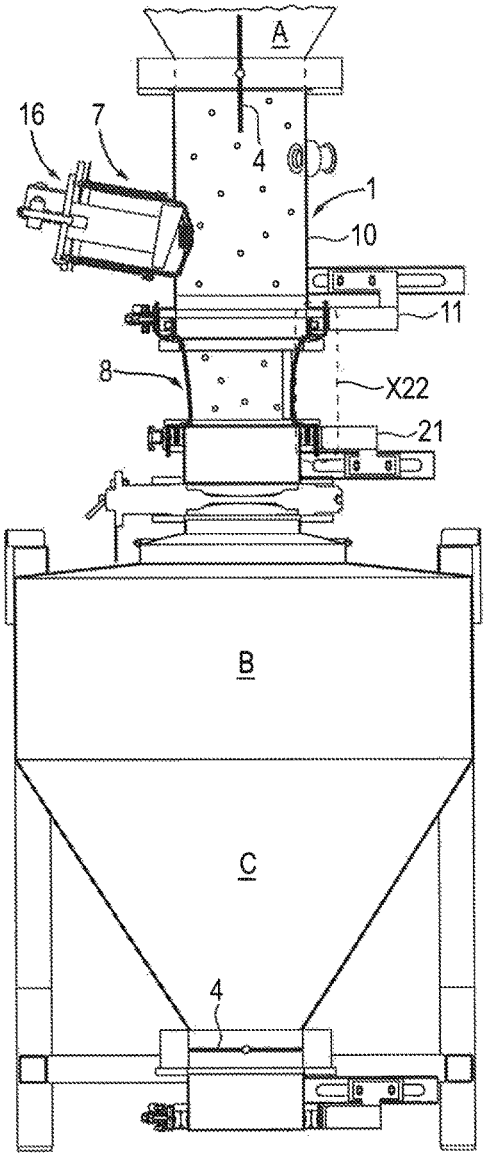
Figure 42B:
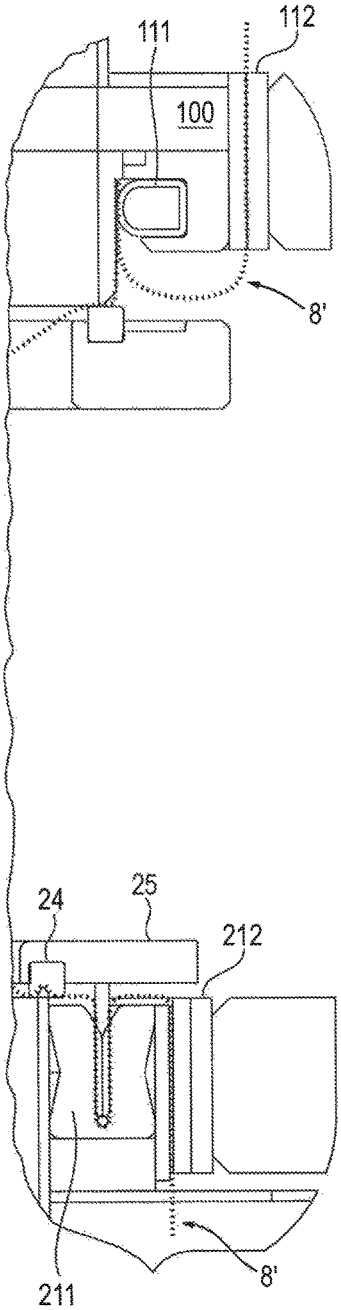
Figure 42A:
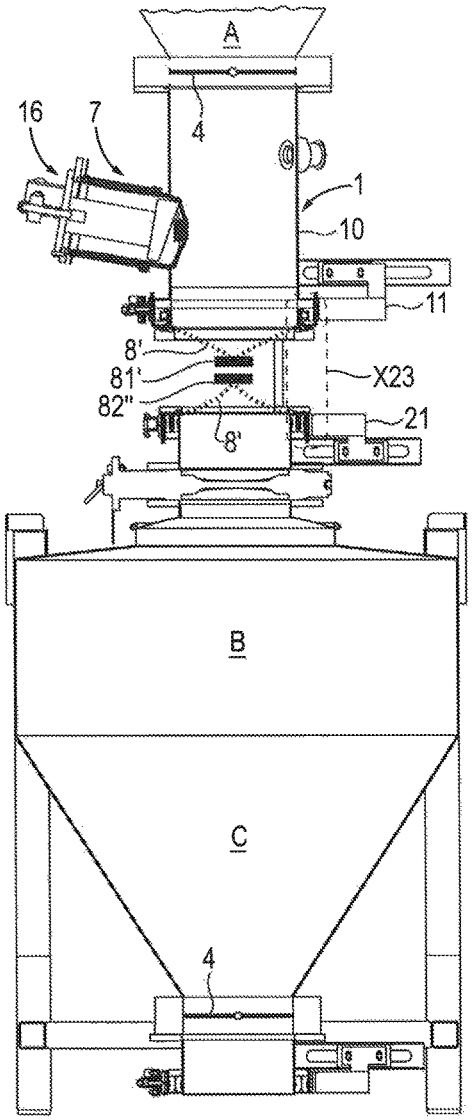

FIGS. 30A to 42B: show a third exemplary application of the apparatus according to the invention in conjunction with a transfer means for filling a second container in the form of a container containing process material in the form of flowable solid materials, with the key situations during a transfer operation, as schematic illustrations;

FIG. 30A—first situation: first liner remainder from a previous transfer operation closed by first crimp and fixed, in a sealed-off manner, at tensioning unit of the transfer means by means of active first tensioner, press ring with seal moved toward guide tube, end of the liner remainder additionally fixed, in a sealed manner, at guide tube by means of closed second tensioner;

FIG. 30B—the enlarged detail X11 from FIG. 30A;

FIG. 31A—second situation: second tensioner opened and free end of the first liner remainder directed downwardly, press ring with seal and second folding element moved down from guide tube;

FIG. 31B—the enlarged detail X12 from FIG. 31A;

FIG. 32A—third situation: upper end of the new liner piece for next transfer operation guided through initially open second tensioner, drawn loosely over guide tube and second tensioner closed, lower end of the new liner piece guided downwardly through press ring and folding element;

FIG. 32B—the enlarged detail X13 from FIG. 32A;

FIG. 33A—fourth situation: press ring with seal and first folding element brought toward guide tube, second container to be filled positioned below the transfer means, with second liner remainder from the previous transfer operation fixed, in a sealed-off manner, in the first and second tensioner of the second tensioning unit;

FIG. 33B—the enlarged detail X14 from FIG. 33A;

FIG. 34A—fifth situation: second tensioner of the second tensioning unit opened, lower end of the second liner remainder guided upwardly;

FIG. 34B—the enlarged detail X15 from FIG. 34A;

FIG. 35A—sixth situation: lower end of the new liner piece guided through initially open second tensioner of the second tensioning unit, second tensioner closed;

FIG. 35B—the enlarged detail X16 from FIG. 35A;

FIG. 36A—seventh situation: discharge of the first liner remainder with deactivated first tensioner at first tensioning unit;

FIG. 36B—the enlarged detail X17 from FIG. 36A;

FIG. 37A—eighth situation: discharge of the second liner remainder from first tensioner of the second tensioning unit;

FIG. 37B—the enlarged detail X18 from FIG. 37A;

FIG. 38A—ninth situation: pressing of the lower end of the new liner piece into first tensioner of the second tensioning unit by means of second folding element and press ring moved down; insertion of the first folding element above the press ring;

FIG. 38B—the enlarged detail X19 from FIG. 38A;

FIG. 39A—tenth situation: pressing of the upper end of the new liner piece into first tensioner of the first tensioning unit by means of first folding element on press ring moved up;

FIG. 39B—the enlarged detail X20 from FIG. 39A;

FIG. 40A—eleventh situation: press ring moved down, activation of the first tensioner at first tensioning unit, removal of the first folding element from first tensioner of the first tensioning unit;

FIG. 40B—the enlarged detail X21 from FIG. 40A;

FIG. 41A—twelfth situation: press ring with seal moved up toward guide tube, opening of isolation member in the first container to be emptied, process material from first container flows through guide tube into second container;

FIG. 41B—the enlarged detail X22 from FIG. 41A;

FIG. 42A—thirteenth situation: closing of isolation member in the first container, provision of a second crimp and, close thereto, a next first crimp on the new liner piece; severing of the liner piece between second and next first crimp; creation of first and second liner remainder; and FIG. 42B—the enlarged detail X23 from FIG. 42A.

Figure 43A:
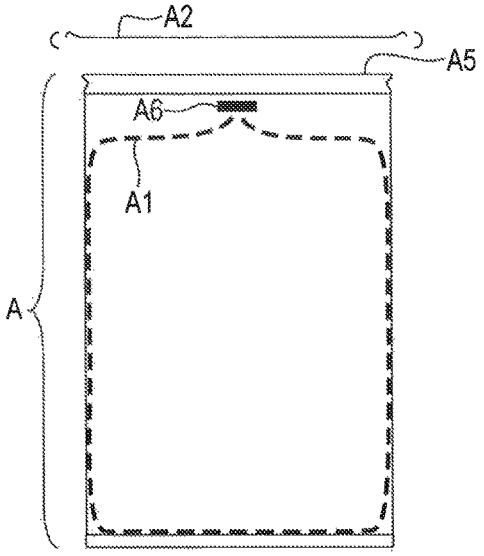
Figure 43B:
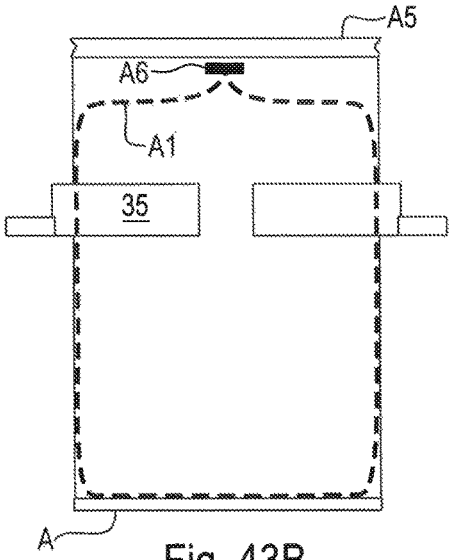
Figure 43C:
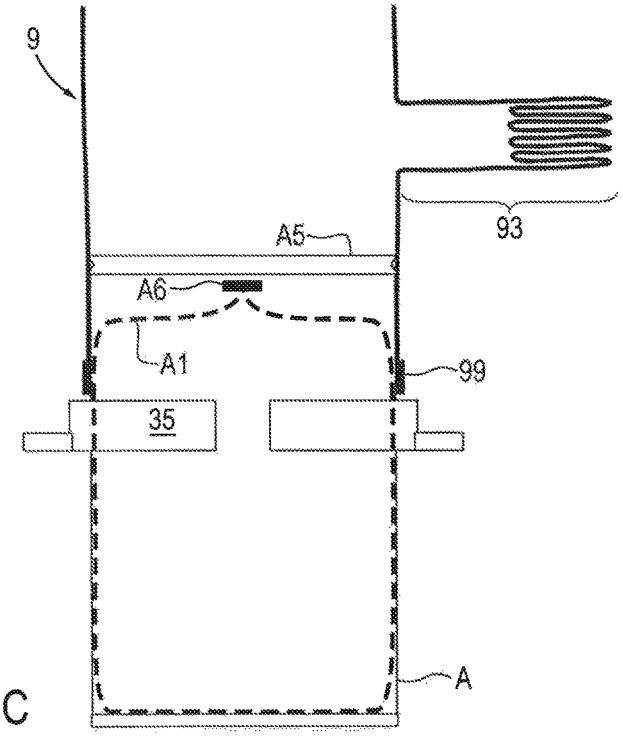
Figure 44:
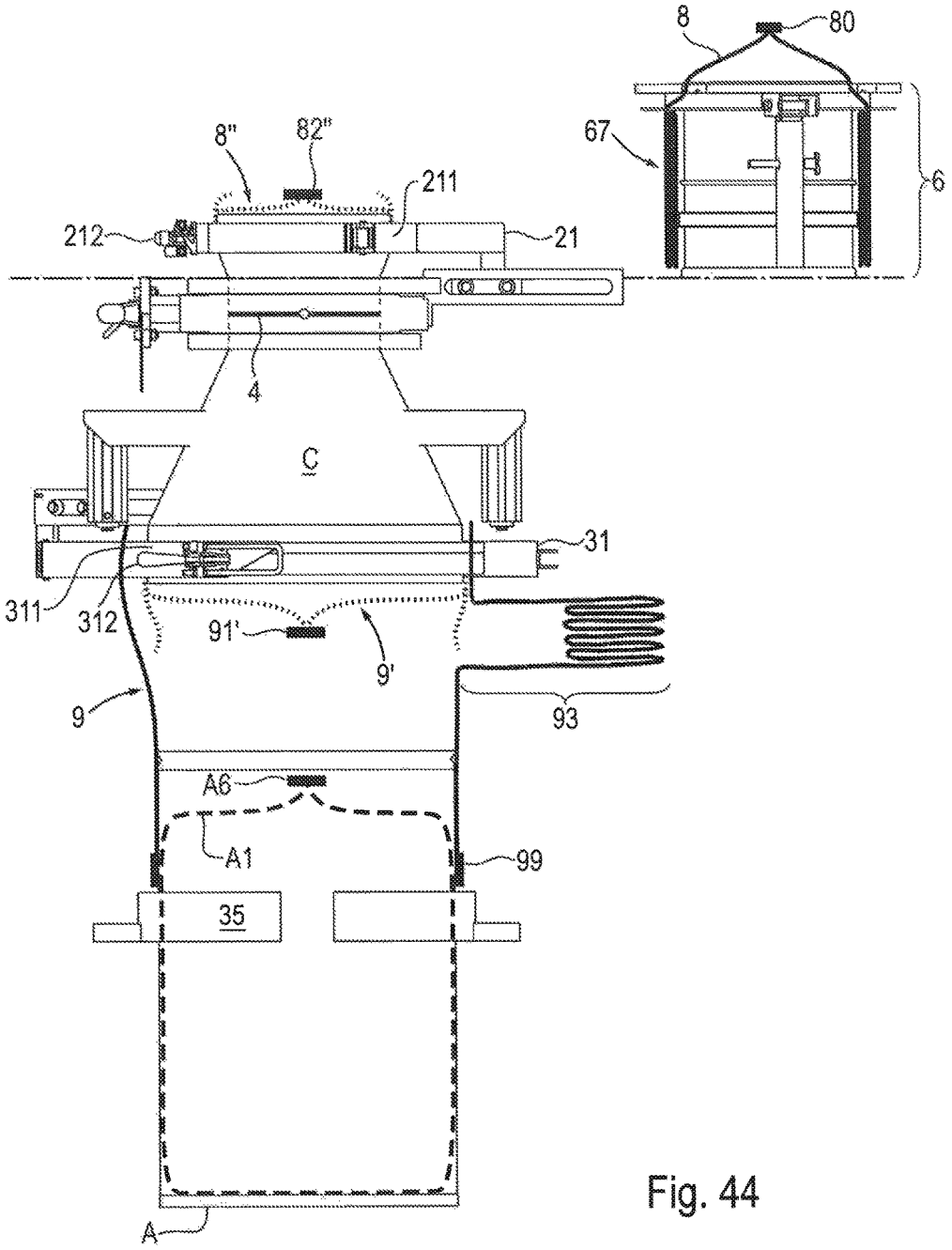
Figure 45:
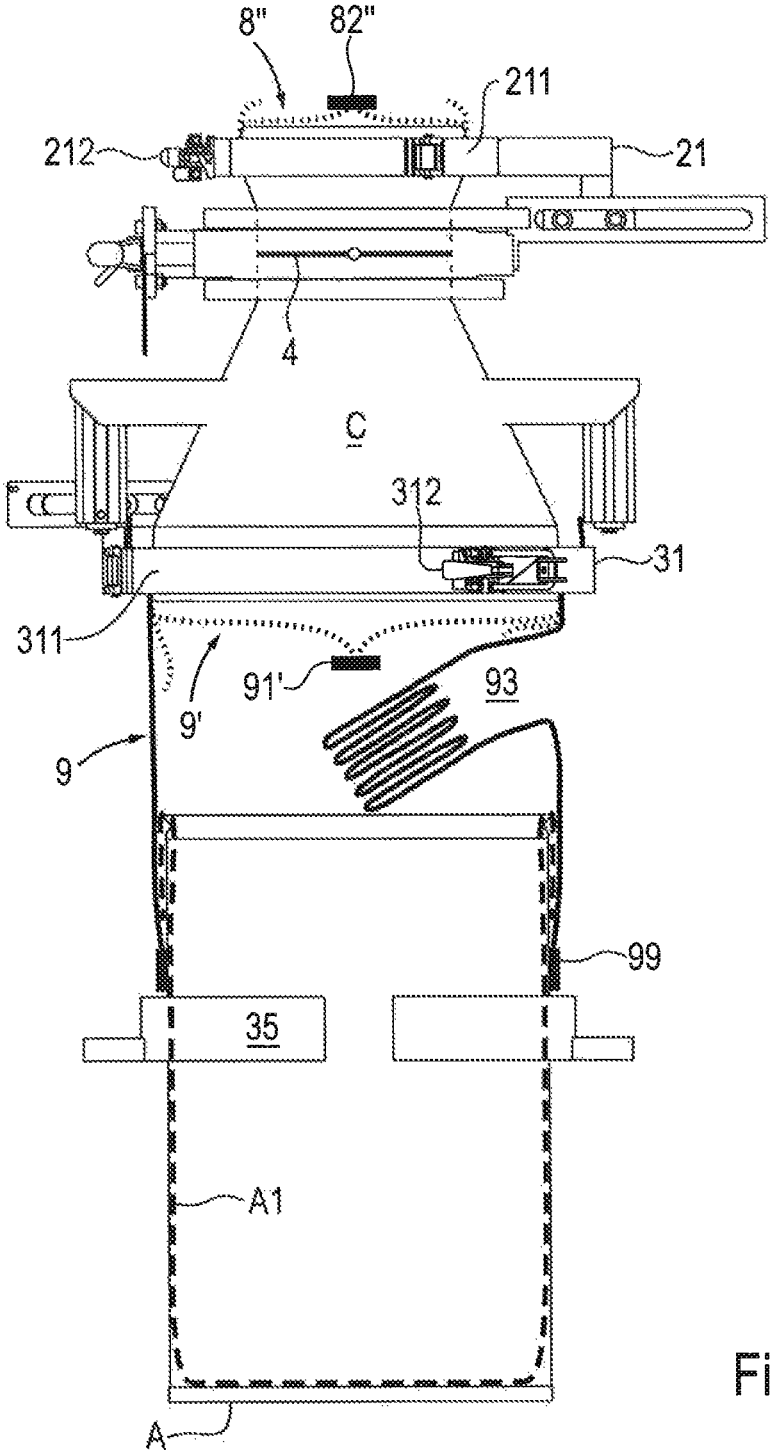
Figure 46A:
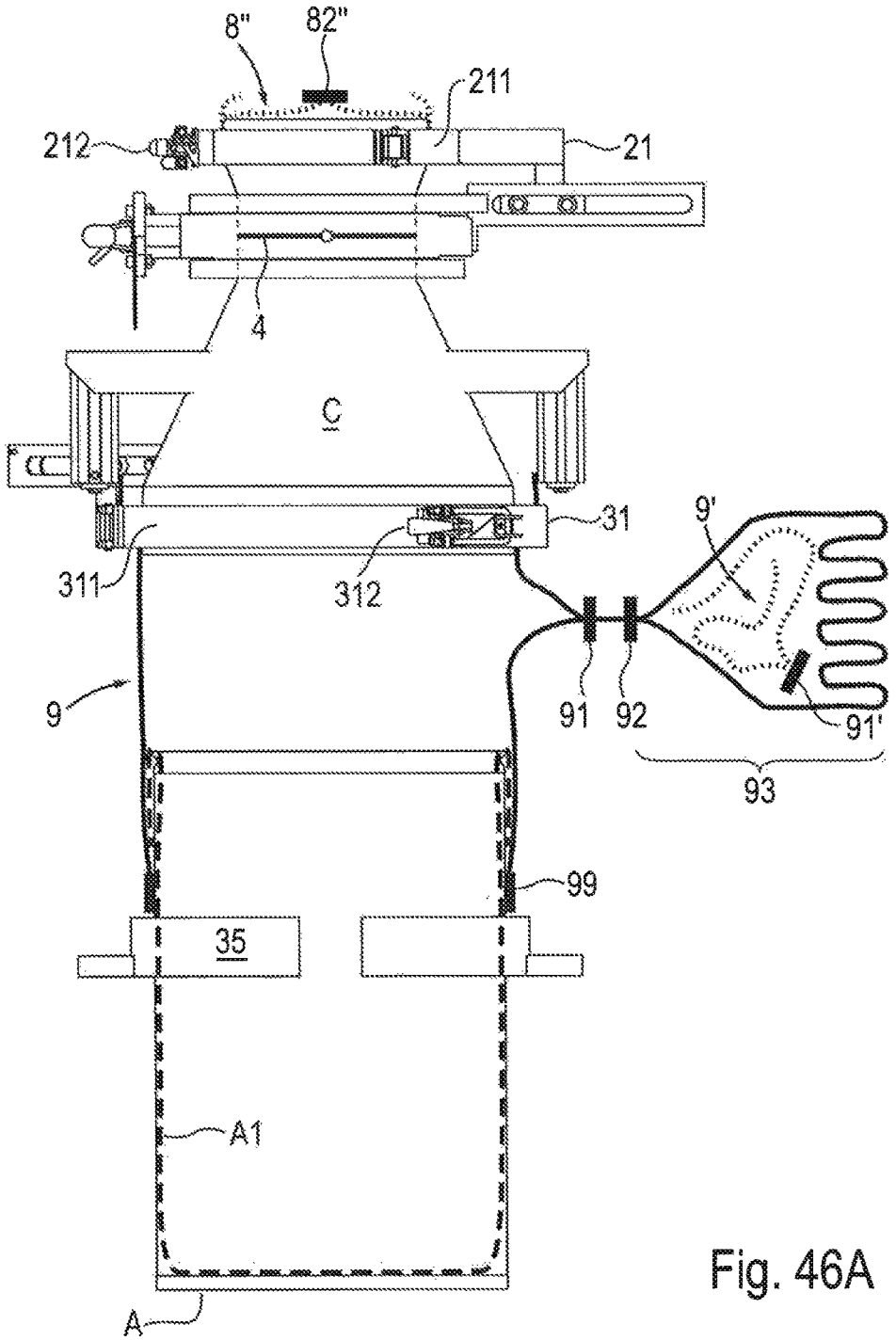
Figure 46B:
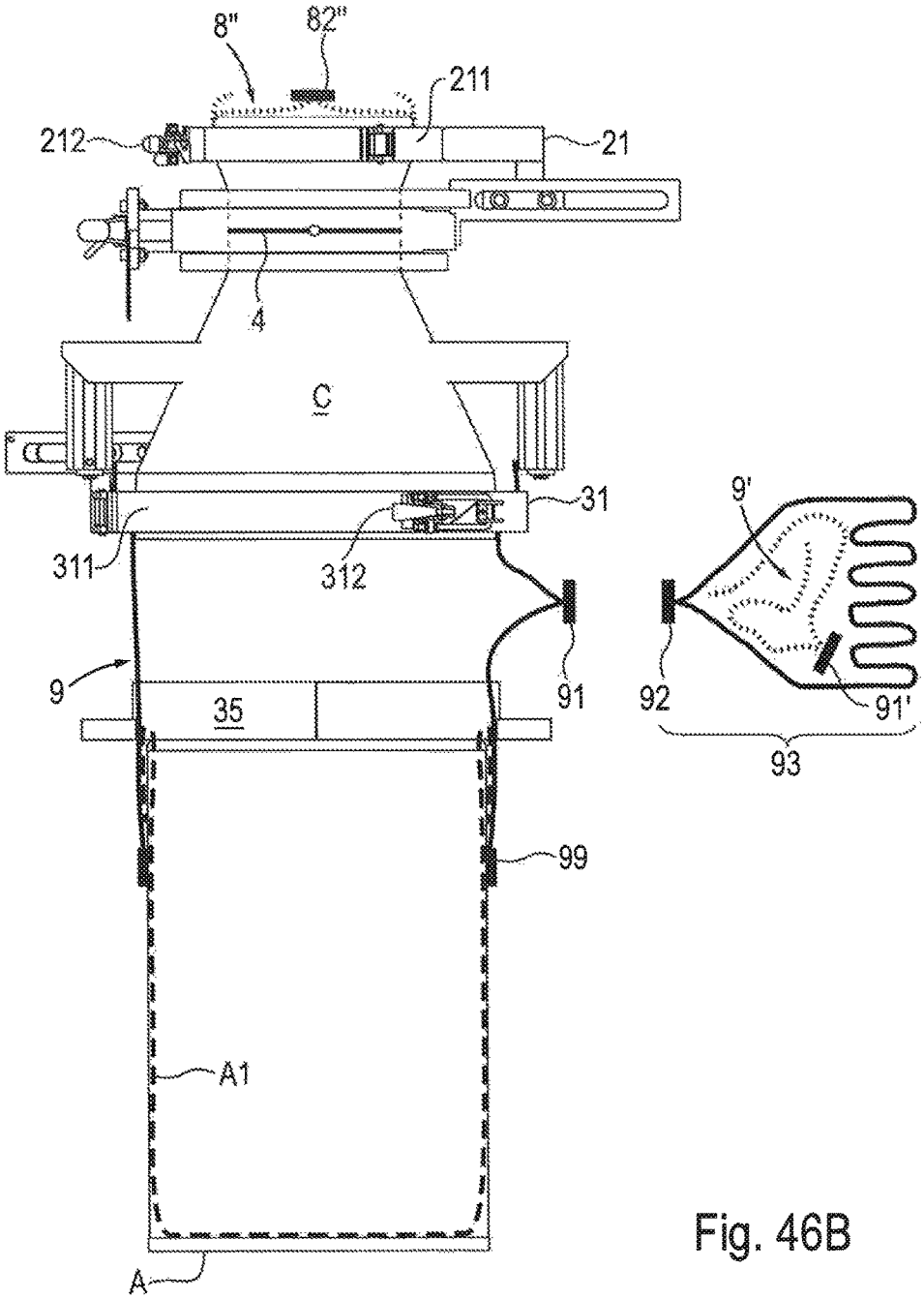
Figure 47A:
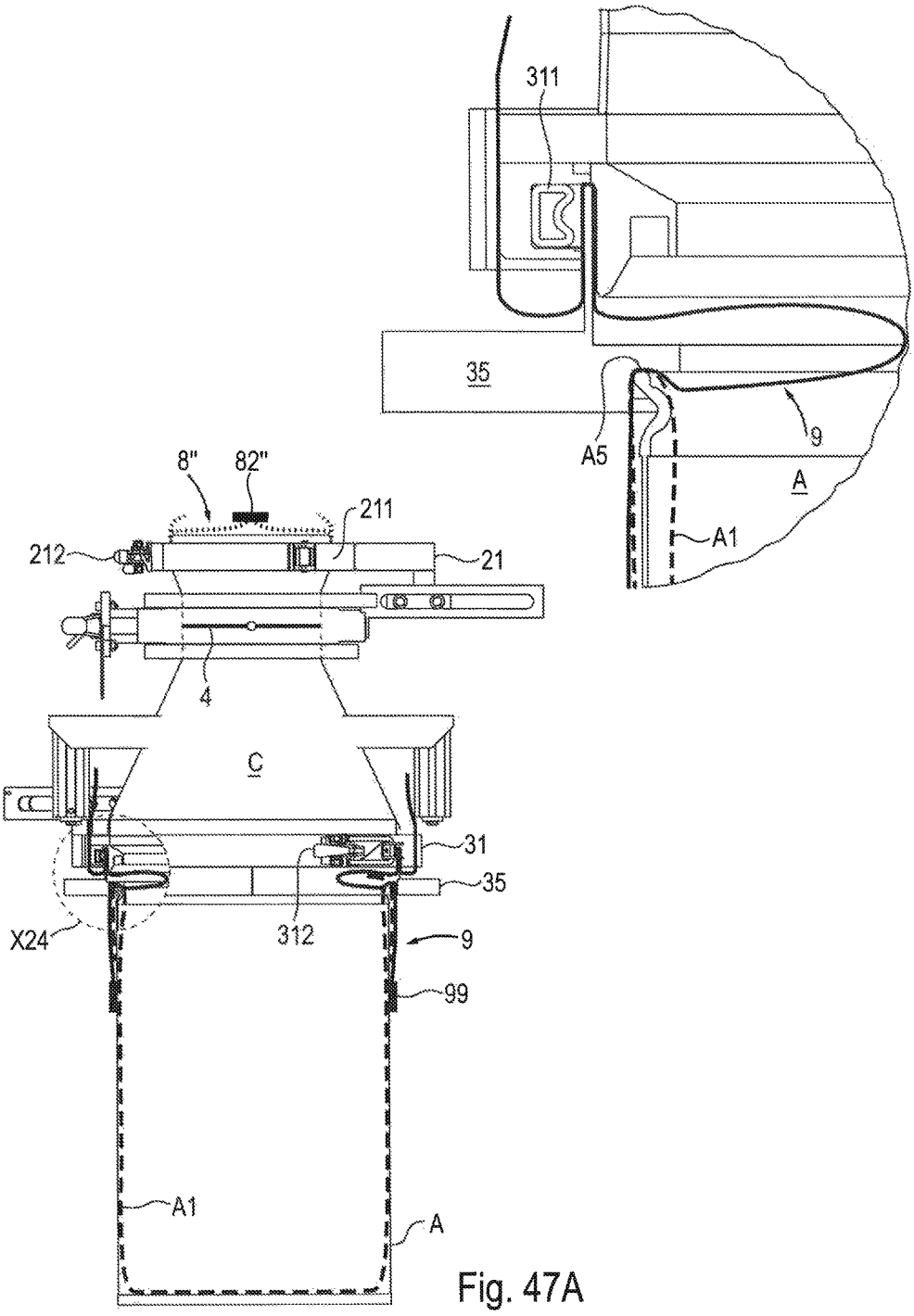
Figure 49A:
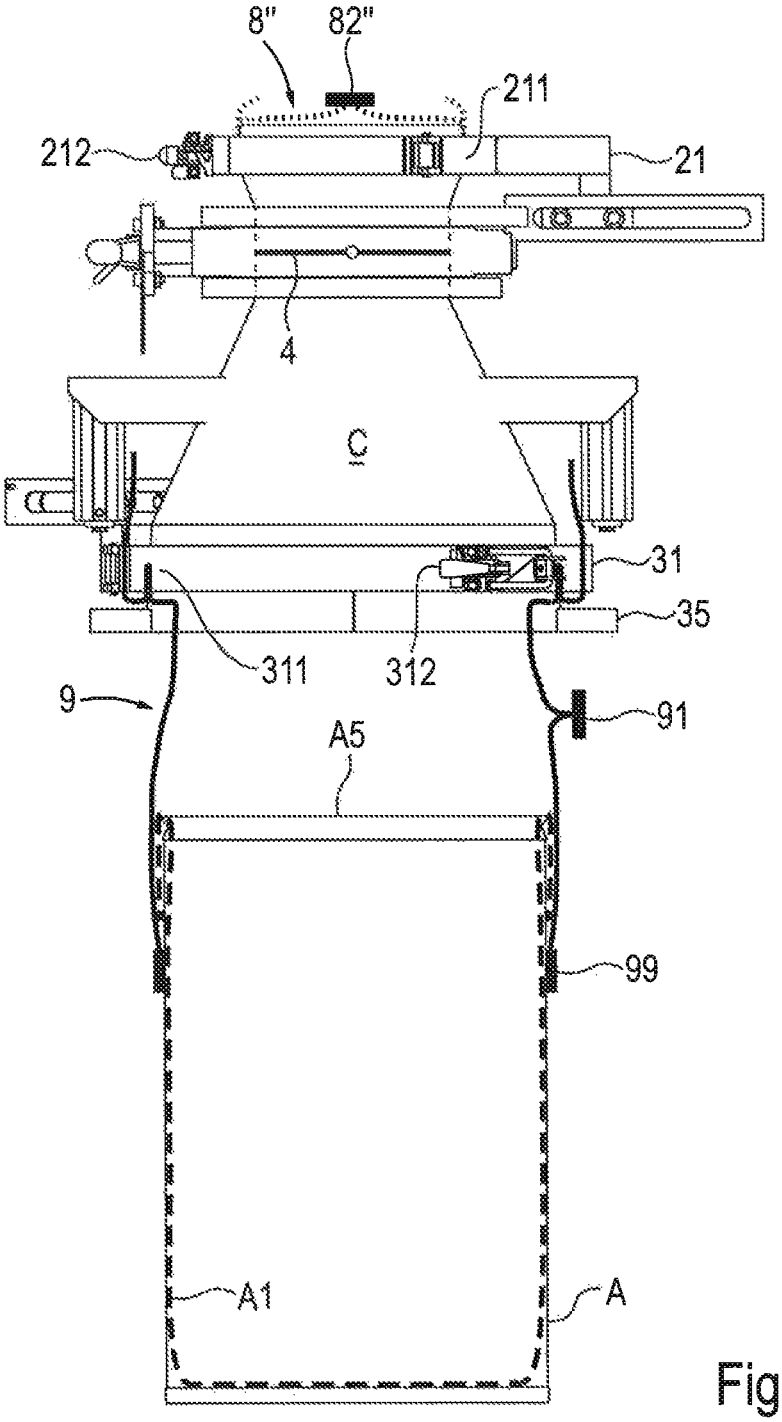
Figure 49B:
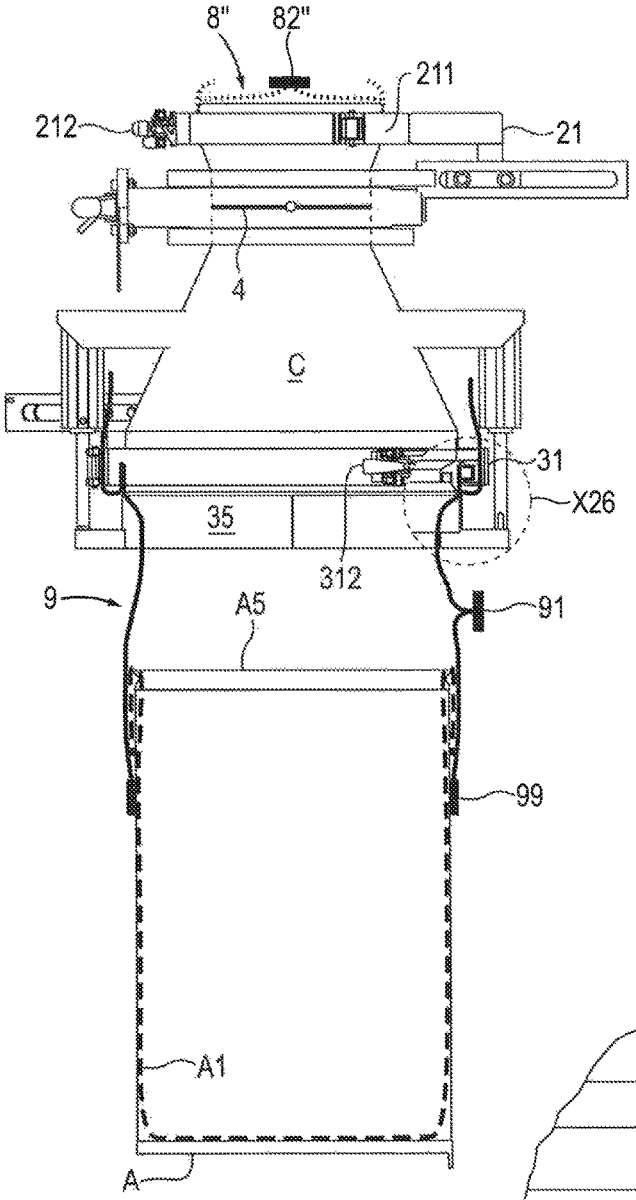
Figure 49C:
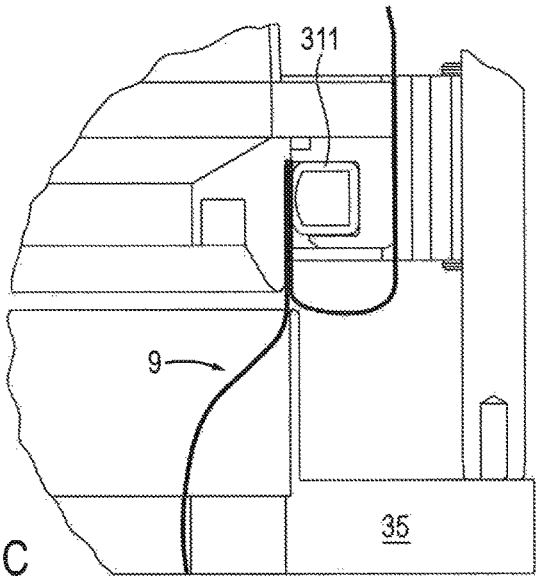
Figure 49D:
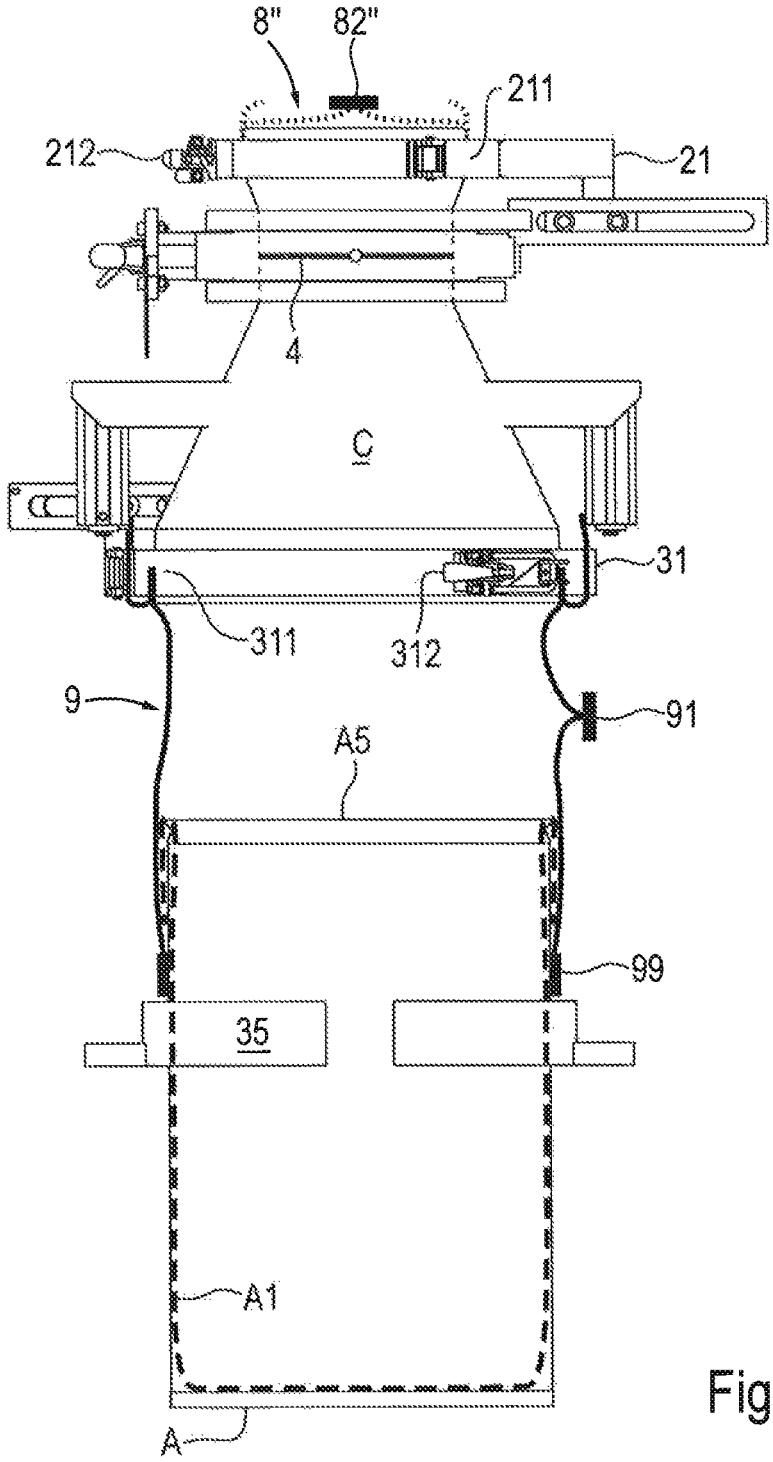
Figure 51A:
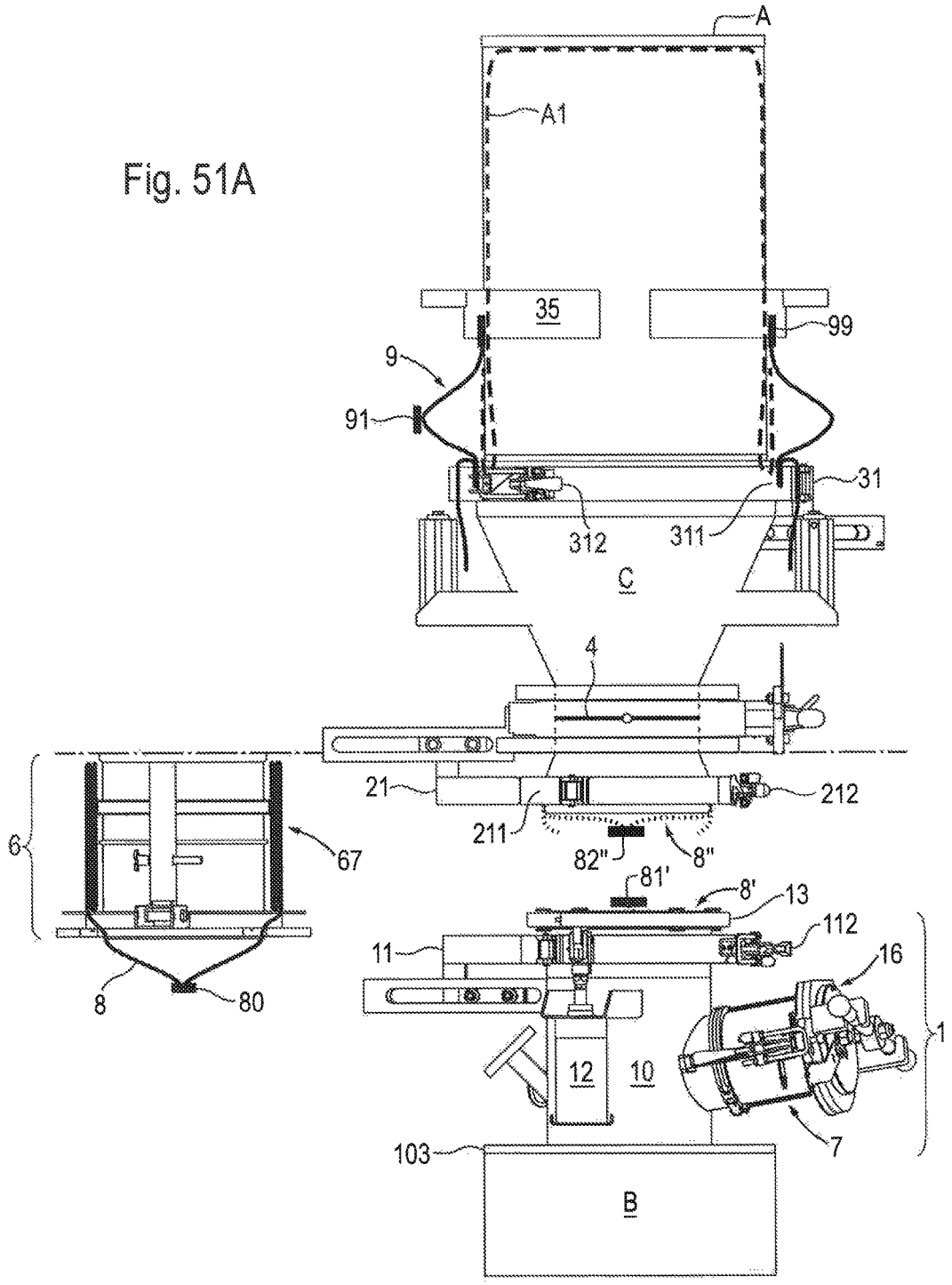
Figure 51B:
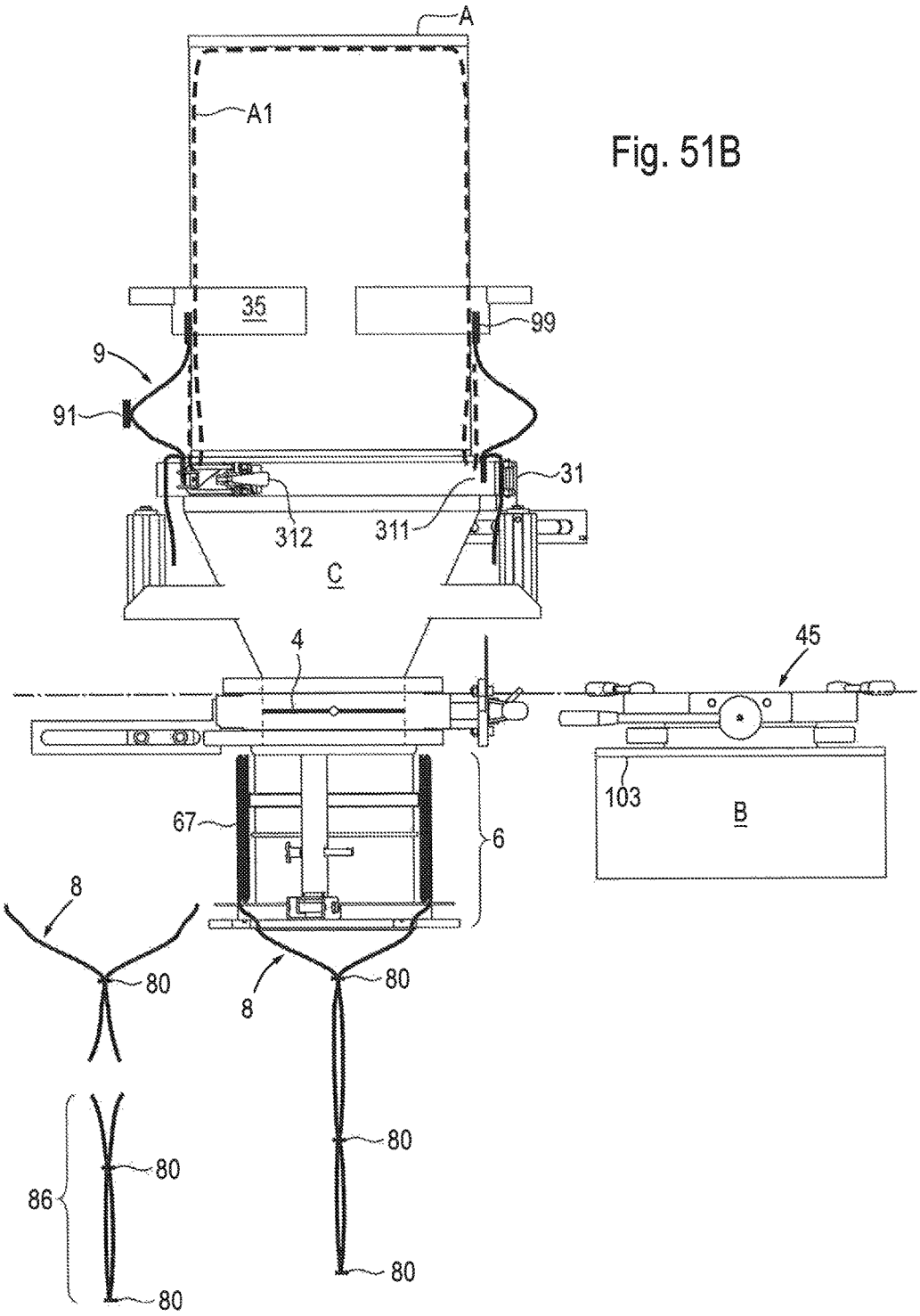
Figures 52A, 52B:
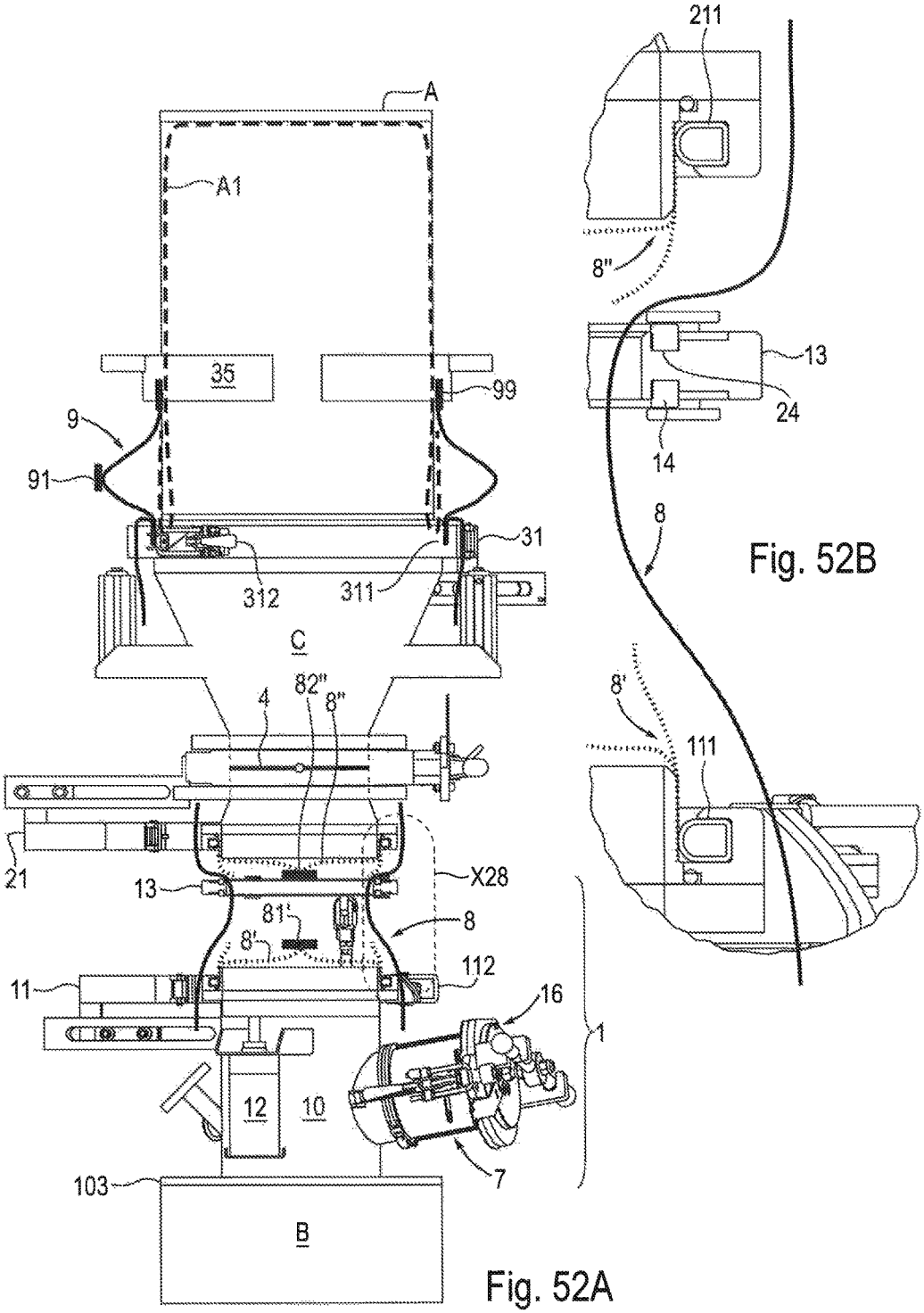
Figure 52C:
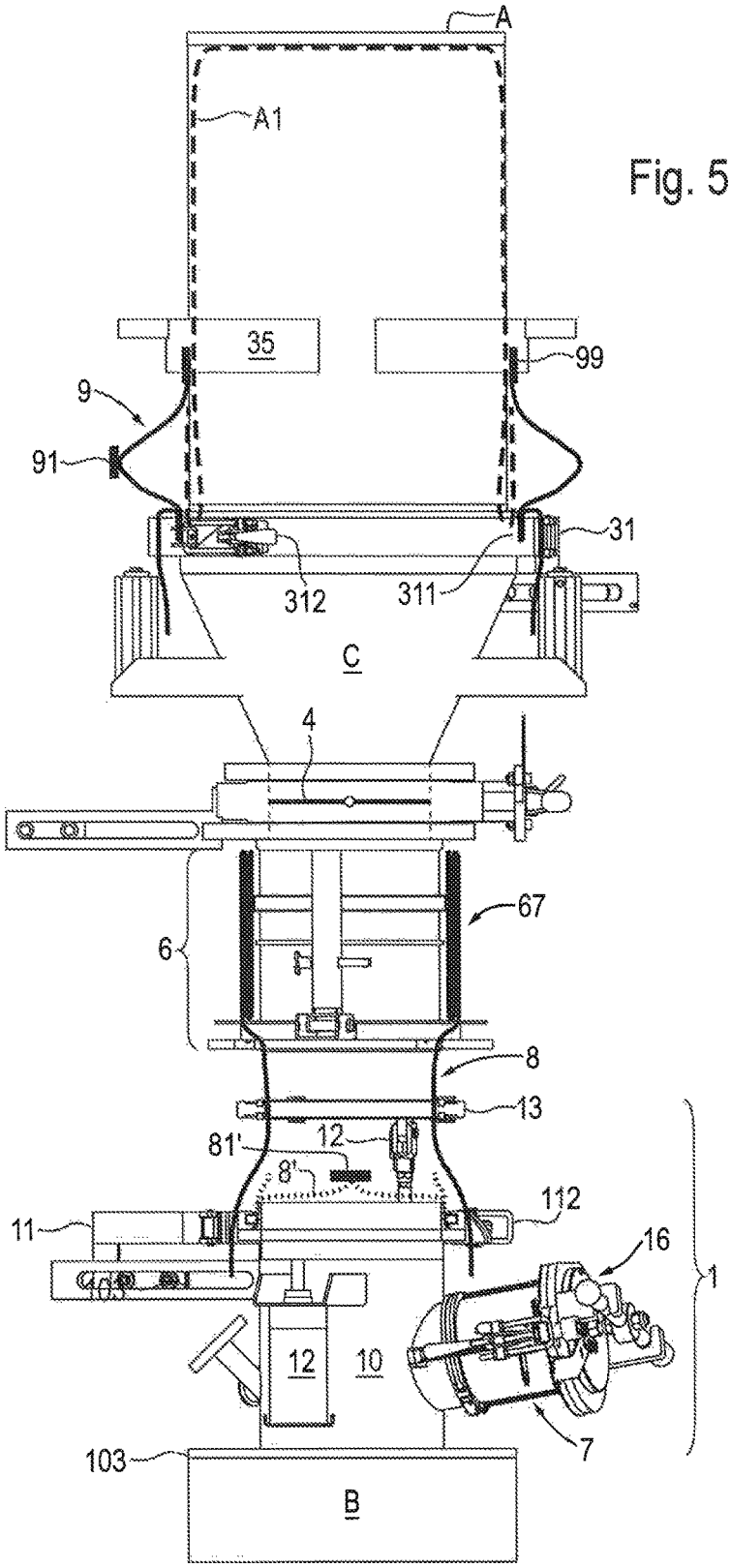
Figure 52D:
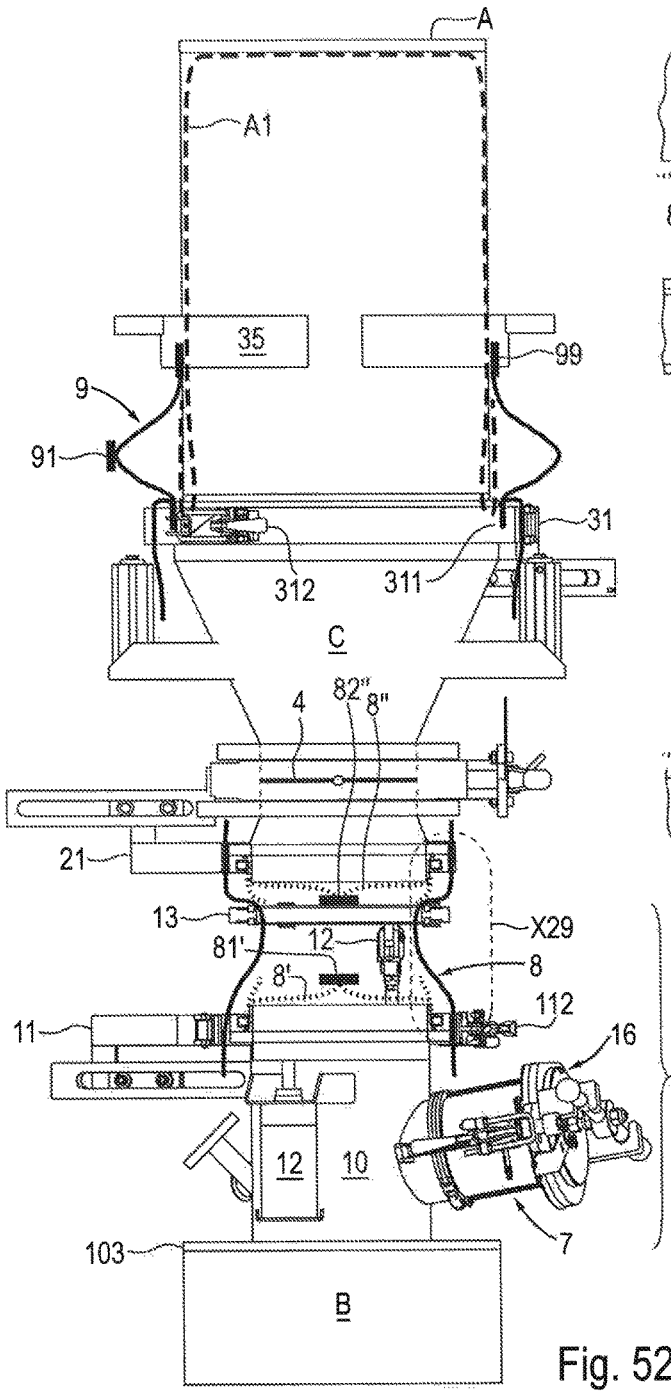
Figure 52E:
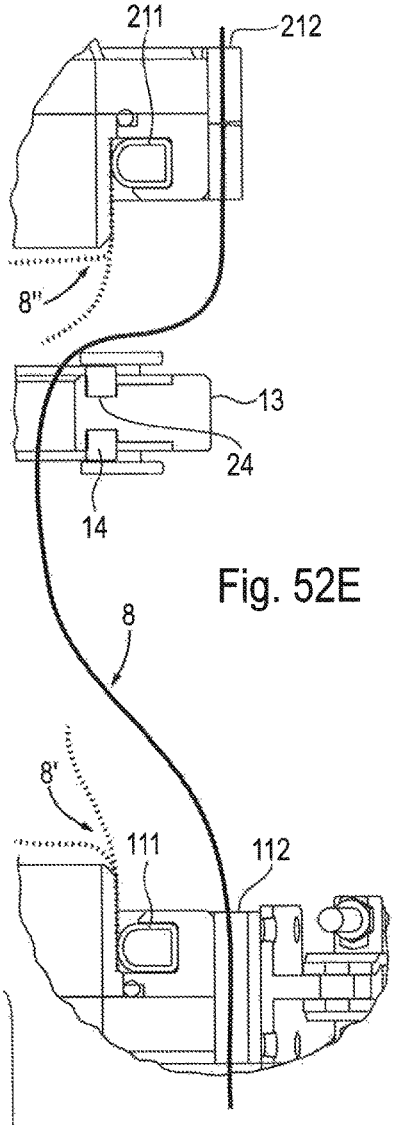
Figures 53A, 53B:
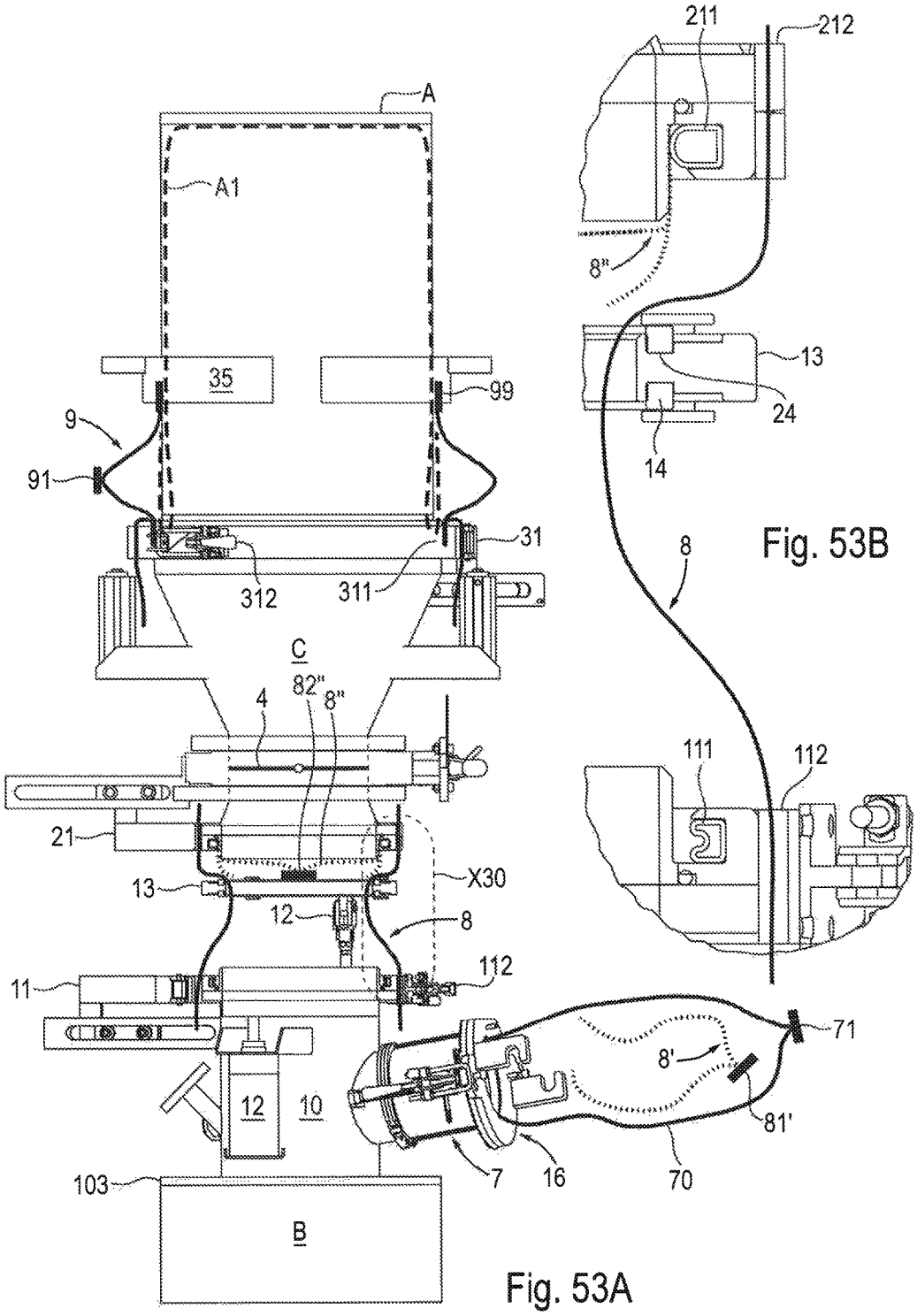
Figures 53C, 53D:
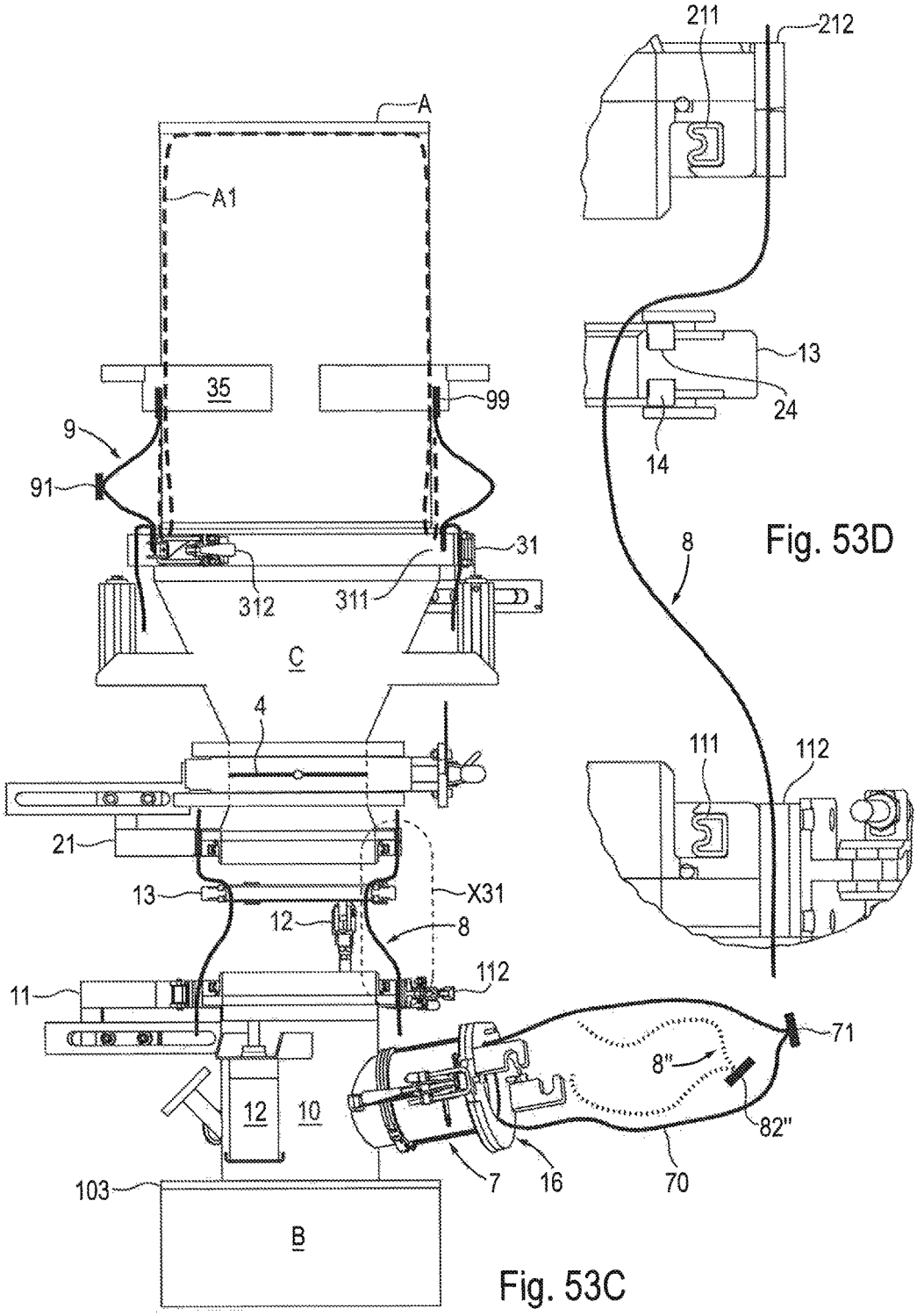
Figure 54A:
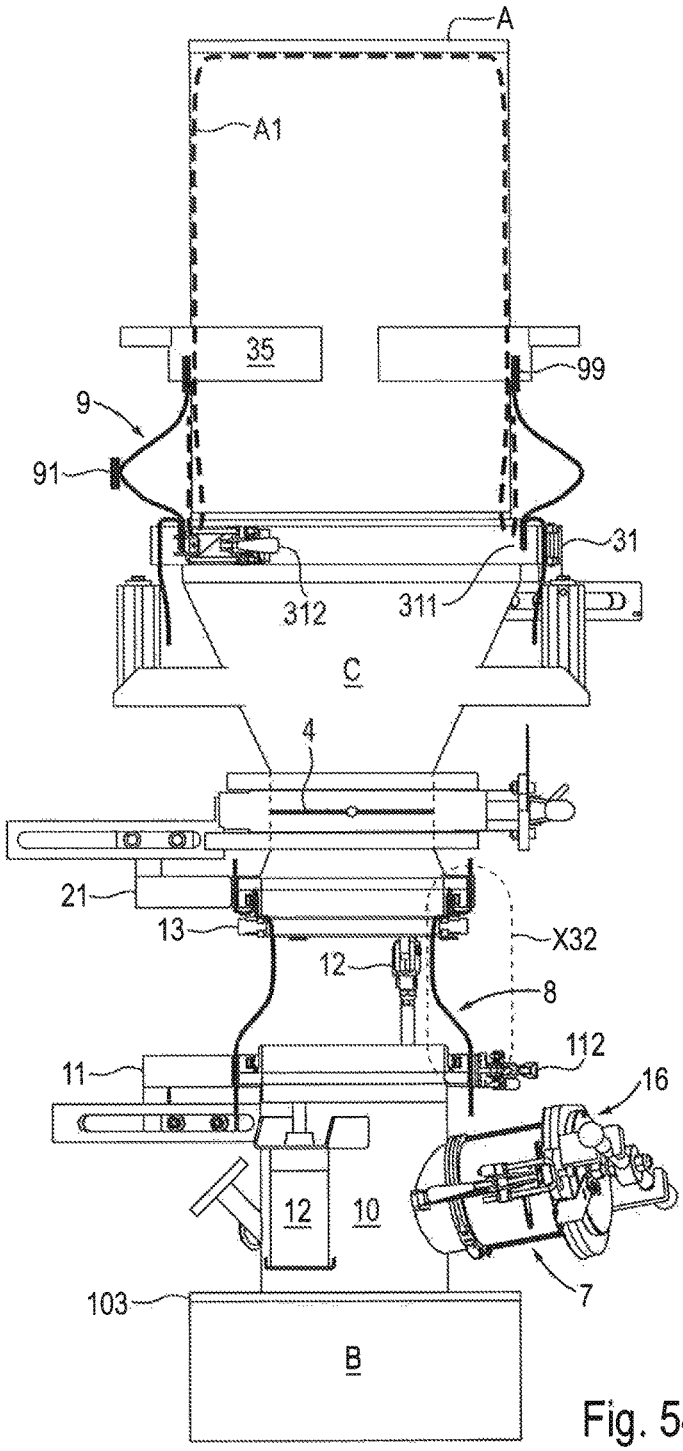
Figure 54B:
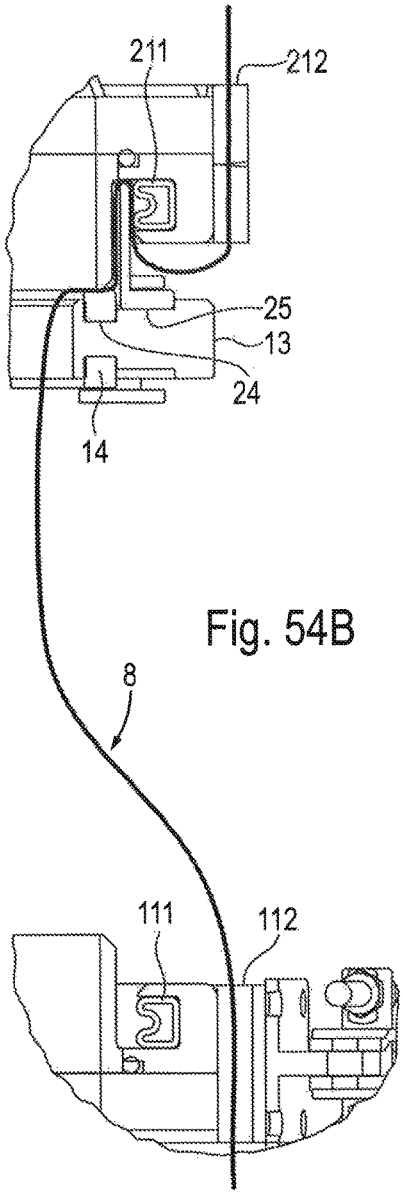
Figures 54C, 54D:
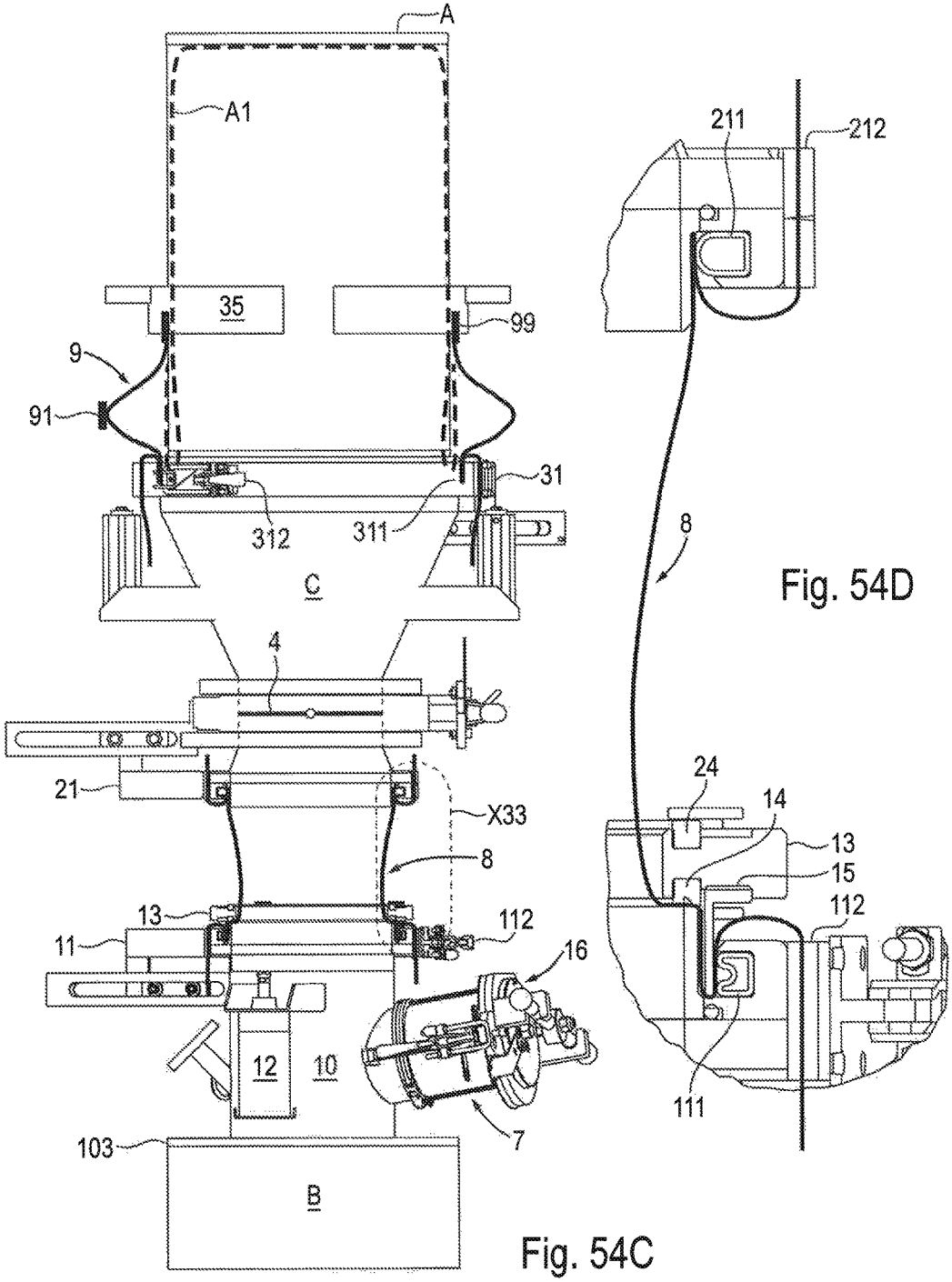
Figure 54E:
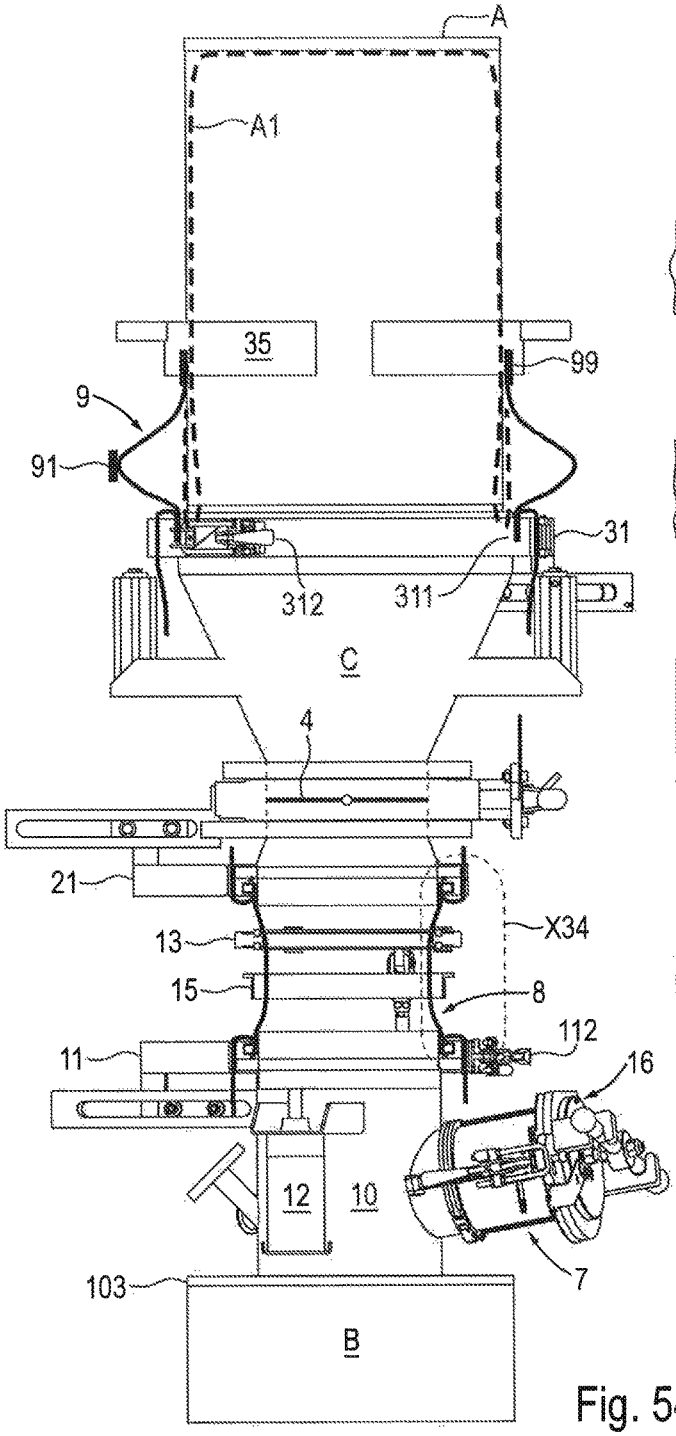
Figure 54F:
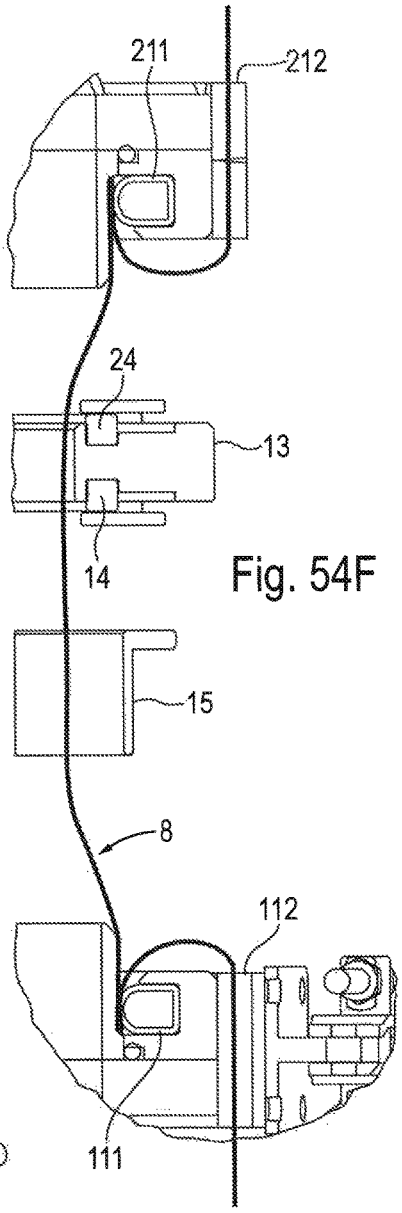
Figure 57A:
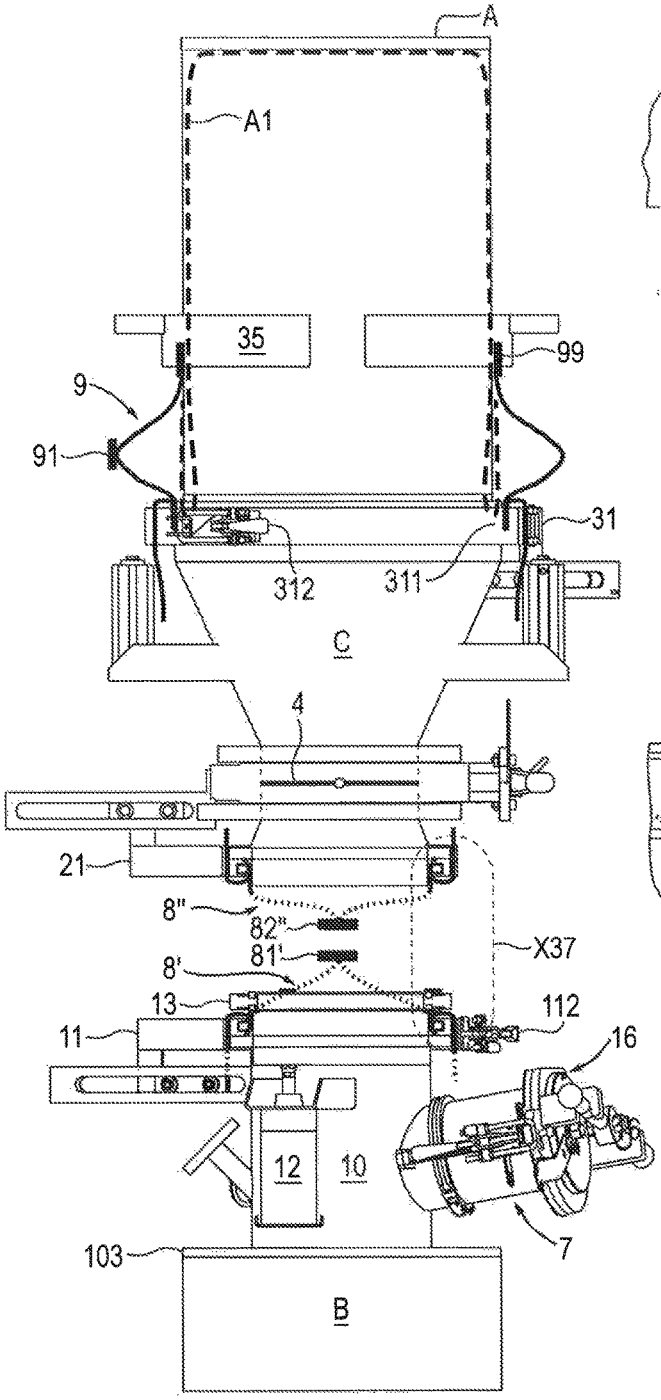
Figure 57A:
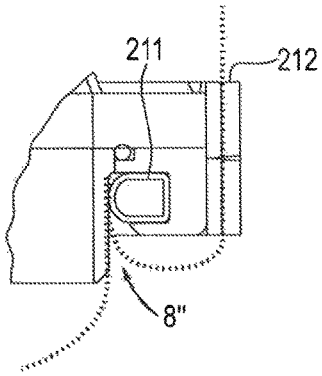
Figure 57B:
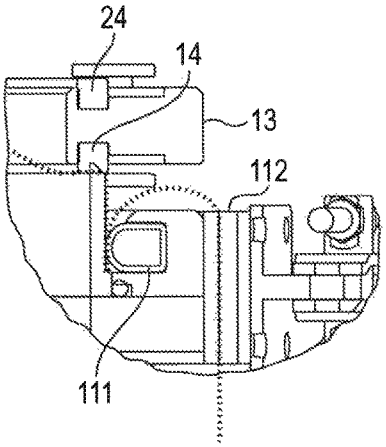

FIGS. 43A to 57B: show a fourth exemplary application of the apparatus according to the invention in conjunction with a transfer means for emptying a first container in the form of a drum containing process material in the form of flowable solid materials, with the key situations during a transfer operation, as schematic illustrations;

FIG. 43A—first situation: provision of first container to be emptied with inner liner provided with upper tying point, tensioning ring detached, container cover removed;

FIG. 43B—third folding element placed around first container;

FIG. 43C—new special liner piece with intervention part placed around upper region of the first container, lower end of the special liner piece fixed in a sealed-off manner against first container;

FIG. 44—second situation: provision of funnel-shaped installation part with second and third tensioning unit above first container; upper end of a special liner remainder of a previous transfer operation held, in a sealed-off manner, by means of active first tensioner at third tensioning unit, upper end of the second liner piece introduced into open second tensioner of the second tensioning unit, endless liner head as alternative to second tensioning unit;

FIG. 45—third situation: access by means of intervention part for the purpose of removing tying point from the inner liner, drawing of the upper end of the inner liner over the rim of the container between container casing and lower end of special liner piece;

FIGS. 46A and 46B: fourth situation: discharge of the third liner remainder;

FIG. 46A—deactivation of first tensioner in third tensioning unit, grasping of third liner remainder using intervention part, bringing externally of the third liner remainder captured in the intervention part, provision of a second crimp and, close thereto, a next first crimp close to the intervention part at the special liner piece;

FIG. 46B—severing of the special liner piece between second and next first crimp, removal of the separated intervention part, positioning of third folding element slid up on container rim;

FIG. 47A—fifth situation: bringing of first container and installation part toward one another, pressing-in of the upper end of the special liner piece at first tensioner of the third tensioning unit by means of third folding element;

FIG. 47B—the enlarged detail X24 from FIG. 47A;

FIG. 48A—sixth situation: at least partial activation of first tensioner at third tensioning unit;

FIG. 48B—the enlarged detail X25 from FIG. 48A;

FIG. 49A—seventh situation: moving of the first container and installation part away from one another;

FIG. 49B—removal of the third folding element from the first tensioner of the third tensioning unit, full activation of first tensioner;

FIG. 49C—the enlarged detail X26 from FIG. 49B;

FIG. 49D—sliding down of folding element positioned around first container;

FIG. 50A—eighth situation: bringing together of first container and installation part, placement of third seal with third tensioning unit on rim of the first container;

FIG. 50B—the enlarged detail X27 from FIG. 50A;

FIG. 51A—ninth situation: tipping upside-down of the assembly formed from first container and installation part with second and third tensioning unit or alternative endless liner head and only the third tensioning unit, positioning relative to transfer means with second container therebelow, first liner remainder from previous transfer operation held in first tensioning unit of the transfer means;

FIG. 51B—the upside-down assembly according to FIG. 51A with alternative endless liner head and only the third tensioning unit, removal of a length for the purpose of providing a new first liner piece, or with alternative double flap and only the third tensioning unit;

FIG. 52A—tenth situation: insertion of a new divided-off first liner piece between transfer means and installation part, lower end of the first liner piece guided through open second tensioner of the first tensioning unit at the transfer means and upper end guided through open second tensioner at the second tensioning unit;

FIG. 52B—the enlarged detail X28 from FIG. 52A;

FIG. 52C—insertion of the alternative first new liner piece drawn off from the endless liner head, lower end of the first liner piece guided through open second tensioner of the first tensioning unit at transfer means;

FIG. 52D—both second tensioners of first and second tensioning unit closed;

FIG. 52E—the enlarged detail X29 from FIG. 52D;

FIGS. 53A to 53D: eleventh situation: discharge of first and second liner remainder with respective utility portion of liner stock from transfer unit;

FIG. 53A—deactivation of first tensioner of the first tensioning unit; discharge of first liner remainder from transfer apparatus;

FIG. 53B—the enlarged detail X30 from FIG. 53A;

FIG. 53C—deactivation of first tensioner of the second tensioning unit, discharge of second liner remainder;

FIG. 53D—the enlarged detail X31 from FIG. 53C;

FIGS. 54A to 54D: twelfth situation: sealed-off securing of the first divided-off liner piece at first tensioners of first and second tensioning unit;

FIG. 54A—moving up of the press ring with second folding element toward the second tensioning unit, pressing-in of upper end of the first divided-off liner piece at associated first tensioner by means of second folding element;

FIG. 54B—the enlarged detail X32 from FIG. 54A;

FIG. 54C—downward movement of the press ring, activation of first tensioner of second tensioning unit, removal of second folding element from first tensioner at second tensioning unit, placement of press ring with seal on guide tube of the transfer means, pressing-in of lower end of the first divided-off liner piece at first tensioner of first tensioning unit by means of first folding element;

FIG. 54D—the enlarged detail X33 from FIG. 54C;

FIG. 54E—moving up of the press ring and removal of first folding element, activation of first tensioner of first tensioning unit;

FIG. 54F—the enlarged detail X34 from FIG. 54E;

FIG. 55A—thirteenth situation: moving of the assembly formed from first container and installation part with second and third tensioning unit and of the assembly formed from transfer means and second container toward one another, opening of the isolation member at the installation part, process material from first container flows through guide tube into second container;

FIG. 55B—the enlarged detail X35 from FIG. 55A;

FIG. 56A—fourteenth situation: closure of the isolation member at the installation part, movement of the assemblies according to FIG. 55A away from one another;

FIG. 56B—the enlarged detail X36 from FIG. 56A;

FIG. 57A—fifteenth situation: provision of a second and, close thereto, a next first crimp at the first divided-off liner piece, severing of the liner piece between second and next first crimp; creation of new first and second liner remainders; and FIG. 57B—the enlarged detail X37 from FIG. 57A.

Figure 59A:
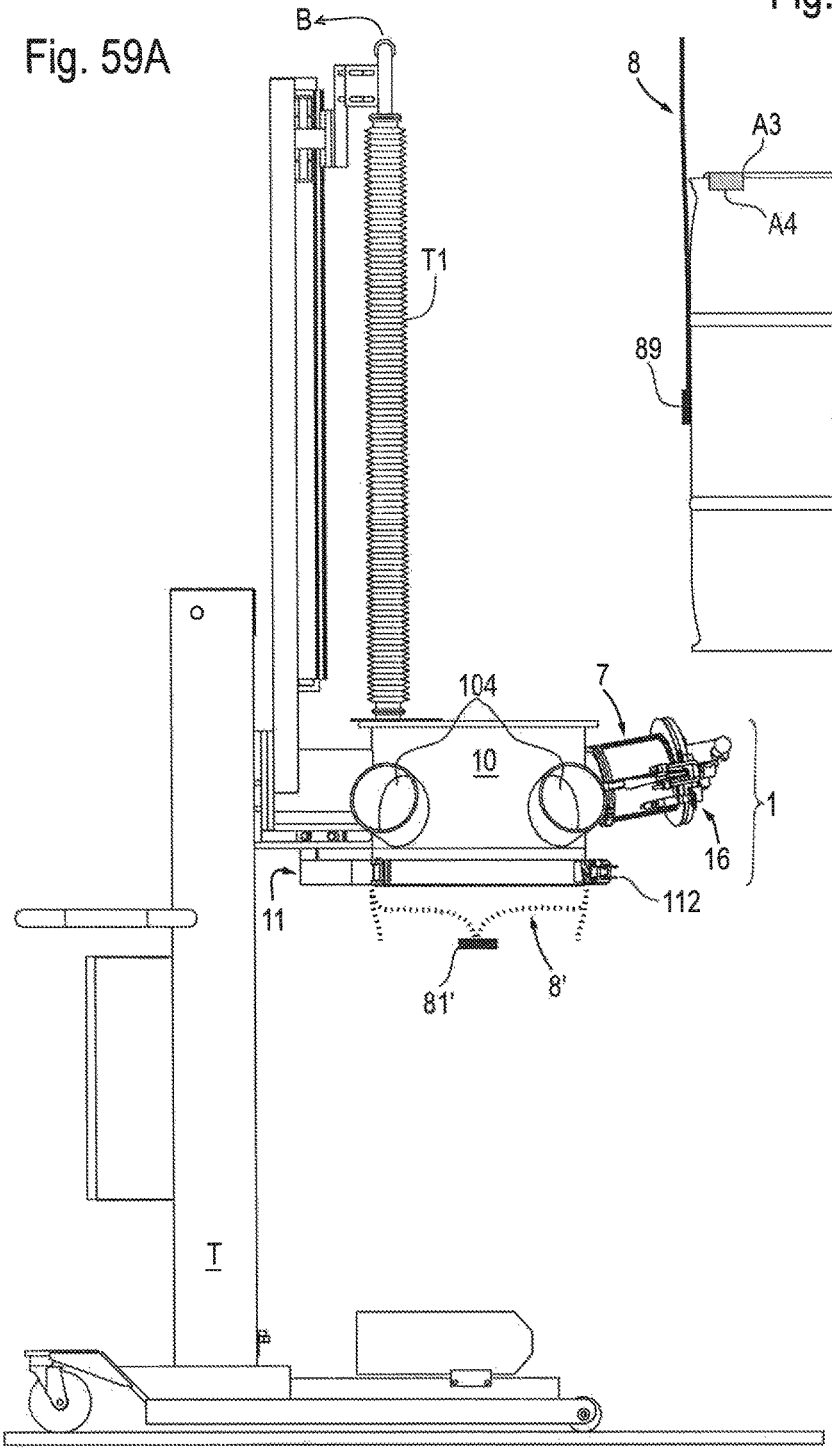
Figure 58A:
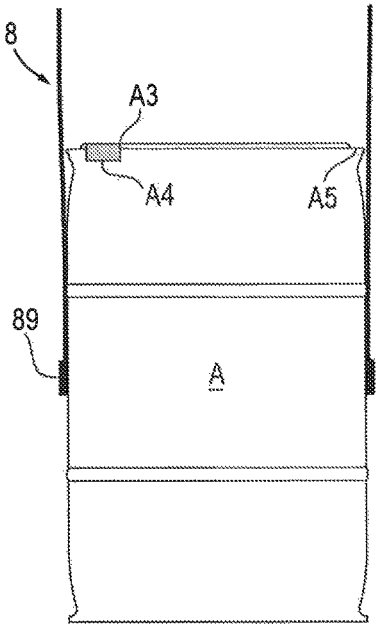
Figure 59B:
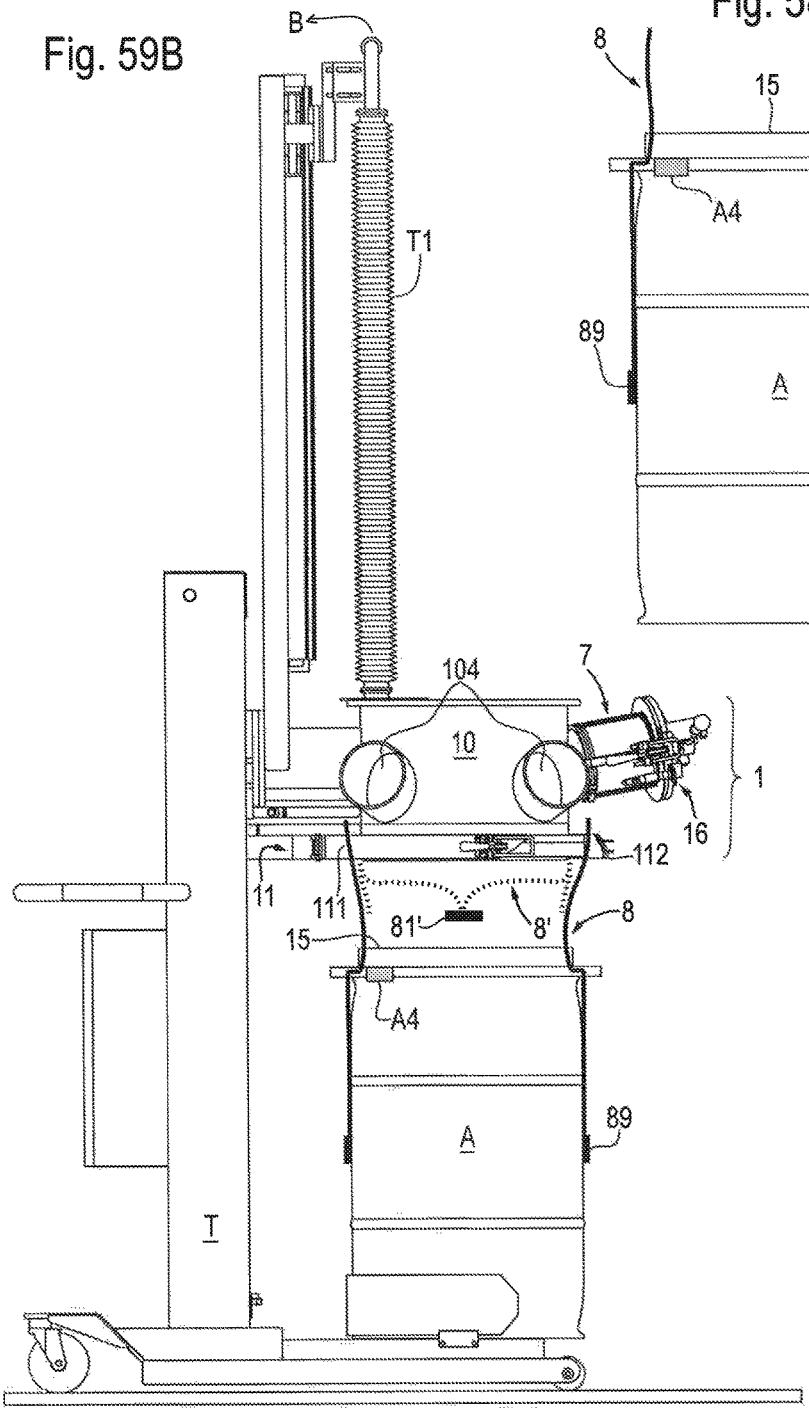
Figure 58B:
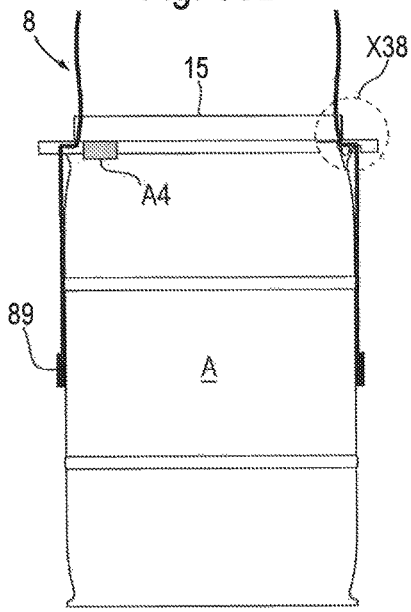
Figure 59C:
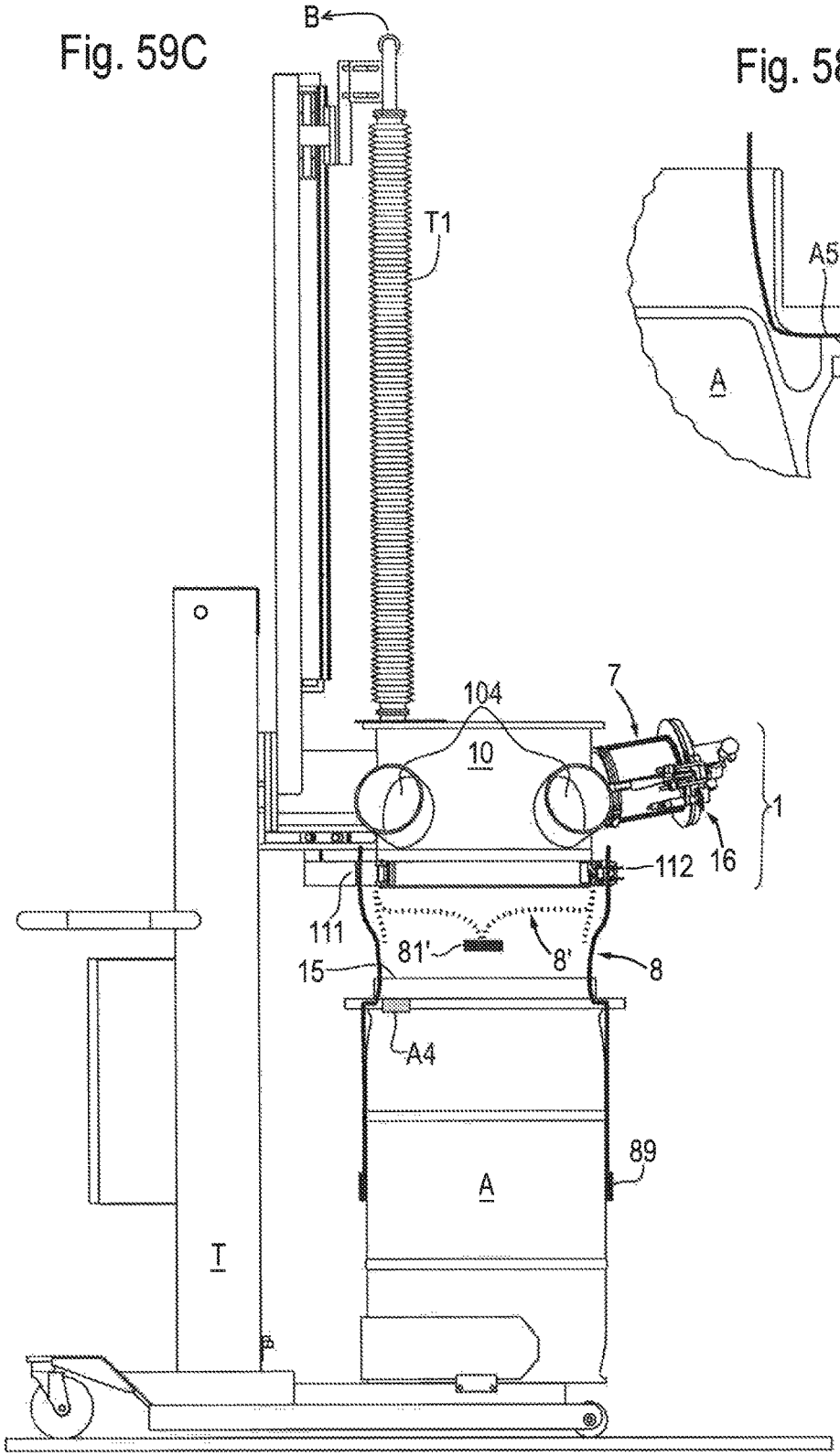
Figure 58C:
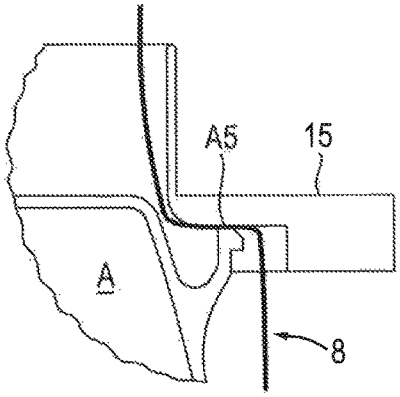
Figure 60:
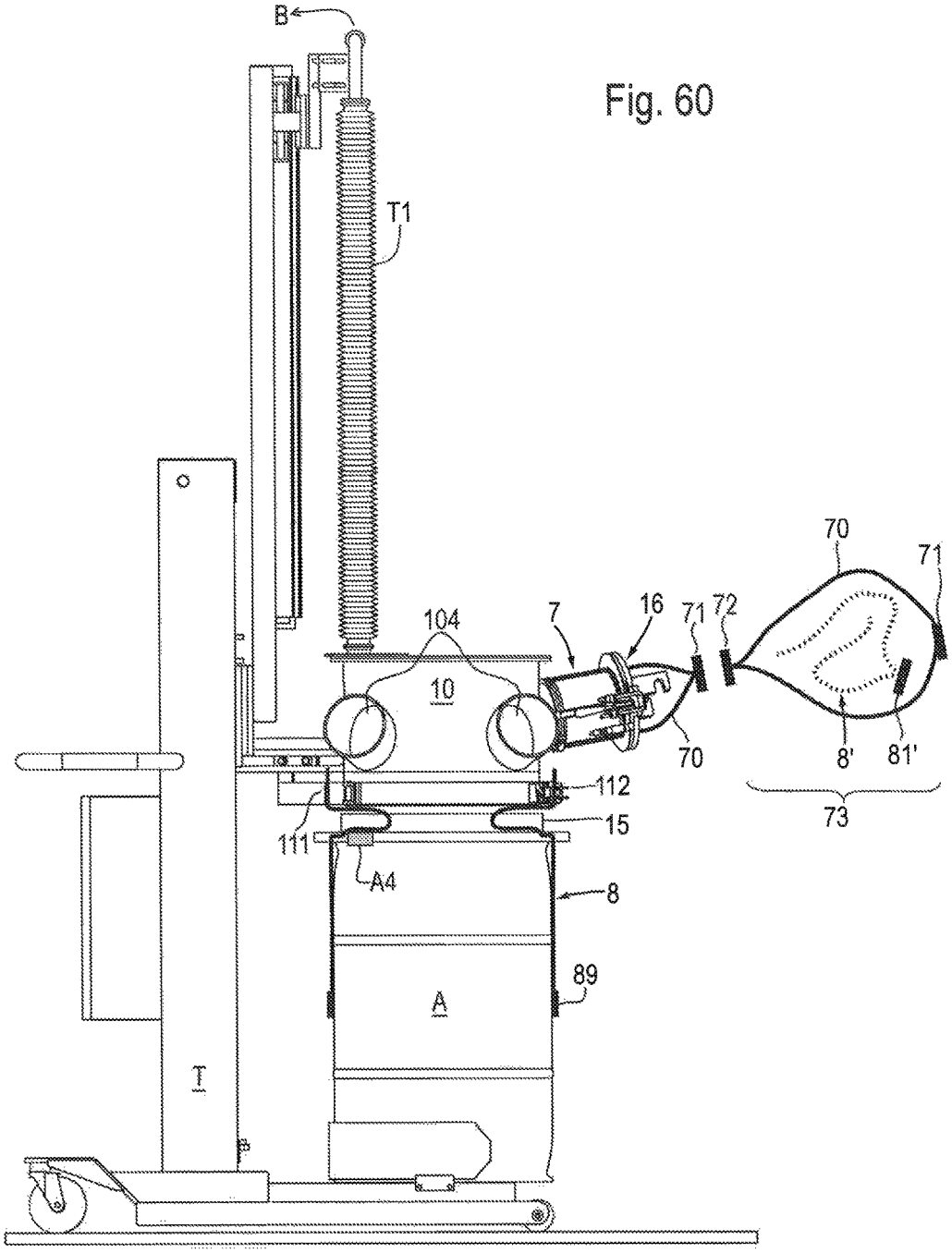
Figure 61A:
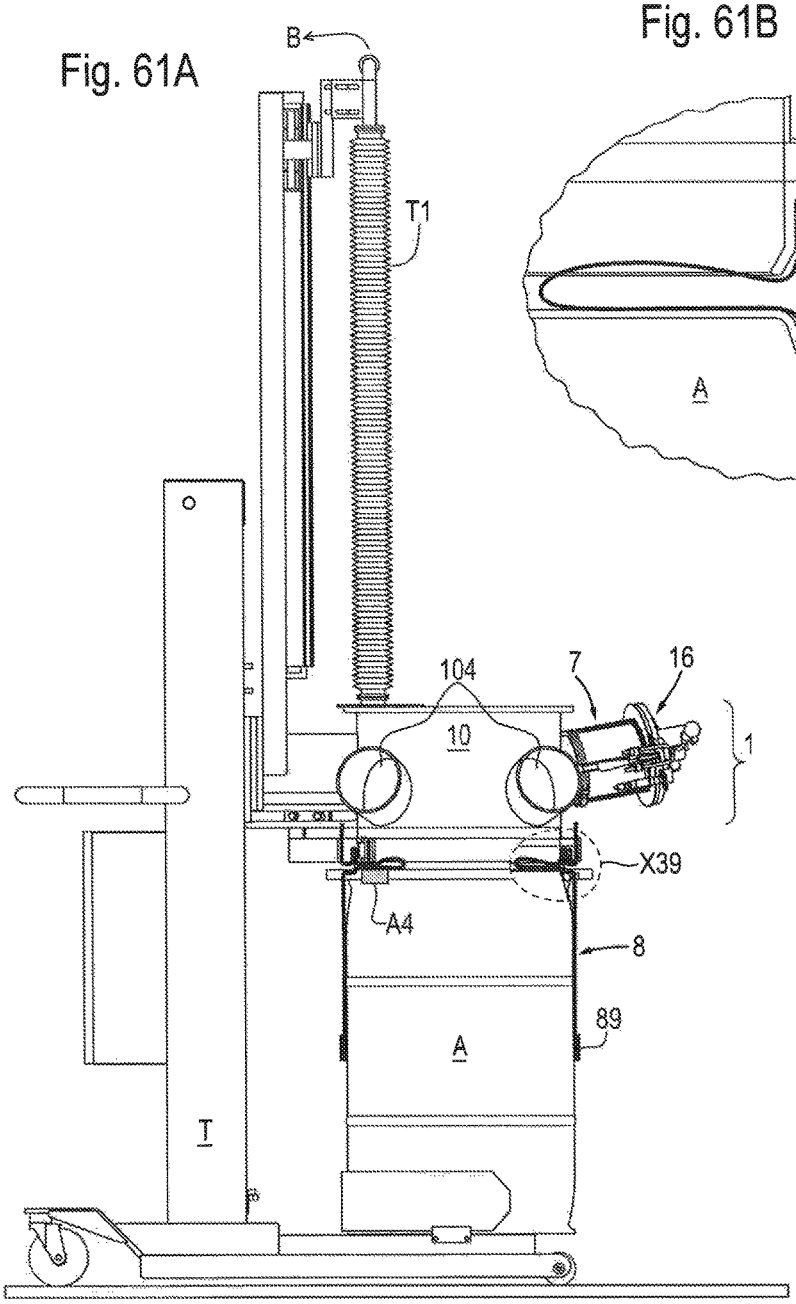
Figure 61B:
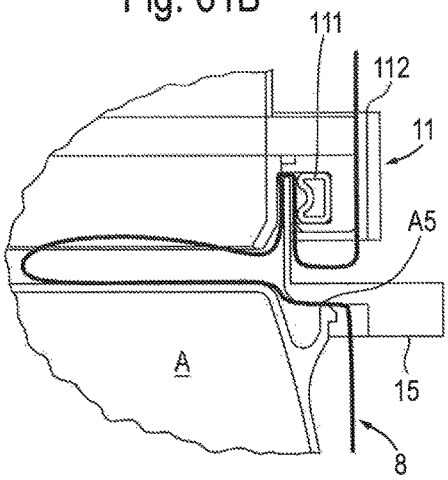
Figure 62:
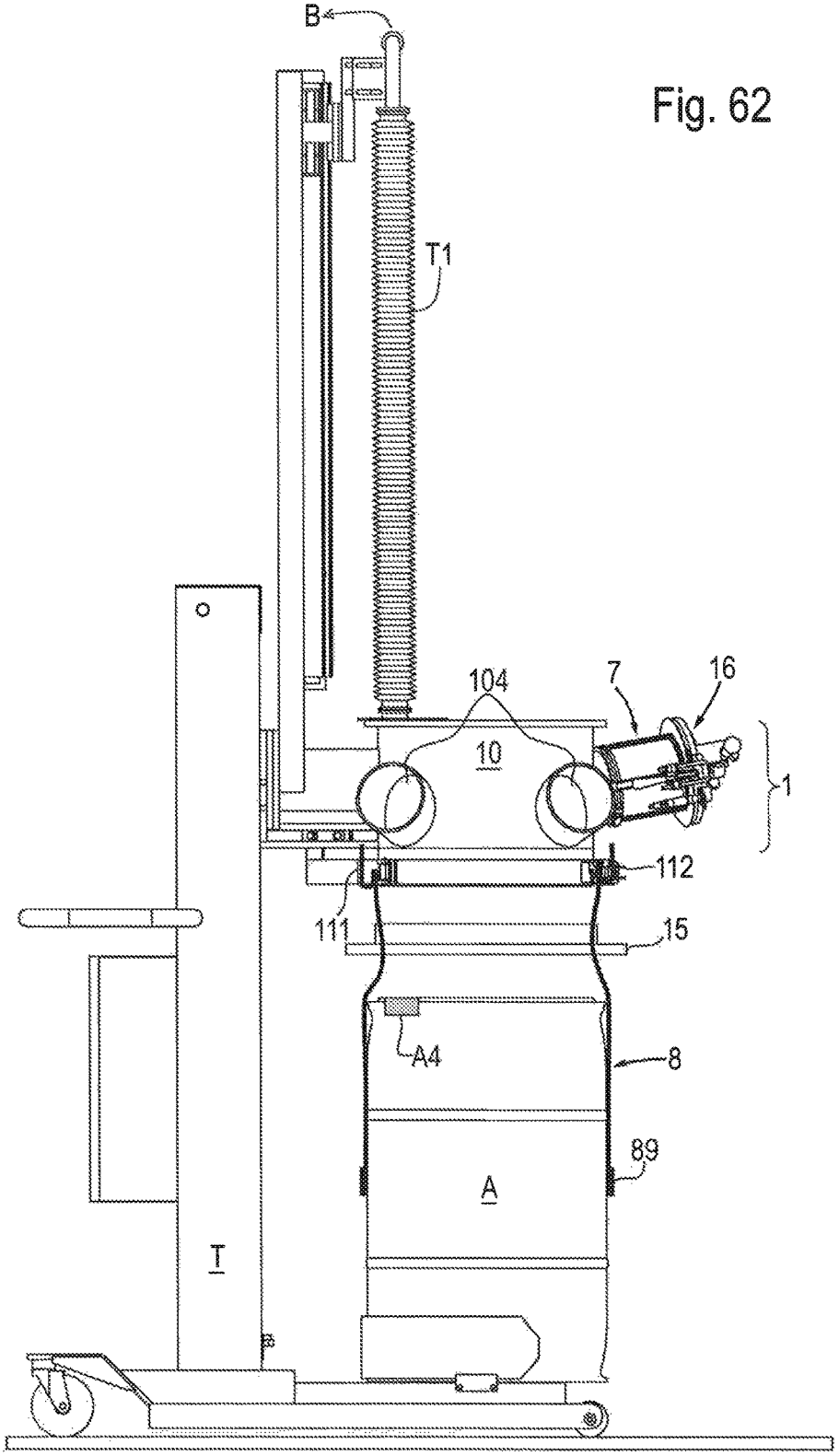
Figure 63A:
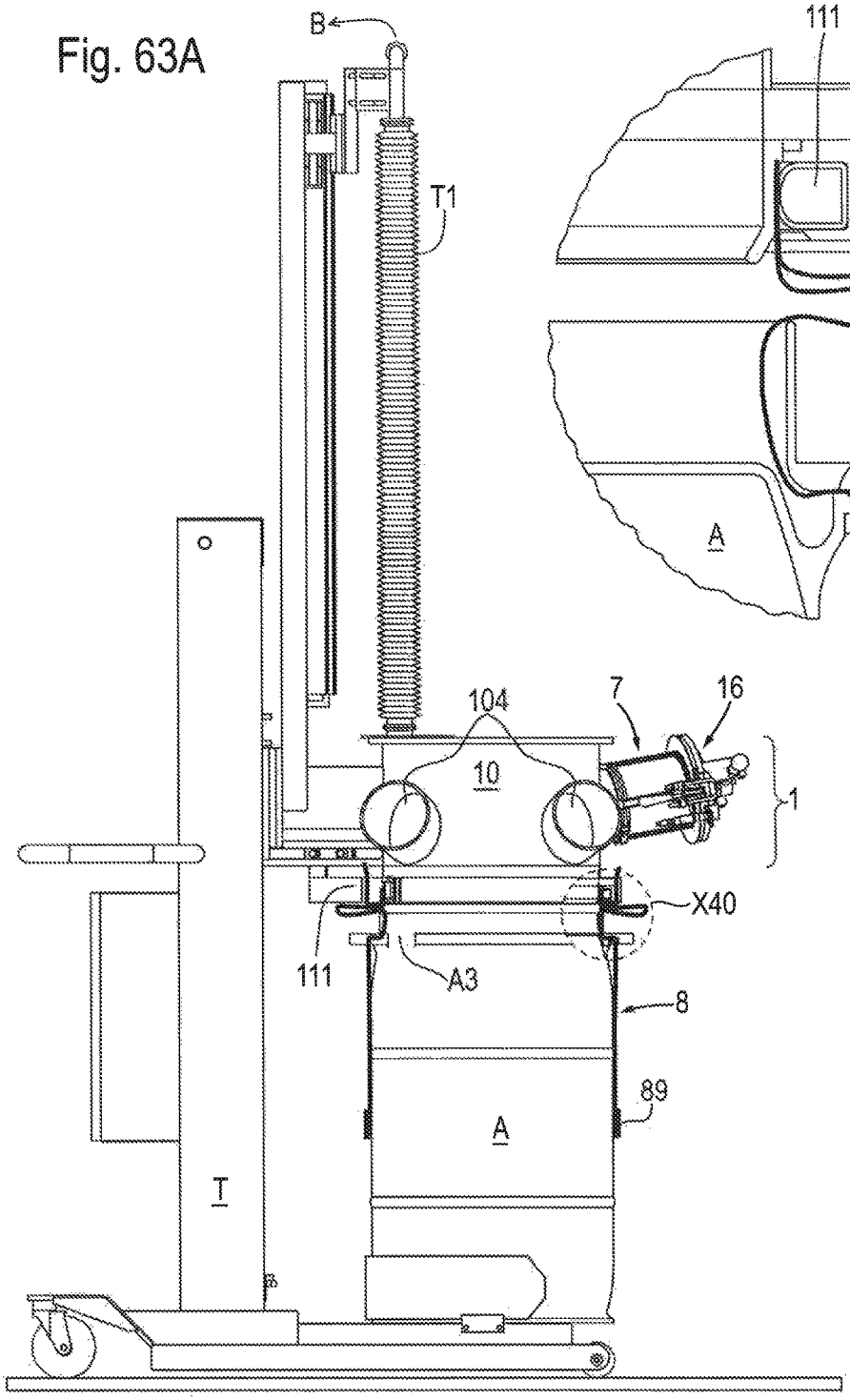
Figure 63B:
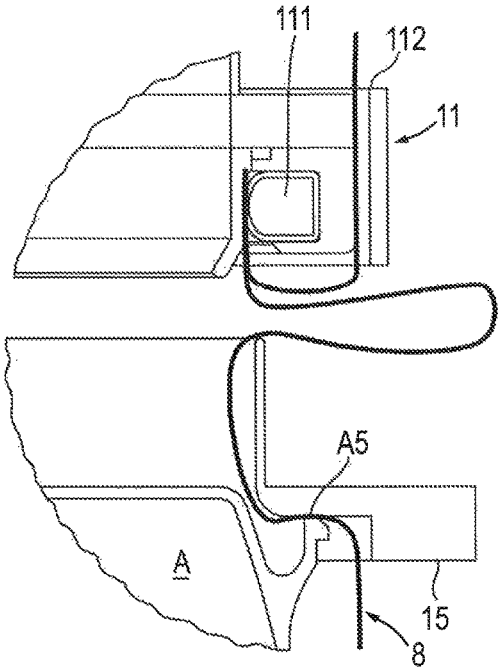
Figure 64:
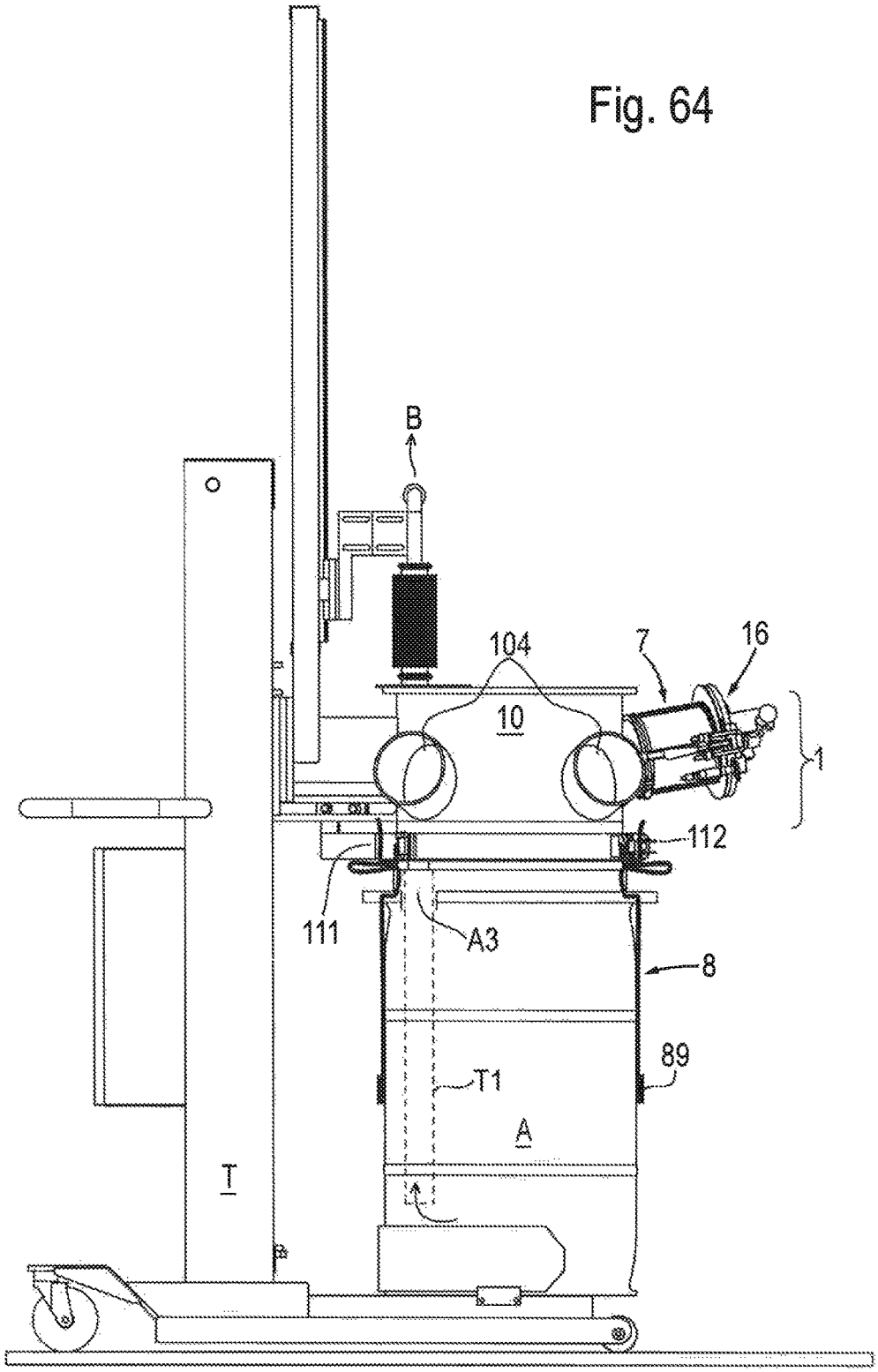
Figure 65A:
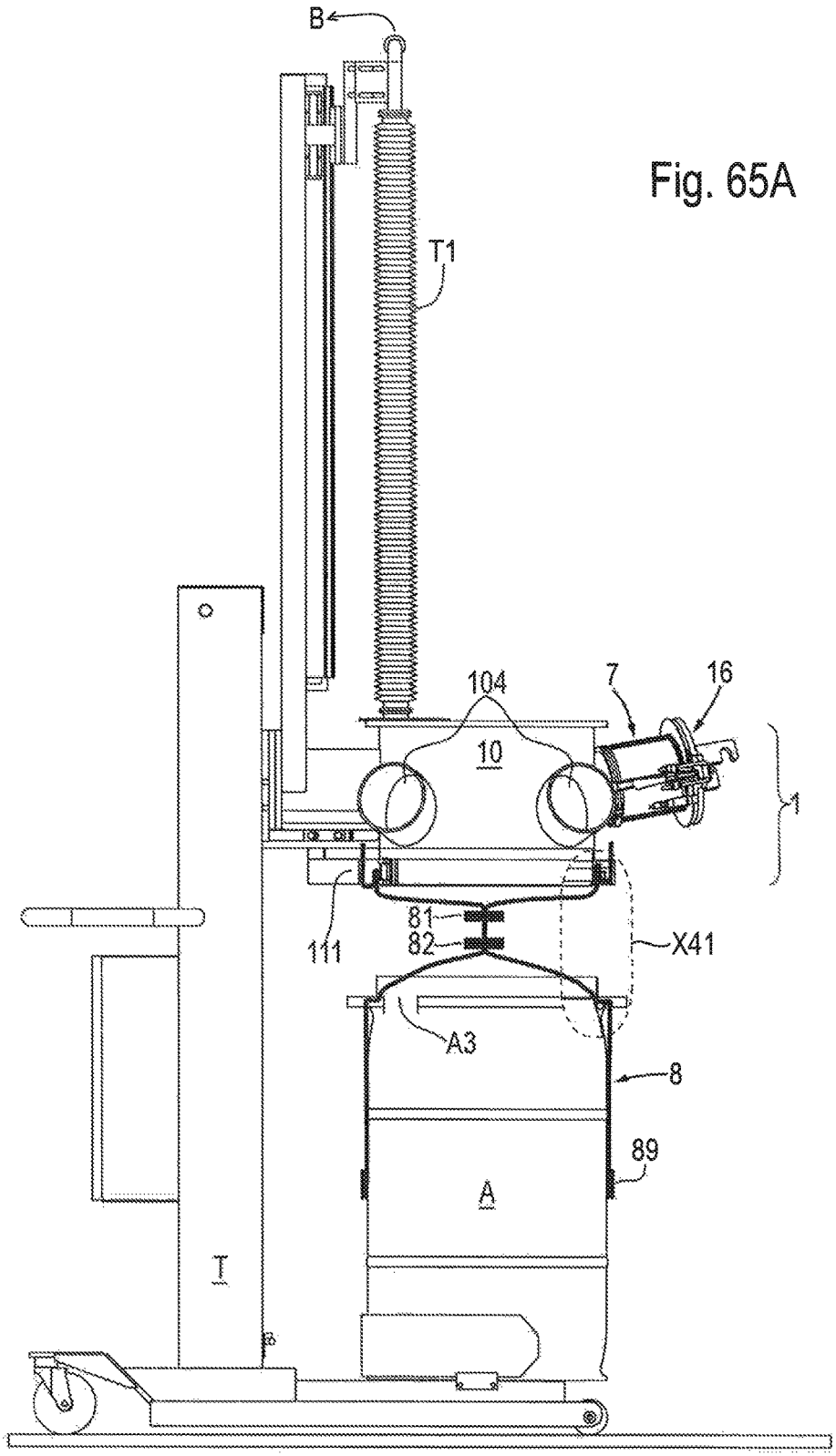
Figure 65B:
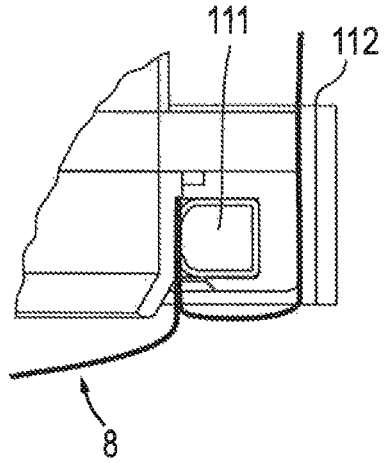
Figure 65B:
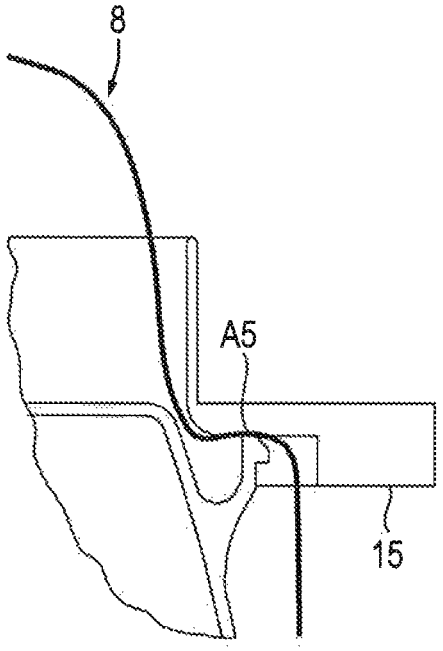

FIGS. 58A to 66: show a fifth exemplary application of the apparatus according to the invention in conjunction with a transfer means for emptying a first container in the form of a drum containing liquid process material, with the key situations during a transfer operation, as schematic illustrations;

FIG. 58A—first situation: first container to be emptied provided with closed bung hole, new first liner piece placed around upper region of the first container, lower end of the first liner piece fixed in a sealed-off manner against container;

FIG. 58B—first folding element positioned on rim of the first container, upper end of the first liner piece guided through first folding element;

FIG. 58C—the enlarged detail X38 from FIG. 58B;

FIG. 59A—second situation: provision of transport frame with transfer means and intake tube with feed to the second container, first liner remainder with first crimp from previous transfer operation fixed, in a sealed-off manner, in first tensioner of first tensioning unit, free end of first liner remainder hangs down, second tensioner closed;

FIG. 59B—third situation: upper end of new first liner piece guided through open second tensioner of first tensioning unit;

FIG. 59C—fourth situation: upper end of new first liner piece fixed, in a sealed-off manner, in closed second tensioner of first tensioning unit;

FIG. 60—fifth situation: deactivation of first tensioner of the first tensioning unit, discharge of first liner remainder with utility portion of liner stock from transfer unit;

FIG. 61A—sixth situation: moving of the first container and transfer means toward one another, pressing-in of the upper end of the first liner piece at first tensioner of first tensioning unit by means of first folding element;

FIG. 61B—the enlarged detail X39 from FIG. 61A;

FIG. 62—sixth situation: activation of first tensioner of first tensioning unit, moving of first container and transfer means away from one another, removal of first folding element from first tensioning unit;

FIG. 63A—seventh situation: moving of first container and transfer means toward one another, placement of first folding element on rim of first container, removal of stopper from bung hole by intervention points at transfer means;

FIG. 63B—the enlarged detail X40 from FIG. 63A;

FIG. 64—eighth situation: insertion of intake tube through open bung hole in first container, transfer of process material from first container into second container;

FIG. 65A—ninth situation: provision of a second and, close thereto, a next first crimp on the first liner piece;

FIG. 65B—the enlarged detail X41 from FIG. 65A; and

Figure 66:
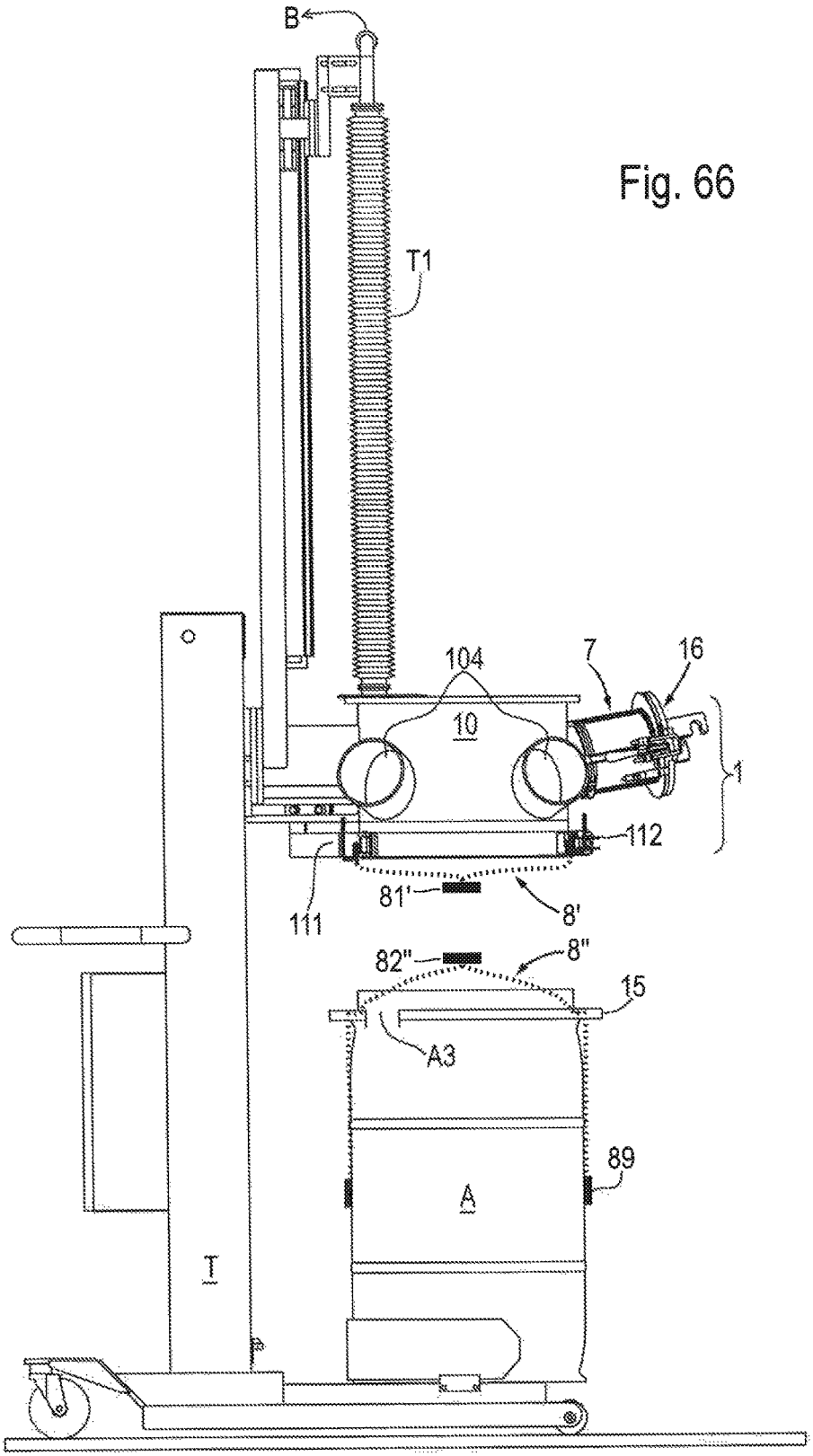

FIG. 66—tenth situation: severing of the first liner piece between second and next first crimp; creation of new first and second liner remainders, disposal of the empty first container sealed-off with second liner remainder.

EXEMPLARY EMBODIMENTS

The detailed description hereinafter of a plurality of exemplary embodiments of the apparatus according to the invention with various installation designs and method sequences applied therewith is provided with reference to the accompanying drawings.

The following is true for the entire description below. Where reference numerals are contained in a figure for the purpose of clarifying the drawing, but are not explained in the text of the description directly associated with said figure, reference is made to the mention of said reference numerals in the above descriptions of the figures. In the interest of clarity, a repeated description of components is generally omitted in the following figures, provided it is clear from the drawing that these are "recurring" components.

A first exemplary application of the apparatus according to the invention in conjunction with a transfer means 1 for emptying a first container A in the form of a big bag for process material in the form of flowable solid materials into a second container B with the key situations during a transfer operation is illustrated in the sequence of FIGS. 1 to 13. For all exemplary applications described hereinafter, it is true that the essential features of the invention are the at least one tensioning unit of the apparatus and the method sequences to be operated therewith, whereas the transfer means and the method steps to be performed therewith already form the subject of dependent claims.

FIG. 1: Starting Situation

An inner liner A1 provided with a closure 80 extends out from the first container A, the free end of said liner being usable for the transfer operation as a first liner piece 8 to be guided toward the first tensioning unit 11—installed here on the transfer means 1. The transfer means 1 has, as essential component, a guide tube 10, which is intended to guide process material between the containers A,B and on the one hand has a first aperture 101 and on the other hand has a second aperture 102. The second container B is mounted on by means of the connector 103. At the top, the guide tube 10 has an L-shaped collar 100 with a first tensioning unit 11 provided thereon, which has a first tensioner 111, preferably an expansion seal, and a second tensioner 112, preferably a clamp which is to be opened. Both tensioners 111,112 of the first tensioning unit 11 are arranged circularly around the guide tube 10 and concentrically with one another in relation to the axial extension of said guide tube.

In the present case, one end of the tubular first liner remainder 8' is fixed in a sealed-off manner in both tensioners 111,112 of the first tensioning unit 11 and is closed at the other end by means of a first crimp 81'. In order to provide a stronger seal, a press ring 13 rests via its inserted seal 14 with compressive force on the first tensioning unit 11 in order to create an additional seal point at an end of the first liner piece 8 guided through beneath the press ring 13.

The preferably tubular transfer unit 16 extends from an outer rim 161 with the casing 160 and leads at an incline into the guide tube 10 below the collar 100 via a through-opening. A flange 162 is secured to the rim 161 axially displaceably with respect to the direction of extension of the transfer unit 16, with a circular head seal 163 sitting therein, which head seal is near the rim 161. A detachable cover 165 is docked on the flange 162, from the inner side of which cover a stop 166 extends and ends for example at the guide tube 10 of the transfer means 1. A handle 167 is arranged on the outer side of the cover 165. A liner stock 7, for example in the form of a film-like endless line, is stored externally on the casing 160 of the transfer unit 16, between the rim 161 and the guide tube 10 of the transfer means 1. A utility portion 70 of the liner stock 7 is clamped between the rim 161 of the transfer unit 16 and the head seal 163, thus producing the closed front seal point 164. Close to the guide tube 10, the liner stock 7 is fixed on the transfer unit 16 and sealed off via the free end so to speak of said liner stock by means of the termination element 168.

On the transfer unit 16, the utility portion 70 extends in the case of the presently closed front seal point 164 into the transfer unit 16 and is advanced in the transfer unit 16 by the introduced stopper 166 via its first crimp 71 mounted on the utility portion 70 until reaching the guide tube 10 of the transfer means 1.

FIG. 2: Second Situation

The press ring 13 with its seal 14 is moved upwardly by actuating the lifting link 12 and is thus lifted from the guide tube 10. The second tensioner 112 is open and the free end of the first liner remainder 8' is directed upwardly. The free end of a new liner piece 8, provided with closure 80, of a first container A is guided through the open second tensioner 112 and is drawn loosely over the guide tube 10.

FIG. 3: Third Situation

The free end of the new liner piece 8 is fixed in a sealed-off manner by means of the closed second tensioner 112.

FIG. 4: Fourth Situation

The cover 165 is detached from the flange 162, this being raised via its head seal 163 from the rim 161 of the transfer unit 16, such that the clamping of the utility portion 70 of the liner stock 7 is canceled and therefore the front seal point 164 is released. During this process, the stopper 166 secured to the cover 165 is moved out from the inside of the transfer unit 16. The flange 162 is moved by means of guides on the transfer unit 16 in the axial direction thereof, wherein the utility portion 70 is pulled outwardly between the rim 161 and flange 162 and through a released opening in the flange 162.

FIG. 5: Fifth Situation

The utility portion 70 is advanced into the guide tube 10 through the transfer unit 16.

FIG. 6: Sixth Situation

With inactive first tensioner 111, the first liner remainder 8' is grasped by the utility portion 70 and is extracted externally through the transfer unit 16 and guide tube 10.

FIG. 7: Seventh Situation

The flange 162 sits on the rim 161 of the transfer unit 16, the utility portion 70 of the liner stock 7 is clamped, and the pressed-on head seal 163 forms the closed front seal point 164. At the extracted utility portion 70 with first liner remainder 8' enclosed therein, a separation part 73 is divided off, specifically by providing a second crimp 72 and, close thereto, a next first crimp 71, such that a next utility portion 70 at the liner stock 7 is created. The distance between the two crimps 72, 71 should be kept as small as possible, such that, when severing between the crimps 72,71, minimal excess lengths of the cut liner stock 7 remain, which might be sprinkled with process material.

FIG. 8: Eighth Situation

The liner stock is severed between the second crimp 72 and next first crimp 71, such that it is possible to dispose of the separation part 73 separated from the next utility portion 70 and containing the first liner remainder 8' enclosed therein.

FIG. 9: Ninth Situation

A next utility portion 70 with next first crimp 71 provided thereon is inserted by means of the stopper 166 through the flange 162 into the transfer unit 16. The first liner piece 8 is pressed in by means of the first folding element 15 at the deactivated first tensioner 111 and the groove thus provided. Now, the first tensioner 111 could be activated at least a little in order to hold the first liner piece 8 with preload.

FIG. 10: Tenth Situation

The first folding element 15 is removed again and the first tensioner 111 is in any case fully activated, such that the first liner piece 8 is now fixed firmly and in a sealed-off manner.

FIG. 11: Eleventh Situation

The press ring 13 with its seal 14 is lowered and moved toward the transfer means 1, such that a further seal is created at the first liner piece 8. The closure 80 on the liner piece 8 is removed, such that process material from the first container A flows to the first aperture 101 through the transfer means 1 and from the second aperture 102 into the docked second container B. The stopper 166 advanced in the transfer unit 16 as far as the guide tube 10 of the transfer means 1 prevents critical amounts of process material from passing into the transfer unit 16.

FIG. 12: Twelfth Situation

On the first liner piece 8 of the emptied first subsequent container A, a second crimp 92 and, close thereto, a next first crimp 81 are provided.

FIG. 13: Thirteenth Situation

Once the first liner piece 8 has been severed between second and next first crimp 82",81', a new first liner remainder 8' remaining in the first tensioning unit 11 and a second liner remainder 8" to be disposed of with the attached first container A are produced. The starting situation according to FIG. 1 is thus presented again at the transfer means 1, and a further transfer operation can be started with a next first container A to be emptied.

A second exemplary application of the apparatus according to the invention in conjunction with a transfer means 1 for emptying a first container A in the form of a container having an inflexible outlet into a second container B for process material in the form of flowable solid materials is presented in the sequence of FIGS. 14A to 29B, with the key situations during a transfer process.

FIGS. 14A to 14C: First Situation

The first liner remainder 8' from a previous transfer operation is closed by the first crimp 81' and fixed to the guide tube 10 by means of activated first tensioner 111. The press ring 13 with the seal 14 is moved upwardly above the guide tube 10, and the end of the first liner remainder 8' is additionally fixed in a sealed-off manner to the guide tube 10 by means of closed second tensioner 112. With regard to the structure of the transfer means 1 as a whole, inclusive of the transfer unit 16 provided with the liner stock 7, reference is made to the sequence of FIGS. 1 to 13.

FIGS. 15A and 15B: Second Situation

The second tensioner 112 is opened and the overhang of the first liner remainder 8' via the free end is directed upwardly and no longer protrudes downwardly beyond the collar 100, but points in the direction of the press ring 13.

FIGS. 16A and 16B: Third Situation

The lower end of the first liner piece 8 for a new transfer operation is guided downwardly beyond the collar 100 through the annular gap of the open second tensioner 112 and drawn loosely over the guide tube 10. The upper end of the first liner piece 8 is guided upwardly through the press ring 13 and the second folding element 25 resting thereagainst.

FIGS. 17A and 17B: Fourth Situation

The lower end of the first liner piece 8 is fixed in a sealed-off manner in the second tensioner 112.

FIGS. 18A and 18B: Fifth Situation

The first container A to be emptied, with a closed isolation member 4 and second liner remainder 8" from the previous transfer operation held in a second tensioning unit 21, is positioned above the transfer means 1. The second tensioning unit 21 consists of a first tensioner 211—here in the form of a pair of clamping jaws—and a second tensioner 212, formed here as a clamp. The second liner remainder 8" is clamped between the first tensioner 211 and is closed by a second crimp 82". A funnel-shaped installation part C is adjoined above the isolation member 4. In order to facilitate the handling of the second liner remainder 8" at the second tensioning unit 21, the press ring 13 and the second folding element 25 are moved slightly downward by means of the lifting link 12.

FIG. 19: Sixth Situation

The upper end of the first liner piece 8 is guided through the open second tensioner 212 at the second tensioning unit 21.

FIGS. 20A and 20B: Seventh Situation

With deactivated first tensioner 111 of the first tensioning unit 11, the first liner remainder 8' lies loosely between first tensioner 111 and collar 100. The upper end of the first liner piece 8 is fixed by means of closed second tensioner 212 at the second tensioning unit 21.

FIGS. 21A to 21H: Eighth Situation

This sequence of figures illustrates the discharge of the first liner remainder 8' with deactivated first tensioner 111 at the first tensioning unit 11. With presently closed front seal point 164 at the transfer unit 16, the utility portion 70 initially extends into the transfer unit 16 and is advanced into the transfer unit 16 by the introduced stopper 166 via its first crimp 71 provided on the utility portion 70 until reaching the guide tube 10 of the transfer apparatus 1 (see FIG. 21A). The cover 165 is then detached from the flange 162, this being raised via its head seal 163 from the rim 161 of the transfer unit 16, such that the clamping of the utility portion 70 of the liner stock 7 is canceled and therefore the front seal point 164 is released. By means of extraction of the liner stock 7 through the transfer unit 16, a utility portion 70 is produced (see FIG. 21B). The utility portion 70 of the liner stock 7 is then preferably manually advanced through the transfer unit 16 into the guide tube 10 of the transfer means 1 (see FIG. 21C). The first liner remainder 8' is now manually grasped by the front end of the utility portion 70 through the transfer unit 16 and the guide tube 10 of the transfer means 1. Here, the first tensioner 111 is deactivated and the seal point thereof is released, such that the first liner remainder 8' lies loosely between the first tensioner 111 and the collar 100 (see FIG. 21D).

The utility portion 70 with grasped first liner remainder 8' is then extracted externally through the transfer unit 16 (see FIG. 21E). The flange 162 sits on the rim 161 of the transfer unit 16, the utility portion 70 of the liner stock 7 is clamped, and the pressed-on head seal 163 forms the closed front seal point 164. A separation part 73 is then divided off at the extracted utility portion 70 with first liner remainder 8' enclosed therein by providing a second crimp 72 and, close thereto, a next first crimp 71, such that a next utility portion 70 at the liner stock 7 is created (see FIG. 21G). The liner stock is then severed between second crimp 72 and next first crimp 71, such that the separation part 73 separated from the next utility portion 70 can be disposed of with the first liner remainder 8' enclosed therein (see FIG. 21H).

FIGS. 22A and 22B: Ninth Situation

By means of the stopper 166, the utility portion 70 with crimp 71 provided thereon is inserted through the flange 162 into the transfer unit 16 toward the transfer means 1. The lifting link 12 and therewith the press ring 13 are moved downwardly, and in so doing the first folding element 15—which can be inserted temporarily—presses the lower end of the first liner piece 8 into the groove at the deactivated first tensioner 111. Now, the previously fully deactivated first tensioner 111 could be activated a little in order to hold the first liner piece 8 under preload. The seal 14 positioned on the press ring 13 is in contact with the collar 100 and here clamps the first liner piece 8, such that a closed annular seal point is created.

FIGS. 23A and 23B: Tenth Situation

The press ring 13 with seal 14 is moved upwardly from the collar 100 of the guide tube 10, and the first folding element 15 is distanced from the at least partially activated first tensioner 111. The press ring 13 and the second folding element 25 are moved close to the second tensioning unit 21 by means of the lifting link 12. The first tensioner 111 is at the latest now fully activated, and therefore the first liner piece 8 is fixed in the first tensioner 111 in a sealed-off manner. The lower end of the first liner piece 8 is held twice in a sealed-off manner in the first tensioning unit 11 by means of the two tensioners 111,112.

FIGS. 24A and 24B: Eleventh Situation

The first folding element 15 is distanced from the first tensioner 111 of the first tensioning unit 11 at the transfer means 1. The press ring 13 and the second folding element 25 are moved downwardly by means of the lifting link 12, such that the seal 14 provided on the press ring 13 comes into contact with the collar 100 and in so doing fixes and seals off the lower end of the first liner piece 8.

FIGS. 25A to 25E: Twelfth Situation

The sequence of FIGS. 25A to 25E illustrates the discharge of the second liner remainder 8" from the first tensioner 211 at the second tensioning unit 21 at the first container A. FIG. 25C corresponds with FIG. 21G, FIG. 25D corresponds with 21H, and FIG. 25E corresponds with FIG. 22A. Once the second liner remainder 8" has been discharged, the lower end of the first liner piece 8 remains fixed in a sealed-off manner in both tensioners 111,112 of the first tensioning unit 11, and the upper end of the first liner piece 8 remains in the first tensioner 212 of the second tensioning unit 21.

FIGS. 26A and 26B: Thirteenth Situation

The second folding element 25 is moved upwardly by means of the lifting link 12, wherein the press ring 13 remains in its lower position. The press ring 13 and the second folding element 25 can be actuated independently of one another. The second folding element 25 presses the upper end of the first liner piece 8 into the first tensioner 211 of the second tensioning unit 21. A seal 24 provided on the second folding element 25 clamps the first liner piece 8 additionally, such that a seal point is created between the second tensioning unit 21 and the second folding element 25.

FIGS. 27A and 27B: Fourteenth Situation

The isolation member 4 is opened, such that process material from the first container A flows through the first aperture 101 through the transfer means 1 and from the second aperture 102 into the docked second container B.

FIGS. 28A and 28B: Fifteenth Situation

The isolation member 4 is closed, such that the flow of process material is interrupted. A first crimp 81' and, close thereto, a second crimp 82" are provided on the first liner piece 8. The liner piece 8 is then severed between the two crimps 81',82", such that a new first liner remainder 8' and a new second liner remainder 8" are created.

FIGS. 29A and 29B: Sixteenth Situation

The second folding element 25 is moved down by means of the lifting link 12 until the second folding element 25 sits on the press ring 13.

A third exemplary application of the apparatus in conjunction with a transfer means 1 for filling a second container B in the form of a container containing process material in the form of flowable solid materials from a first container A is illustrated in the sequence of FIGS. 30A to 42B, with the key situations during a transfer operation.

FIGS. 30A and 30B: First Situation

In contrast to FIGS. 14A to 14C, the collar 100 with the first tensioning unit 11 and the two tensioners 111,112 incorporated therein is now mounted on the lower end of the guide tube 10 of a transfer means 1. At the upper end of the guide tube 10 there is located an isolation member 4, via which the first container A is mounted. As described with reference to FIGS. 14A to 14C, one end of the first liner remainder 8' is fixed in a sealed-off manner in the first tensioning unit 11. The press ring 13 and the second folding ring 25 are momentarily positioned on the collar 100 of the transfer apparatus 1.

FIGS. 31A and 31B: Second Situation

The second tensioner 112 is opened and the overhang of the liner remainder 8', directed downwardly via the free end, no longer protrudes upwardly beyond the collar 100, but points downwardly. The press ring 13 with the seal 14 is moved downwardly by means of the lifting link 12, below the guide tube 10 as it were. The second folding element 25, also connected to the lifting link 12, is located adjacently to the press ring 13.

FIGS. 32A and 32B: Third Situation

The insertion of the first liner piece 8 into the first tensioning unit 11 is equivalent to FIGS. 16A and 16B, but turned here through 180°.

FIGS. 33A and 33B: Fourth Situation

The insertion of the first liner piece 8 into the second tensioning unit 21 is equivalent to FIG. 19, but turned here through 180°.

FIGS. 34A and 348: Fifth Situation

The lower end of the second liner remainder 8" is guided upwardly through the open second tensioner 212 at the second tensioning unit 21.

FIGS. 35A and 35B: Sixth Situation

The lower end of the first liner piece 8 is firstly guided through the open second tensioner 212 at the second tensioning unit 21 and is then fixed by means of closed second tensioner 212 at the second tensioning unit 21.

FIGS. 36A to 37B: Seventh and Eighth Situation

This pair of figures shows, in abbreviated form, the discharge of the first liner remainder 8' with deactivated first tensioner 111 at the first tensioning unit 11 and also the discharge of the second liner remainder 8" from the first tensioner 211 at the second tensioning unit 21. The corresponding steps have already been described in the series of FIGS. 21A to 21H and 25A to 25E and therefore will not be repeated here.

FIGS. 38A and 38B: Ninth Situation

The transfer unit has a state as shown in FIG. 1. The lifting link 12 and therefore the press ring 13 and also the adjacent second folding element 25 are moved down, and in so doing the second folding element 15 presses the lower end of the first liner piece 8 into the first tensioner 211 of the second tensioning unit 21. The seal positioned on the second folding element 25 is in contact with the collar on the second container B and here clamps the first liner piece 8. The first folding element 15—which can be inserted temporarily—is positioned above on the press ring 13.

FIGS. 39A and 39B: Tenth Situation

The lifting link 12 and therefore the press ring 13 are moved down, and in so doing the first folding element 15 presses the upper end of the first liner piece 8 into the groove at the deactivated first tensioner 111. The seal 14 positioned on the press ring 13 is in contact with the collar 100 and here clamps the first liner piece 8 in a sealed-off manner.

FIGS. 40A and 40B: Eleventh Situation

The press ring 13 is moved down again by means of the lifting link 12 and comes to lie adjacently to the second folding element 25. The first folding element 15 is distanced from the first tensioner 111, which is still at least partially activated. The first tensioner 111 is now fully activated, such that the first liner piece 8 is clamped in a sealed-off manner between the collar 100 and the first tensioner 111. The lower end of the first liner piece 8 is held twice in the second tensioning unit 21 in a sealed-off manner in both tensioners 211, 212.

FIGS. 41A and 41B: Twelfth Situation

The isolation member 4 is opened between the first container A and the transfer means 1, such that process material from the first container A flows through the transfer means 1 into the docked second container B. The isolation member 4 at the second container B is closed.

FIGS. 42A and 428: Thirteenth Situation

Once the transfer operation is complete, the isolation member 4 between first container A and the transfer means 1 is closed. The further handling of the first liner piece 8 is equivalent to the description of FIGS. 28A and 28B.

A fourth exemplary application of the apparatus in conjunction with a transfer means 1 for emptying a first container A in the form of a drum containing process material in the form of flowable solid materials is illustrated in the sequence of FIGS. 43A to 57B with the key situations during a transfer operation into a second container B.

FIGS. 43A to 43C: First Situation

The first container A to be emptied has an inner liner A1, which is closed by an upper tying point A6. The cover A2 is removed from the first container A, and before this the tensioning ring was detached. The third folding element 35 is placed around the first container A1, and adjacently thereto a new special liner piece 9 with intervention part 93 is placed around the upper region of the first container A. The lower end of the special liner piece 9 is fixed to the first container A in a seal 99. The intervention part 93 preferably has the form of a glove.

FIG. 44: Second Situation

A funnel-shaped installation part C is provided above the first container A, on which installation part there is mounted a third tensioning unit 31 near the first container A, whereas an isolation member 4 and thereabove a second tensioning unit 21 are attached remotely from the container A. The upper end of a third special liner remainder 9' of a previous transfer operation is fixed in a sealed-off manner in the activated first tensioner 311 at the third tensioning unit 31. The upper end of the special liner piece 9 is introduced into the open second tensioner 212 of the second tensioning unit 21. Alternatively to the second tensioning unit 21 with the second liner remainder 8" fixed therein, an endless liner head 4, to which a liner stock 47 is applied, could be installed. The endless liner head 4 provides first liner pieces 8, of which the free ends are each provided in the starting situation with a closure 80.

FIG. 45: Third Situation

Access for the purpose of removing the tying point A6 from the inner liner A1 is provided by means of the intervention part 93. The upper end of the inner liner A1 is drawn over the rim of the first container and inserted between the container casing and lower end of the special liner piece 9.

FIGS. 46A and 46B: Fourth Situation

The first tensioner 311 of the third tensioning unit 31 is deactivated. The special liner remainder 9' is grasped by the intervention part 93 and transported externally in this captured manner. A second crimp 92 and, close thereto, a next first crimp 91 are now provided on the second liner piece 9 close to the intervention part 93. The special liner piece 9 is severed between second and next first crimp 92,91, whereupon the separated intervention part 93 is removed. The third folding element 35 is slid upwardly and positioned on the rim of the first container A.

FIGS. 47A and 47B: Fifth Situation

The first container A and the assembly formed from installation part C comprising the second and third tensioning unit 21,31 are moved toward one another. By means of the third folding element 35, the upper end of the special liner piece 9 is pressed in at the first tensioner 311 of the third tensioning unit 31.

FIGS. 48A and 48B: Sixth Situation

In order to attain a preload acting on the folded-in upper end of the special liner piece 9, the first tensioner 311 at the third tensioning unit 31 is at least partially activated as the third folding element 35 is extracted.

FIGS. 49A to 49D: Seventh Situation

The first container A and the assembly formed from installation part C comprising the second and third tensioning unit 21,31 are moved away from one another (see FIG. 49A). The third folding element 35 is distanced from the first tensioner 311 of the third tensioning unit 31, whereupon the first tensioner is fully activated now at the latest (see FIG. 49B). The third folding element 35 is lastly slid downwardly and positioned around the first container A (see FIG. 49D).

FIGS. 50A and 50B: Eighth Situation

The first container A and the assembly formed from installation part C comprising the second and third tensioning unit 21,31 are moved toward one another again. Here, the third seal 34 sits with the third tensioning unit 31 on the rim of the first container A.

FIGS. 51A and 51B: Ninth Situation

The assembly formed from first container A and installation part C comprising 20 second and third tensioning unit 21,31 or alternative endless liner head 6 and only the third tensioning unit 31 is turned upside down. The transfer means 1 with the second container B is positioned below this structure. The first liner remainder 8' from a previous transfer operation is held in a sealed-off manner in first tensioning unit 11 of the transfer means 1 (see FIG. 51A). FIG. 51B shows the upside-down assembly according to FIG. 51A with the alternative endless liner head 6 and only the third tensioning unit 31. For the purpose of providing a new first liner piece 8, a length is drawn off from the liner stock 47. As an alternative to an inserted separate liner piece 8 or a liner piece 8 drawn off from the endless liner head 6, a double flap 45 can be installed between the installation part C and the 30 second container B, such that the first and second tensioning unit 11,21 are omitted.

FIGS. 52A to 52E: Tenth Situation

A divided-off first liner piece 8 is inserted between the first tensioning unit 11 and the second tensioning unit 21. The lower end of the first liner piece 8 is guided through the open second tensioner 112 of the first tensioning unit 11 and the upper end of the liner piece 8 is guided through the open second tensioner 212 at the second tensioning unit 21 (see FIGS. 52A and 52B). Alternatively, a first liner piece 8 drawn off from the endless liner head 4 is inserted, and then only the lower end of the first liner piece 8 needs to be guided through the open second tensioner 112 of the first tensioning unit 11 (see FIG. 52C). In the version without the endless liner head 4, both second tensioners 112,212 of the first and second tensioning unit 11,21 are closed (see FIGS. 52D and 52E).

FIGS. 53A to 53D: Eleventh Situation

What is illustrated is the discharge of first liner remainder 8' and second liner remainder 8" with respective utility portion 70 of the liner stock 7 from the transfer unit 16. Once the first tensioner 111 of the first tensioning unit 11 has been deactivated, the first liner remainder 8' is discharged in the previously described manner (see FIGS. 53A and 53B). Following deactivation of the first tensioner 211 of the second tensioning unit 21, the second liner remainder 8" is then discharged (see FIGS. 53C and 53D).

FIGS. 54A to 54F: Twelfth Situation

The press ring with second folding element 25 is moved upwardly toward the second tensioning unit 21 in order to press the upper end of the first divided-off liner piece 8 against the associated first tensioner 211 (see FIGS. 54A and 54B). The press ring 13 is then moved downwardly, the first tensioner 211 of the second tensioning unit 21 is activated, and the second folding element 25 is distanced from the first tensioner 211 at the second tensioning unit 21. The press ring 13 with the seal 14 is now placed against the collar 100 of the guide tube 10 of the transfer means 1, and the lower end of the divided-off liner piece 8 is pressed by means of the first folding element 15 against the first tensioner 111 of the first tensioning unit 11 (see FIGS. 54C and 54D). In this phase, lastly, the press ring 13 is moved upwardly, and the first folding element 15 is removed following the activation of the first tensioner 111 of the first tensioning unit 11 (see FIGS. 54E and 54F).

FIGS. 55A and 55B: Thirteenth Situation

The assembly formed from the first container A and installation part C comprising second and third tensioning unit 21,31 is moved closer to the assembly formed from transfer means 1 and second container B. The isolation member 4 at the installation part C is opened, such that process material from the first container A can flow through the guide tube 10 into the second container B.

FIGS. 56A and 56B: Fourteenth Situation

The isolation member 4 at the installation part C is closed, and the assemblies according to FIG. 55A are moved away from one another.

FIGS. 57A and 57B: Fifteenth Situation

In order to complete the transfer operation, a second and, close thereto, a next first crimp 82,81 are provided on the liner piece 8. Once the liner piece 8 has been severed between the crimps 81,82, a new first liner remainder 8' having the mutated crimp 81' and a new second liner remainder 8" having the mutated crimp 82" are created.

A fifth exemplary application of the apparatus in conjunction with a transfer means 1 for emptying a first container A in the form of a drum containing liquid process material into a second container B is illustrated in the sequence of FIGS. 58A to 66, with the key situations during a transfer operation.

FIGS. 58A to 58C: First Situation

The first container A to be emptied is provided with the bung hole A3 closed by a stopper A4. A liner piece 8 is placed around the upper region of the first container A. At the lower end of the liner piece 8, this is fixed to the first container A in a sealed-off manner using a seal 89. The first folding element is positioned on the container rim A5. Here, the upper end of the liner piece 8 is guided through the first folding element 15.

FIGS. 59A to 59C: Second to Fourth Situation

The transport frame T with intake tube T1 and the transfer means 1 are provided. The first liner remainder 8' from the previous transfer operation is fixed in a sealed-off manner in the first tensioner 111 of the first tensioning unit 11 by means of a first crimp 81'. The free end of the first liner remainder 8' hangs down, and the second tensioner 112 is closed. The first container A is positioned congruently below the guide tube 10 of the transfer means 1 in the transport frame T. The upper end of the liner piece 8 is firstly guided through the open tensioner 112 of the first tensioning unit 12 and is then fixed in a sealed-off manner via the upper end by means of the closed second tensioner 112 of the first tensioning unit 12.

FIG. 60: Fifth Situation

The discharge of the liner remainder 8' with groove portion 70 from the liner stock 7 of the transfer unit 16 with deactivated first tensioner 111 at the first tensioning unit 11 is illustrated in abbreviated form. The corresponding steps have already been described in FIGS. 21A to 21H and 25A to 25E and therefore will not be repeated.

FIGS. 61A to 62: Sixth Situation

The transfer means 1 is lowered, such that the first container A and the transfer means 1 are brought together so to speak. Here, the upper end of the liner piece 8 is pressed into the deactivated first tensioner 111 of the first tensioning unit 11 by means of the first folding element 15. The first tensioner 111 is then activated, and the transfer means 1 is moved up, such that the first container A and the transfer means 1 are moved away from one another so to speak. The first folding element 15 is now removed from the first tensioner 111 of the first tensioning unit 11.

FIGS. 63A and 63B: Seventh Situation

The first container A and transfer means 1 are moved toward one another. The first folding element 15 is then placed on the rim A5 of the first container A. The stopper A4 is now removed from the bung hole A3 by means of the intervention points 104 in the guide tube 10 of the transfer means 1.

FIG. 64: Eighth Situation

The intake tube T1 at the transport frame T is introduced through the open bung hole A3 into the first container A. Process material from the first container A is transferred, preferably via a pump, into a second container B arranged after the intake tube T1.

FIGS. 65A and 65B: Ninth Situation

A second crimp 82 and, close thereto, a next first crimp 81 are provided on the liner piece 8.

FIG. 66: Tenth Situation

The first liner piece 8 is severed between the two crimps 81,82, and a new first liner remainder 8' and a new second liner remainder 8" are created. It is now possible to dispose of the emptied first container A, which is sealed off by means of the second liner remainder 8".

The invention claimed is:

1. An apparatus for transferring process material between a first container and a second container, having:

a) at least one tensioning unit, which has a first tensioner and a second tensioner, which can be actuated independently of one another; wherein:

b) the at least one tensioning unit is intended to temporarily fix, in a sealed-off manner:

ba) just an end portion, near to the tensioning unit, of a tubular liner piece, which extends indirectly between the containers, in order to seal off the transition between the containers from the exterior;

bb) just an end portion, near to the tensioning unit, of a tubular liner remainder left over from a previous transfer operation, which liner remainder is closed at the other end by a first crimp; and bc) the end portion of the liner piece simultaneously with the end portion of the liner remainder left over from a previous transfer operation, wherein c) both tensioners of the respective tensioning unit are intended to temporarily fix, in a sealed-off manner, jointly the near end portion of the liner piece or jointly the near end portion of the liner remainder left over from a previous transfer process; and d) both tensioners of the respective tensioning unit are arranged circularly and concentrically with one another in relation to a longitudinal extension of the liner piece.

2. The apparatus as claimed in claim 1, wherein:

a) the first tensioner of the respective tensioning unit is designed with an expansion seal, which is to be acted on or can be activated by media pressure, or has intrinsically resilient clamping jaws; and b) the second tensioner of the respective tensioning unit is provided as a clamp, which is constricted in a closed state and expanded in an open state and has a manually actuatable closure.

3. The apparatus as claimed in claim 2, wherein:

a) the first tensioner of the respective tensioning unit is formed with an expansion seal, which is to be acted on or can be activated by media pressure, or has intrinsically resilient clamping jaws and, within the concentric arrangement, is arranged inwardly in relation to the second tensioner of the same tensioning unit, said second tensioner being provided as a clamp and being externally arranged;

b) the second tensioner of the respective tensioning unit is intended for the temporarily sealed-off fixing of the end portion, near to the tensioning unit, of the liner piece or of the liner remainder; and c) the first tensioner of the tensioning unit is intended for the temporary sealed-off fixing of the near end portion of the liner piece or of the liner remainder by means of folding in with a looped course, wherein, on the end portion of the liner piece or liner remainder, a sealed-off fixing point in the respective first tensioner lies closer to the rest of the liner piece or to the rest of the liner remainder than a sealed-off fixing point in the respective second tensioner.

4. The apparatus as claimed in claim 3, wherein between the first container and the second container there is arranged a transfer means, which comprises:

a) a guide tube, which is intended to guide the process material between the containers, the guide tube having a first aperture and a second aperture;

b) a transfer unit, which leads into the guide tube and allows intervention through the guide tube; and c) the first tensioner of a first tensioning unit arranged in a collar surrounding the guide tube; wherein:

d) the end of the liner piece near the first tensioning unit is drawn over the outer surface of the collar and the second tensioner belonging to the first tensioning unit serves, in the closed state, to seal off and fix this end of the liner piece; and e) on one side of the first tensioner there is provided an outwardly opening annular gap, into which the relevant end of the liner piece can be folded in a looped manner and against which the first tensioner presses in a sealing manner under application of a force.

5. The apparatus as claimed in claim 4, wherein:

a) a tubular liner stock that can be extracted from the transfer unit is stored thereon; and b) a utility portion removed from the liner stock can be introduced through the transfer unit into the guide tube and is intended to sheathe the liner remainder left over from the previous transfer operation and remaining at the first tensioning unit, and to transfer this liner remainder externally.

6. The apparatus as claimed in claim 5, wherein:

a) the utility portion is closed toward a mouth into the guide tube by means of a first crimp, lies in the transfer unit, and is advanced toward the mouth by a stopper, which can be introduced from a free end of the transfer unit;

b) the utility portion is sealed off from the liner stock in a releasable front seal point;

c) the front seal point is formed by a flange, which can be slid toward the free end of the transfer unit and which has a head seal provided thereon, which head seal is placed circularly onto the utility portion wound around the free end of the transfer unit;

d) the stopper, which can be removed from the transfer unit through the flange, is connected to a cover that can be pre-placed, before the flange;

e) the transfer unit is formed in the manner of a side support starting from the guide tube and leads at an incline into a wall of the guide tube via a through-opening; and f) the end of the liner stock is fixed in a sealed-off manner by means of a termination element on the transfer unit.

7. The apparatus as claimed in claim 6, wherein:

a) the transfer means also has a lifting link and a press ring transported thereby, which initially serves to be placed with compressive force congruently against the first tensioning unit in order to create an additional seal at the end of the liner piece fixed in a sealed-off manner or at the liner remainder remaining in the first tensioning unit from a previous transfer operation, wherein the liner piece or the liner remainder are guided through the press ring; and b) the press ring additionally can be used to fold the end of the liner piece near the first tensioning unit into the first tensioner by means of an inwardly pressing annular folding element.

8. The apparatus as claimed in claim 7, wherein: the first container has the form of a bag to be emptied, wherein an inner liner provided with a closure extends out from the bag, the free end of said inner liner being usable for the transfer operation as a liner piece for leading to the first tensioning unit on the transfer means.

9. The apparatus as claimed in claim 7, wherein:

a) the first container has the form of a container to be emptied having an inflexible outlet; and b) for the transfer operation, a liner piece extends from a first tensioning unit on the transfer means to a second tensioning unit, which: is installed directly on the first container to be emptied or on an intermediate installation part connected to the first container; wherein the second tensioning unit is intended to temporarily fix, in a sealed-off manner, the near end of the liner piece and/or a second liner remainder remaining from the previous transfer process.

10. The apparatus as claimed in claim 7, wherein:

a) the first container has the form of a drum to be emptied; and b) for the transfer operation a special liner piece having an intervention part extends from a third tensioning unit to a seal circularly running externally around the first container to be emptied; wherein:

ba) the third tensioning unit is near the first container, installed on one side of an installation part arranged between the containers; and bb) the third tensioning unit is intended to temporarily fix, in a sealed-off manner, the near end of the special liner piece or a first special liner remainder remaining from the previous transfer operation.

11. The apparatus as claimed in claim 10, wherein: a second tensioning unit is arranged on the installation part, remotely from the first container, and is intended to temporarily fix, in a sealed-off manner, the near end of a liner piece, which extends as far as the first tensioning unit on the transfer means and to which the second container is connected.

12. The apparatus as claimed in claim 7, wherein the first container has the form of a drum to be emptied, wherein, for the transfer operation, a liner piece extends from the tensioning unit on the transfer means to a seal circularly running externally around the first container.

13. The apparatus as claimed in claim 7, wherein:

a) the first container has the form of a container to be emptied having an inflexible outlet; and b) for the transfer operation, a liner piece extends from a first tensioning unit on the transfer means to a second tensioning unit, which:

is installed directly on the second container to be filled or on an intermediate installation part connected to the second container; wherein the second tensioning unit is intended to temporarily fix, in a sealed-off manner, the near end of the liner piece or a second liner remainder remaining from the previous transfer operation.

14. The apparatus as claimed in claim 7, wherein:

a) the first container has the form of a container to be emptied having an inflexible outlet; and b) for the transfer operation, a liner piece extends from a first tensioning unit on the transfer means to a second tensioning unit, which:

is installed directly on the second container to be filled or on an intermediate installation part connected to the second container; wherein the second tensioning unit is intended to temporarily fix, in a sealed-off manner, the near end of the liner piece and a second liner remainder remaining from the previous transfer operation.

15. The apparatus as claimed in claim 7, wherein:

a) the first container has the form of a drum to be emptied; and b) for the transfer operation a special liner piece having an intervention part extends from a third tensioning unit to a seal circularly running externally around the first container to be emptied; wherein:

ba) the third tensioning unit is near the first container, installed on one side of an installation part arranged between the containers; and bb) the third tensioning unit is intended to temporarily fix, in a sealed-off manner, the near end of the special liner piece and a first special liner remainder remaining from the previous transfer operation.

16. The apparatus as claimed in claim 10, wherein:

an endless liner head having a liner stock stored thereon is arranged on the installation part, remotely from the first container, and is intended to provide a liner piece which extends as far as the first tensioning unit on the transfer means and to which the second container is connected.

17. The apparatus as claimed in claim 10, wherein:

a double flap is arranged as isolation valve on the installation part, remotely from the first container, and is connected by the second container.

* * * * *